US009480317B2

(12) United States Patent
Rothschild et al.

(10) Patent No.: US 9,480,317 B2
(45) Date of Patent: Nov. 1, 2016

(54) MULTIPURPOSE STORAGE DEVICE AND METHOD

(71) Applicant: International Holdings, LLC, Northfield, IL (US)

(72) Inventors: Wayne H. Rothschild, Northbrook, IL (US); Maxwell Bell Rothschild, Northbrook, IL (US)

(73) Assignee: International Holdings, LLC, Northfield, IL (US)

( * ) Notice: Subject to any disclaimer, the term of this patent is extended or adjusted under 35 U.S.C. 154(b) by 178 days.

(21) Appl. No.: 14/219,778

(22) Filed: Mar. 19, 2014

(65) Prior Publication Data

US 2014/0262862 A1 Sep. 18, 2014

Related U.S. Application Data

(63) Continuation of application No. 12/892,281, filed on Sep. 28, 2010, now Pat. No. 8,714,389, which is a continuation of application No. 11/263,424, filed on Oct. 31, 2005, now Pat. No. 7,845,508, which is a continuation-in-part of application No. 11/046,423, filed on Jan. 28, 2005, now Pat. No. 7,597,209.

(51) Int. Cl.

| | |
|---|---|
| ***A45C 7/00*** | (2006.01) |
| ***A45C 9/00*** | (2006.01) |
| ***A45C 15/00*** | (2006.01) |

(Continued)

(52) U.S. Cl.

CPC ..... *A45C 7/0036* (2013.01); *A45C 7/0054* (2013.01); *A45C 9/00* (2013.01); *A45C 15/00* (2013.01); *A47G 9/062* (2013.01); *A45C 5/06* (2013.01); *A45C 13/02* (2013.01);

(Continued)

(58) Field of Classification Search

CPC ..... A45C 13/02; A45C 7/0095; A45C 9/00
USPC ..... 220/6, 7, 666, 4.01; 190/1, 2, 107, 901, 190/903

See application file for complete search history.

(56) References Cited

U.S. PATENT DOCUMENTS

| | | | | |
|---|---|---|---|---|
| 170,991 | A | 12/1875 | Conover | 229/186 |
| 1,269,276 | A | 6/1918 | Harris | 383/4 |

(Continued)

OTHER PUBLICATIONS

Information brochure from Homegrown Kids—Toy Taco www.toydirectory.com/monthly/toyfairpreview/Homegrown/index.asp; (Apr. 2005); 1 page.

(Continued)

*Primary Examiner* — Shawn M Braden
(74) *Attorney, Agent, or Firm* — Nixon Peabody LLP

(57) ABSTRACT

A convertible device that converts between an activity mat and a storage container to capture and store numerous articles. Upon reclosing the activity mat, the articles are recaptured into the storage container. The device includes walls and a base, webbing connected between each adjacent wall pair, and a joint connected between the base and walls so that they are foldable into a third configuration wherein the footprint of the folded device is roughly the size of the base. In the third configuration, the walls are stacked relative to the base. The convertible device may further include two zippers for releasably holding the walls in a rigid and upright position in the first configuration. The webbing can be inwardly biased such that when the walls are urged from the second to the first configuration, the webbing folds toward the interior of the convertible device.

7 Claims, 51 Drawing Sheets

(51) Int. Cl.

| | |
|---|---|
| ***A47G 9/06*** | (2006.01) |
| *A45C 5/06* | (2006.01) |
| *A45C 13/02* | (2006.01) |
| *A45C 13/10* | (2006.01) |

(52) U.S. Cl.

CPC ..... *A45C 13/103* (2013.01); *A45C 13/1038* (2013.01); *A45C 2007/0004* (2013.01)

(56) References Cited

U.S. PATENT DOCUMENTS

| | | | | |
|---|---|---|---|---|
| 1,365,831 | A | 1/1921 | Hyatt | 5/285 |
| 1,467,690 | A | 9/1923 | Schwarz | 206/315.1 |
| 1,985,111 | A | 12/1934 | Shofer et al. | 229/14 |
| 2,085,038 | A | 6/1937 | Pretton | 229/31 |
| 2,105,953 | A | 1/1938 | Quellette | 229/34 |
| 2,254,578 | A | 9/1941 | O'Brien | 190/43 |
| 2,479,203 | A | 8/1949 | Brown | 150/11 |
| 2,636,313 | A | 4/1953 | Shank | 46/11 |
| 2,768,719 | A | 10/1956 | Samuel | 190/43 |
| 2,831,624 | A | 4/1958 | Lever | 229/52 |
| 2,884,159 | A * | 4/1959 | Simpson | F16J 13/20 220/211 |
| 3,044,211 | A | 7/1962 | Palm | 46/11 |
| 3,097,782 | A | 7/1963 | Koropatkin et al. | 229/31 |
| 3,173,465 | A | 3/1965 | Pastini | 150/108 |
| 3,262,283 | A | 7/1966 | Taylor | 62/372 |
| 3,375,008 | A | 3/1968 | Atkinson | 273/101 |
| 3,542,569 | A | 11/1970 | Farquhar | 99/174 |
| 3,542,589 | A | 11/1970 | Hartman et al. | 117/235 |
| 3,612,330 | A * | 10/1971 | Baer | B65D 88/524 220/1.5 |
| 3,627,541 | A | 12/1971 | Farquhar | 99/171 |
| 3,747,832 | A | 7/1973 | Chapman | 229/31 |
| 3,976,113 | A | 8/1976 | Kim | 150/12 |
| 4,019,675 | A | 4/1977 | Andersson et al. | 229/31 |
| 4,091,852 | A | 5/1978 | Jordan et al. | 150/5 |
| 4,126,213 | A | 11/1978 | McDonald | 190/18 |
| 4,199,097 | A | 4/1980 | Christensson | 229/31 |
| 4,206,868 | A | 6/1980 | Stephens | 229/33 |
| 4,306,658 | A | 12/1981 | Montealergre | 206/611 |
| 4,340,169 | A | 7/1982 | Webinger | 229/31 |
| 4,375,111 | A | 3/1983 | Hall | 5/419 |
| 4,397,398 | A | 8/1983 | Watanabe | 220/7 |
| 4,451,001 | A | 5/1984 | Webinger | 229/40 |
| 4,489,815 | A | 12/1984 | Martinez et al. | 190/1 |
| 4,509,645 | A | 4/1985 | Hotta | 206/545 |
| 4,661,195 | A | 4/1987 | Hopson | 156/344 |
| 4,681,195 | A | 7/1987 | Trahan et al. | 190/2 |
| 4,712,673 | A | 12/1987 | Moore | 206/232 |
| 4,738,545 | A | 4/1988 | Westgor | 383/4 |
| 4,765,533 | A | 8/1988 | Hoshiko et al. | 229/101 |
| 4,791,883 | A | 12/1988 | Lehman et al. | 119/1 |
| 4,853,985 | A * | 8/1989 | Perry | B65F 1/1623 16/287 |
| 4,930,680 | A | 6/1990 | Hanus | 229/110 |
| 4,984,906 | A | 1/1991 | Little | 383/4 |
| 5,016,813 | A | 5/1991 | Simons | 229/189 |
| 5,033,668 | A | 7/1991 | Cohen et al. | 229/186 |
| 5,035,013 | A | 7/1991 | Bloom | 5/420 |
| 5,048,975 | A | 9/1991 | Holbrook | 383/4 |
| 5,088,139 | A | 2/1992 | Bloom | 5/420 |
| 5,100,151 | A | 3/1992 | Lyon et al. | 273/285 |
| 5,136,738 | A | 8/1992 | Denson | 5/417 |
| 5,207,376 | A | 5/1993 | Cohen et al. | 229/186 |
| 5,255,841 | A | 10/1993 | Ritter | 229/103 |
| 5,294,040 | A | 3/1994 | Cohen et al. | 229/8 |
| 5,328,265 | A | 7/1994 | Clooney | 383/4 |
| 5,332,093 | A | 7/1994 | Littlepage | 206/457 |
| 5,370,460 | A | 12/1994 | Nelson | 383/4 |
| D361,890 | S | 9/1995 | Littlepage | D3/271 |
| 5,630,543 | A | 5/1997 | Dugan | 229/109 |
| 5,788,350 | A | 8/1998 | Fladung | 312/321.5 |
| 5,853,121 | A | 12/1998 | Francisco | 229/188 |
| 5,904,230 | A | 5/1999 | Peterson | 190/107 |
| 6,048,249 | A | 4/2000 | Vandenberg | 446/75 |
| 6,050,483 | A | 4/2000 | Haraldsson et al. | 229/114 |
| 6,053,634 | A | 4/2000 | Kay | 383/4 |
| 6,059,179 | A | 5/2000 | Giampapa | 229/103 |
| 6,079,616 | A | 6/2000 | Chinks et al. | 229/101 |
| 6,146,238 | A | 11/2000 | Daiber | 446/478 |
| D435,342 | S | 12/2000 | Mogil | D3/283 |
| D435,968 | S | 1/2001 | Mogil | D3/283 |
| D436,442 | S | 1/2001 | Mogil | D3/283 |
| 6,193,034 | B1 | 2/2001 | Fournier | 190/107 |
| 6,203,017 | B1 | 3/2001 | Schultz | 273/285 |
| 6,247,328 | B1 | 6/2001 | Mogil | 62/457.2 |
| 6,523,989 | B2 | 2/2003 | Carty | 366/129 |
| 6,572,436 | B1 | 6/2003 | So | 446/478 |
| 6,575,273 | B1 | 6/2003 | Bergkvist et al. | 190/114 |
| 6,663,459 | B2 | 12/2003 | Ostolaza | 446/75 |
| 6,676,010 | B1 | 1/2004 | Roseth et al. | 229/114 |
| 6,688,516 | B1 | 2/2004 | Ussen | 229/198.2 |
| 6,736,309 | B1 | 5/2004 | Westerman et al. | 229/117.05 |
| D493,618 | S | 8/2004 | DeCarlo et al. | D3/302 |
| D494,758 | S | 8/2004 | DeCarlo et al. | D3/302 |
| D500,205 | S | 12/2004 | DeCarlo et al. | D3/302 |
| D510,189 | S | 10/2005 | Greiner | D3/295 |
| D518,637 | S | 4/2006 | DeCarlo et al. | D3/302 |
| 7,044,277 | B2 | 5/2006 | Redzisz | 190/107 |
| 7,143,932 | B2 | 12/2006 | Wang | 229/117.35 |
| 7,188,713 | B1 | 3/2007 | Espar et al. | 190/2 |
| 2006/0169691 | A1 | 8/2006 | Rothschild et al. | 220/7 |
| 2006/0177154 | A1 | 8/2006 | Morrissey, Jr. | 383/4 |

OTHER PUBLICATIONS

Information brochure from Parents of Innovation—Romp'n Run www.parentsofinvention.com/home.html; (Apr. 2005); 1 page.

Information brochure from Homegrown Kids—Activity Cooler www.toydirectory.com/monthy/toyfairpreview/Homegrown/index.asp; (Apr. 2005); 1 page.

Information brochure from Venlo Valet Tray—Valet Tray www.worldlux.com.gci?field0'Valet%20Tray &dept=LEATH&collect; (Apr. 2005); 1 page.

Photo image from Parentsoup—Manicure Lap Desk www.parentsoup.com/specialevents/holiday2004/photo/0..654798.655903.00.html; (Apr. 2005); 1 page.

Photographs of packaging and product—Marshmallow—Create—A-Room School Bus Autobus; (Apr. 2005); 9 pages.

Photographs of packaging and product—Worlds Apart—Ready Room™ Collection—Pack & Playmates Truck; (Apr. 2005); 8 pages.

Photographs of packaging and product—Worlds Apart—Ready Room™ Collection—Pack & Playmates Cottage; (Apr. 2005); 18 pages.

Photographs of packaging and product—Worlds Apart—Ready Room™ Fold-away soft storage—Pack & Playmates Fire Truck; (Apr. 2005); 11 pages.

Toys Et Cetera Fall 2005 Catalog Description of a Play Mat (printed from the Internet on Oct. 4, 2005); 1 page.

Foldable Storage Box Small Grey at dwell. Downloaded Jun. 22, 2007 at http://dwell.co.uk/product.php?prod=102584; 1 page.

Written Opinion corresponding to co-pending International Patent Application Serial No. PCT/US2008/010272, United States Patent Office, dated Dec. 9, 2008, 6 pages.

International Search Report corresponding to co-pending International Patent Application Serial No. PCT/US2008/010272, United States Patent Office, dated Dec. 9, 2008, 3 pages.

Written Opinion corresponding to co-pending International Patent Application Serial No. PCT/US2006/02521, United States Patent Office, dated Sep. 13, 2007, 4 pages.

International Search Report corresponding to co-pending International Patent Application Serial No. PCT/US2006/02521, United States Patent Office, dated Dec. 9, 2008, 3 pages.

Product Information Sheet for Clink-Proof 6-Pack Wetsuit: Flat Lunch Pack Tote; Herrington Catalog.com, "Wetsuit for 6-Packs Gives You a Clink-Proof Way to BYOB!" 2 pages (printed from the Internet on Dec. 6, 2005).

* cited by examiner

MULTIPURPOSE STORAGE DEVICE AND METHOD

CROSS-REFERENCE TO RELATED APPLICATIONS

This application is a continuation of U.S. patent application Ser. No. 12/892,281, filed Sep. 28, 2010, which is a continuation of U.S. patent application Ser. No. 11/263,424, filed Oct. 31, 2005, now U.S. Pat. No. 7,845,508, which is a continuation-in-part of prior U.S. patent application Ser. No. 11/046,423, filed Jan. 28, 2005, now U.S. Pat. No. 7,597,209, each of which is hereby incorporated by reference herein in its entirety.

FIELD OF THE INVENTION

This invention relates generally to storage devices and, more particularly, to convertible containers that be converted between a storage device and an activity mat.

BACKGROUND OF THE INVENTION

Projects and activities involving multiple pieces are often difficult and time-consuming to clean up. This is especially true when there are hundreds of small pieces. Most often, the articles are stored in containers and then dumped out for use. When it is time to stop participating in the activity, the articles are put back into the container. If the participant is a child, the clean-up process can cause frustration for both the child and the child's care-giver.

Examples of activities involving numerous small articles include: building sets, bead making, crafts, painting, clay modeling, personal grooming such as manicures, make-up, etc., household repairs, auto repairs, machinery repair, board games, puzzles, train sets, and the like. Examples of small articles include dolls, marbles, jacks, beads, puzzles, Christmas decorations, and the like. Examples of containers that can hold numerous small articles include lunch boxes, picnic baskets.

Storage containers, play mats, and work mats of various sizes and configurations exist for toys, crafts, and tools. These containers and mats lack a combination of features that make them easily convertible among different configurations, packageable for retail, stackable, and able to capture many articles without the possibility of the articles hindering or obstructing the conversion process.

Thus, there is a need for a collapsible device that has the aforementioned and other features. The present invention address this and other needs.

SUMMARY OF THE INVENTION

An object of this invention is to provide a collapsible and transportable storage container that is convertible into an activity mat and convertible back into the storage container whereby the articles used on the activity surface are automatically captured as the sections of the activity mat rise to form the walls of the container.

Additionally, the invention is useable by adults, teenagers, and young children. As such, safety and ease of use are objects of the present invention.

Further objects include providing surfaces that are compatible with particular activities. These surfaces can be washable, cushioned, oil resistant, and/or compatible with interlocking building components such as plastic blocks, building sticks, play dough, food, tools, cosmetics, and the like. Other objectives will be apparent from the detailed description, figures, and claims set forth below.

According to an embodiment of the present invention, a convertible device transformable between at least a storage container in a first configuration and an activity mat in a second configuration includes wall portions each connected to a base portion; a flexible webbing connected between each adjacent pair of the wall portions; and a stretchable or flexible joint connected between the base portion and some of the wall portions such that the wall portions are foldable into a third configuration. The footprint of the collapsible device in the third configuration has substantially the same dimensions as the base portion. In the third configuration, the wall portions are in a folded, stacked relationship relative to the base portion. The convertible device may further include securing means for releasably holding each of the wall portions in a substantially rigid and upright position in the first configuration. Each of the securing means is connectable between adjacent ones of the wall portions. The flexible webbing is inwardly biased such that when the wall portions are urged from the second configuration to the first configuration, the flexible webbing folds toward the interior of the convertible device.

Additionally, the convertible device may further include stiffening wires coupling the base portion with each of the wall portions. The stiffening wires hold the wall portions in an upright, rigid position in the first configuration. The convertible device may further include a lid adapted to cover the storage device in the first configuration. The lid includes registration lips running along an outer periphery thereof such that another convertible device in the first configuration can be stacked on top of the lid in a registered position. The convertible device may further include clasps arranged between the base portion and each wall portion such that the clasps fasten the base portion to each of the wall portions in a substantially upright and rigid position when the convertible device is in the first configuration.

According to a method of assembling a convertible device convertible between at least a storage container in a first configuration and an activity mat in a second configuration, the method includes connecting at least some wall portions to a base portion via a stretchable or flexible joint; connecting a flexible webbing between each adjacent pair of the wall portions; connecting stretchable joints between the base portion and the wall portions such that they are foldable into a third configuration such that the footprint of the convertible device in the third configuration has substantially the same dimensions as the base portion. In the third configuration the wall portions are in a folded, stacked relationship relative to the base portion. The convertible device, when in the third configuration, fits within an optional lid, and may be secured thereto by elastic straps or hook-and-loop fasteners, for example.

The method may further include attaching an attachment mechanism between each of the wall portions to releasably hold them in a substantially rigid and upright position in the first configuration. The method may further include inwardly biasing the flexible webbing such that when the wall portions are urged from the second configuration to the first configuration the flexible webbing folds toward the interior of the convertible device. The method may still further include inserting stiffening wires between the base portion and each of the wall portions so as to hold them in an upright, rigid position in the first configuration.

According to yet another embodiment of the present invention, a convertible device convertible between at least a storage container in a first configuration and an activity mat in a second configuration includes a base connected to walls; at least one motor attached to the base; means, connected to the motor, for raising the walls so as to transform the convertible device from the second configuration into the first configuration. The motor can be a battery-powered electric motor or a spring motor having a windable ratchet and a release for releasing the ratchet from its wound position.

The means for raising can, in alternate embodiments, include shafts attached to the walls and a slip clutch for preventing overloading of the motor, or cables connected to the motor and secured to the walls and respective pulleys positioned to engage the cables so as to urge the walls between a flattened position and an upright position in response to activation of the motor.

The above summary of the present invention is not intended to represent each embodiment, or every aspect, of the present invention. Additional features and benefits of the present invention will become apparent from the detailed description, figures, and claims set forth below.

BRIEF DESCRIPTION OF THE DRAWINGS

The foregoing and other advantages of the invention will become apparent upon reading the following detailed description and upon reference to the drawings.

FIG. 1E-1 is a perspective view of the convertible storage container shown in FIG. 1A in a stacked, folded configuration positioned under the lid of the convertible container according to an embodiment of the present invention.

Figure 1A:
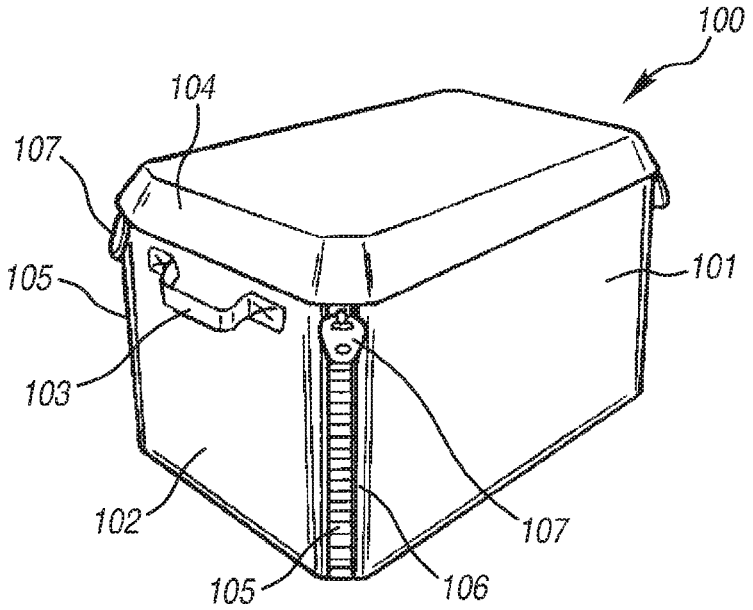
FIG. 1A is a perspective view of a zipper-close convertible storage container in an erect box configuration with a lid attached according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

According to an embodiment of the present invention, a collapsible transportable device is provided for storing articles, which device upon opening converts or transforms into an activity surface for using the articles contained within the container and which upon converting or transforming the activity surface into the container it recaptures the articles that were distributed on the activity surface. In a first configuration, the container has a box-like shape. This configuration is then convertible into a second configuration where the device takes the shape of an activity mat. This configuration is then convertible into a third configuration where the walls of the device assume a folded, stacked relationship. The terms "convertible" and "transformable" and their grammatical variants are used interchangeably herein.

FIG. 1A illustrates a convertible container in a first erect, assembled configuration as a convertible container box 100 with a lid 104 in place. The convertible container box 100 has handles 103 mounted to wall ends 102. Zippers 105 at the corners of the convertible container box 100 releasably hold wall sides 101 to the wall ends 102. When fastened, the zippers hold the wall sides 101 to the wall ends 102, and when unfastened, the zippers operate to release the wall sides 101 from the wall ends 102. The zippers 105 are connected to the wall sides 101 and to the wall ends 102 by way of a resilient material 106. The resilient material 106 allows the zippers 105 to move freely between their fastened and unfastened positions. Without the resilient material 106, it was found that the zippers 105 cannot be fastened unless the sides 101 and ends 102 are in very close alignment. The resilient material 106 provides sufficient "play" between the zipper 105 and the membrane to which the zipper 105 is attached. The resilient material 106 can be a stretchable fabric, such as Spandex, elastane, Lycra, or the like, or any flexible material as mentioned herein. By "resilient," it is meant that the material 106 is at least flexible and can also be stretchable, but not necessarily. The lid 104 can fit loosely on the convertible container box 100 or it can fit snugly thereby adding to the rigidity of the convertible container box 100.

Figure 1B:
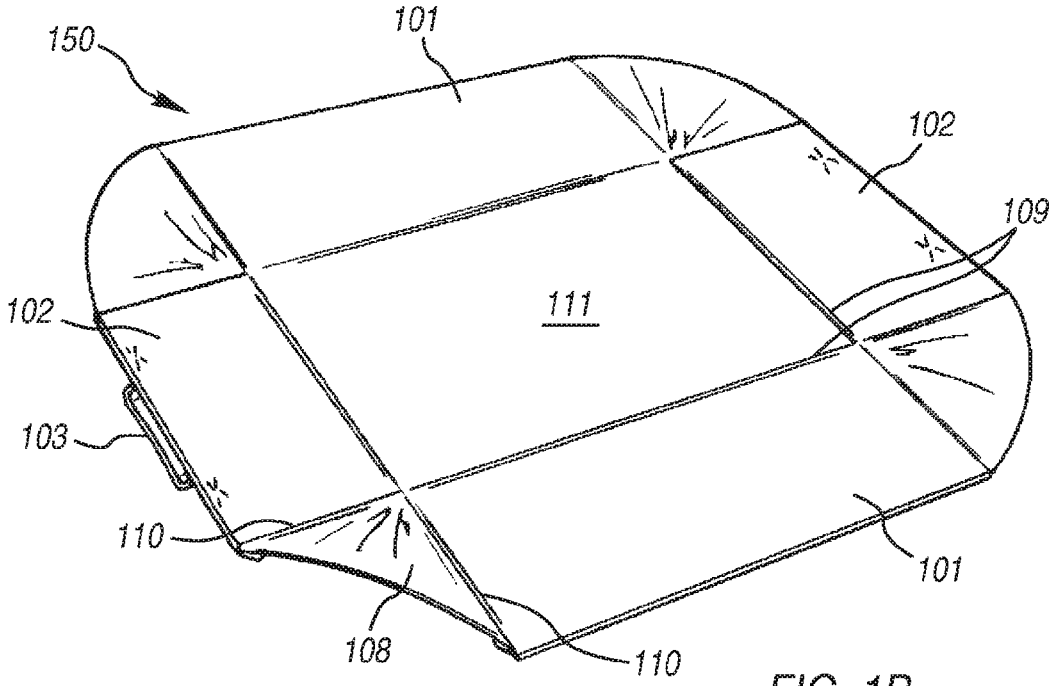
FIG. 1B is a perspective view of the zipper-close convertible storage container shown in FIG. 1A in an open configuration as an activity mat.

FIG. 1B illustrates the convertible container box 100 of FIG. 1A in a second open, flattened configuration as a flattened activity mat 150. To transform the convertible container box 100 into the activity mat 150, the lid 104 is removed and the zipper grips 107 are pulled in a downward direction, unfastening the zippers 105 and flattening the convertible container box 100 into the activity mat 150. The wall sides 101 and wall ends 102 are mounted to the base 111 with flexible joints 109. Flexible webbing 108 is attached at junctions 110 at the wall sides 101 and at the wall ends 102 such that the activity mat 150 forms a continuous surface having a geometric shape. The flexible webbing 108 also pulls the wall sides 101 and wall ends 102 in a downward direction as the zippers 105 are unfastened, thereby contributing to the overall flattening of the activity mat 150 in the second configuration. In the illustrated embodiment, the geometric shape is an octagon. In other embodiments, the geometric shape can be a circle, an ellipse, a square, a rectangle, a hexagon, and a trapezoid.

The flexible webbing 108 can also be stretchable such that during the transformation from one configuration to another, the webbing 108 does not impede the transformation. The flexible webbing 108 is preferably inwardly biased by sewing a stitch line that divides the webbing 108 into two or more geometric shapes such as triangles. Alternatively, an inward bias can be created by inserting formed paperboard or the like into the webbing. Flexibility of the flexible webbing 106 is important to the ability to convert the activity mat into a folded, stacked configuration. The inward bias of the flexible webbing 108 ensures that articles located on the flexible webbing 108 during the conversion from the open, flattened configuration to the erect, assembled configuration do not get trapped within the flexible webbing 108 but rather collect toward the center of the convertible container box 100.

Figure 1C:
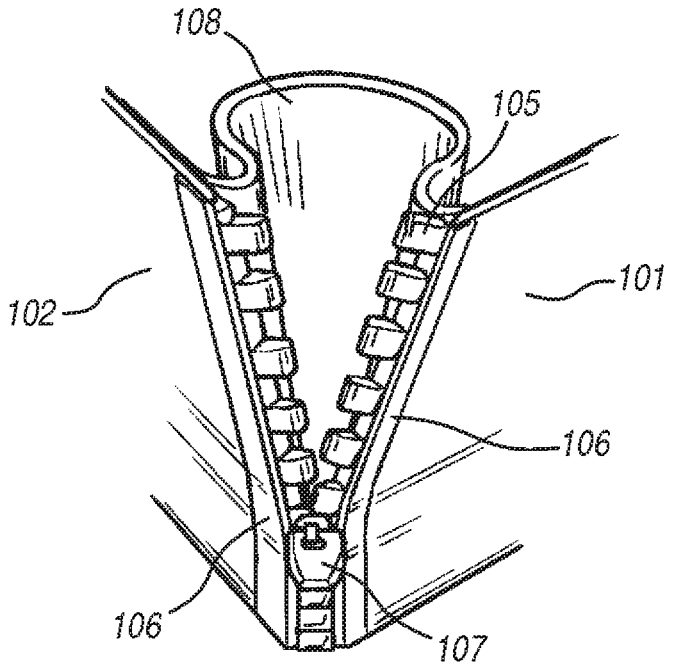
FIG. 1C is a detailed view of one corner of the zipper-close convertible storage container shown in FIG. 1A in a partially opened configuration with the webbing shown biased inwardly according to an embodiment.
Figure 1D:
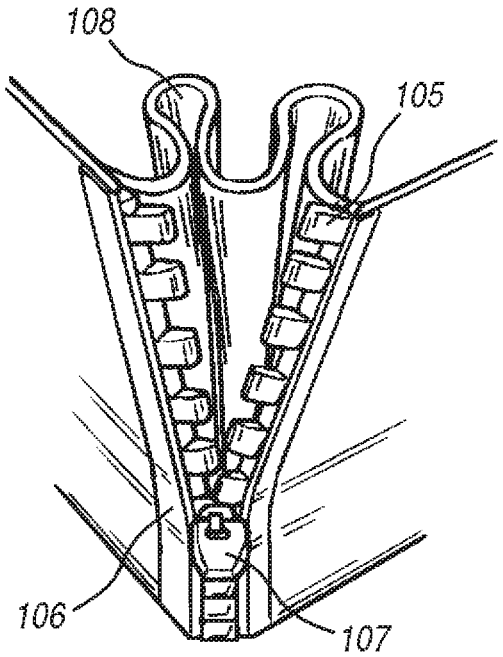
FIG. 1D is a detailed view of one corner of the zipper-close convertible storage container shown in FIG. 1A in a partially opened configuration with unbiased webbing according to another embodiment.

FIGS. 1C and 1D illustrate partial views of a corner of the convertible container box 100. In FIG. 1C, the webbing 108 is inwardly biased such that it stays clear of the zipper 105. In FIG. 1D, the webbing 108 has no such bias. In both FIGS. 1C and 1D, the zipper 105 is connected to the wall side 101 and the wall end 102 by resilient material 106.

In order to transform the configuration of the activity mat 150 into the convertible container box 100, the zipper grip 107 is pulled to fasten the zipper 105. When the wall sides 101 and the wall ends 102 are flat, the zipper 105 is spread wide and the resilient material 106 stretches in order for the zipper grip 107 to begin to close the zipper 105. Similar resilient material can also be used to attach the webbing 108 to the wall sides 101 and wall ends 102 at junctions 110.

Figure 1E:
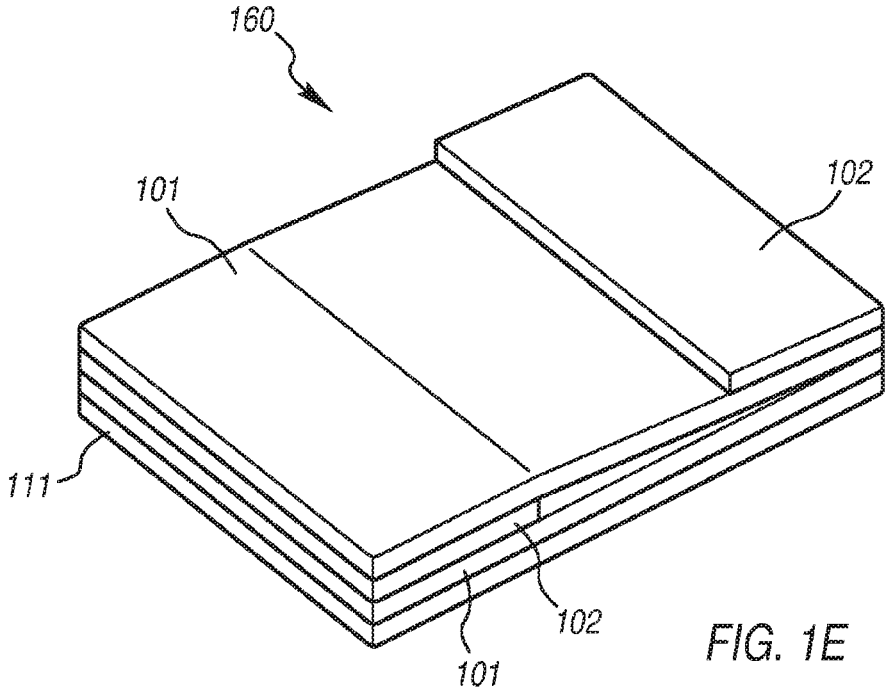
FIG. 1E is a perspective view of the convertible storage container shown in FIG. 1A in a stacked, folded configuration according to an embodiment of the present invention.

FIG. 1E illustrate a convertible container 100 in a third folded, stacked configuration 160 in which the wall sides 101 and wall ends 102 are in a compactly folded, stacked relationship relative to the base 111. The flexible joints 109 (not shown) require sufficient material such that the webbing 108 (not shown) and wall sides 101 are able to fold inward resulting in a compact collapsed form without bending the wall sides 101 or wall ends 102. An alternative embodiment incorporates a resilient member between the webbing 108 and the wall sides 101, which provides the stretch necessary for the convertible container 100 to collapse into its compact form (or third configuration). Furthermore, the fold areas can be made in an accordion form to suit the collapsibility of the convertible container 100. The compact collapsed form advantageously minimizes size for storage, transportation, and retailing.

Figures 1, 1E:
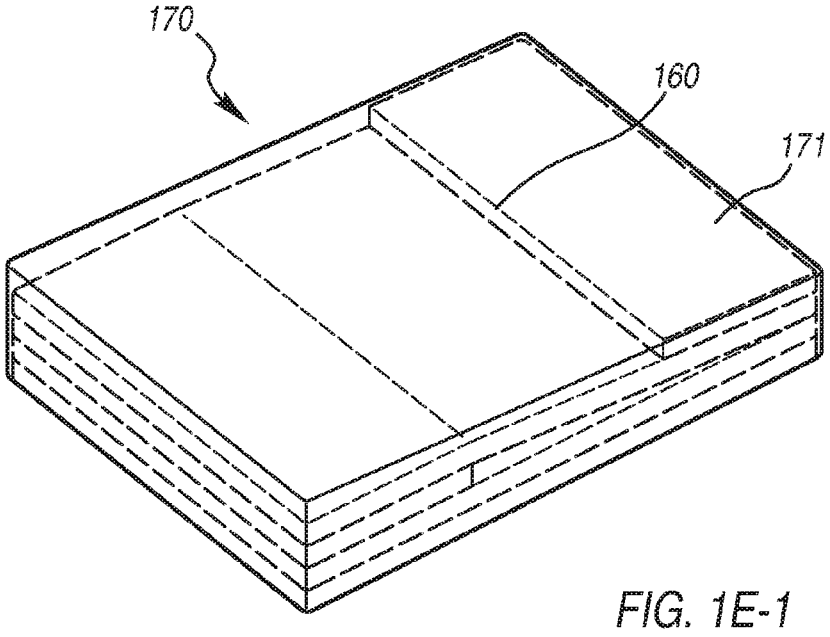

FIG. 1E-1 is a perspective view of the housed convertible storage container 170 shown in a stacked, folded configuration 160 positioned under the lid 171 of the convertible container according to an embodiment of the present invention. This configuration is ideal for storage, transportation and merchandising.

Figure 1F:
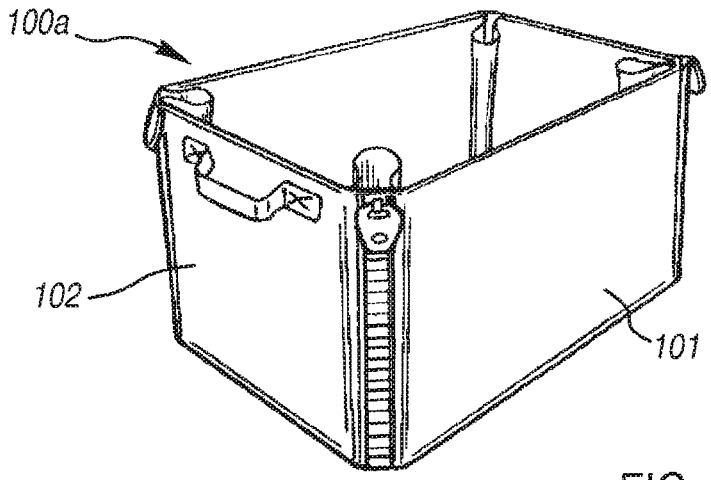
FIG. 1F is a perspective view of a convertible container in an erect box configuration without a lid according an embodiment of the present invention.
Figure 1G:
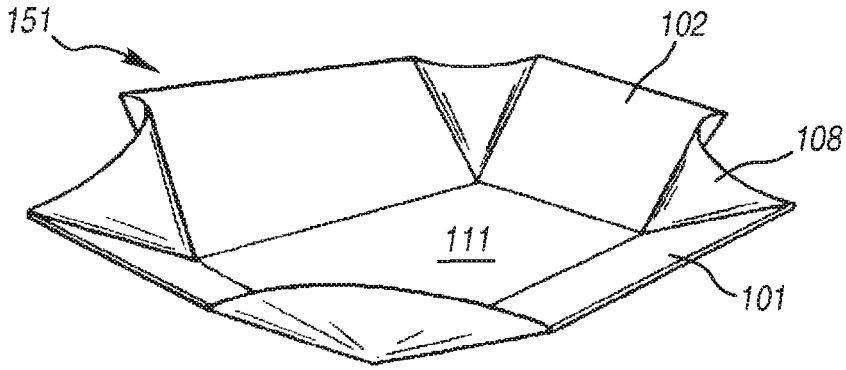
FIG. 1G is a perspective view of the convertible container of FIG. 1F shown in transition between an erect box configuration and an activity mat configuration.

FIG. 1F illustrates a convertible container box 100*a* with wall sides 101 and wall ends 102 in an erect, assembled configuration similar to that shown in FIG. 1A, but without a lid. FIG. 1G illustrates a partially open convertible container box 151 during transition from the convertible container box 100*a* to an activity mat 152. The wall sides 101 and wall ends 102 are at an angle approximately 45 degrees relative to the base 111. The inwardly biased flexible webbing 108 is opening to fill the gap that will be created between the wall sides 101 and the wall ends 102 when the convertible container 100*a* is in the open, flattened configuration. In an embodiment in which seamless material is used create the inner surface of the convertible container box 100*a*, the container can store liquids. The seamless material can be attached to the exposed ends of the wall sides 101 and wall ends 102 to create a seamless interior.

Figure 1H:
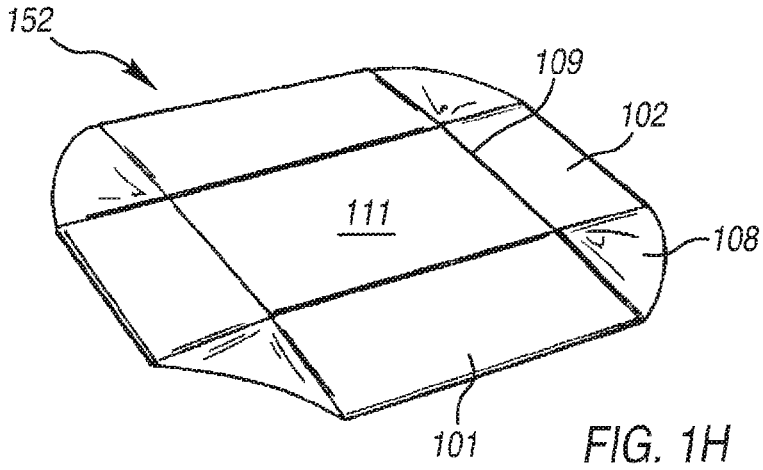
FIG. 1H is a perspective view of the convertible container of FIG. 1F shown in an activity mat configuration.

FIG. 1H is the convertible container box 100*a* shown in an open, flattened configuration as an activity mat 152. In this configuration, the wall sides 101, wall ends 102, base 111, flexible webbing 108, and flexible junctions 109 all lie in substantially the same plane.

Figure 2A:
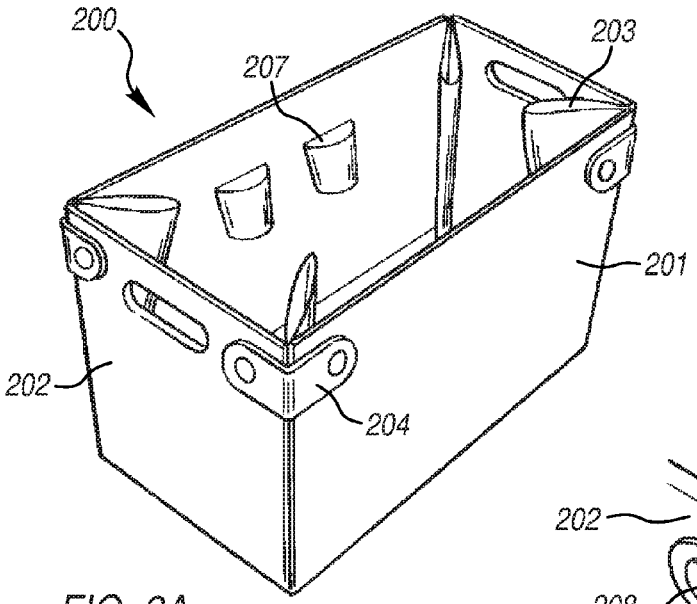
FIG. 2A is a perspective view of a strap-close convertible container in an erect box configuration.

FIG. 2A illustrates a convertible container box 200 similar to the convertible container box 100 in FIG. 1F, except the convertible container box 200 is strap-closed instead of zipper-closed. Wall sides 201 and wall ends 202 of the convertible container box 200 are attached with an attachment strap 204 (that is, one attachment strap for each adjacent pair of walls, as shown). Flexible webbing 203 is attached to the wall sides 201 and the wall ends 202 such that when the convertible container box 200 is converted into an activity mat (not shown) the flexible webbing 203 makes the activity mat a continuous surface. Optional pockets 207 are attached to the inside surface of the wall sides 201 to provide compartmentalized storage for articles.

Figure 2B:
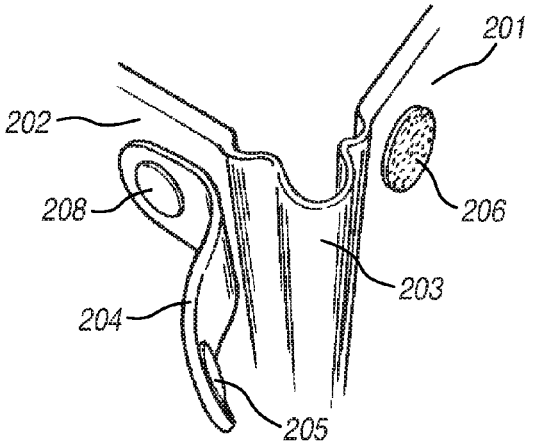
FIG. 2B is a detailed view of a corner of the strap-close convertible container of FIG. 2A in a partially opened configuration.

FIG. 2B illustrates a partial detailed view of a corner of the convertible container box 200 showing the attachment strap 204 attached to the wall end 202 at a fixed mounting point 208. In this illustration, an attachment pad 205 on the opposite end of the attachment strap 204 has been released from its detachable mounting 206 attached to the wall side 201. The attachment pad 205 and detachable mounting 206 can, in various embodiments, be Velcro, adhesive, magnetic, or mechanical in nature. When Velcro is used, the hook side of the Velcro is advantageously situated on the attachment pad 205 and the loop side of the Velcro is best situated on attachment pad 206. In this way, when the convertible container box 200 is used as an activity mat on carpeting, the attachment pad 206 (loop side) will contact the carpet, but the attachment pad 205 (hook side) will be insulated from the carpet by the attachment strap 204 and, therefore, the Velcro will not stick to the carpet.

Figure 3A:
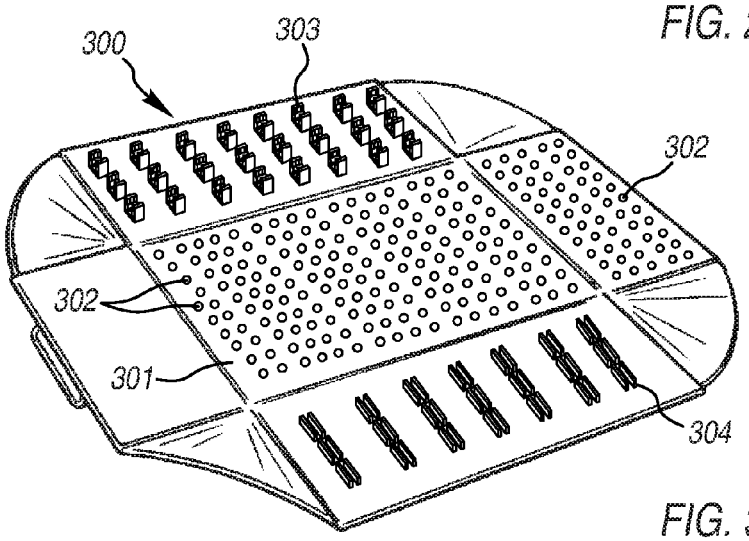
FIG. 3A is a perspective view of the convertible container of FIG. 2A in an open configuration as an activity mat having on its base raised nubs compatible with plastic building blocks according to an embodiment of the present invention.

FIG. 3A shows an activity mat 300 according to an embodiment of the present invention having a base 301, which includes structures 302 that are compatible with plastic building blocks. Structures 302 are rounded plastic nubs compatible with popular plastic building blocks. Similar base or wall structures can be implemented, which are compatible with building sets such as Erector sets, blocks, Playmobil®, foot mounts for dolls such as Barbie®, K'Nex®, crafts, LEGO® building blocks, and the like, such as wall structures 303 and 304. Furthermore, the wall sides and/or the wall ends and/or the lid (see FIG. 10B) can be partially or wholly covered with structures that are compatible with the target activity. Examples of these structures are shown in FIG. 3A, and it should be understood that these structures are for illustration purposes only, and any combination of structures may be formed on the base and/or walls as appropriate to the target activities.

Figure 3C:
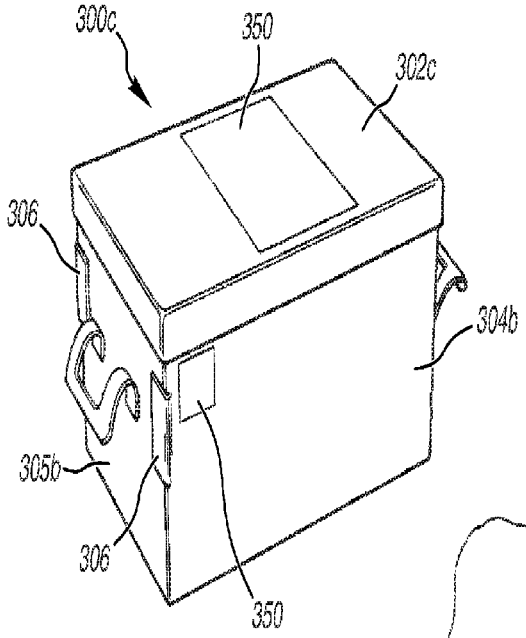
FIG. 3C is a perspective view of the activity mat shown in FIG. 3B converted into a container box in an erect, assembled configuration according to a specific embodiment of the present invention.
Figure 3B:
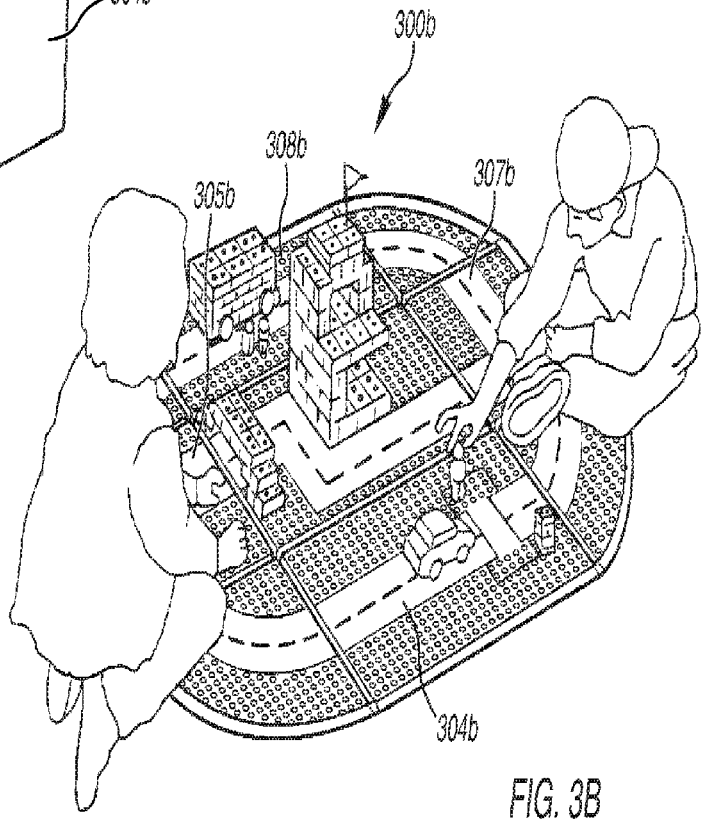
FIG. 3B is a perspective view of an activity mat in an open, flattened configuration according to a specific embodiment of the present invention.

FIGS. 3B and C are perspective illustrations of an exemplary convertible container box 300*c* in an erect, assembled configuration having a lid 302*c* and walls 304*b*, 305*b* that are releasably held together by Velcro straps 306 (FIG. 3C) and in an open, flattened configuration as an activity mat 300*b* as shown in FIG. 3B. The convertible container box 300*c* bears a design relevant to a particular themed activity. In the open, flattened configuration, the activity mat 300*b* exposes the inner surfaces of the walls 304*b*, 305*b*, 307*b*, 308*b* to be used as a play surface. Raised nubs shown on the activity mat 300*b* of FIG. 3B are configured to mate with plastic building blocks, such as LEGO® building blocks. When the children have finished playing on the activity mat 300*b*, it can be quickly converted into the container box 300*c* within seconds, and all of the articles will be contained within the container box 300*c*. When they are ready to play again, they simply unfasten the Velcro straps 306, then unfold the box 300*c* until it converts into the activity mat 300*b*, and resume their play activity. Areas 350 can be used for a logo and/or can be labels on which the owner's name and contact information may be imprinted, for example.

Figure 3D:
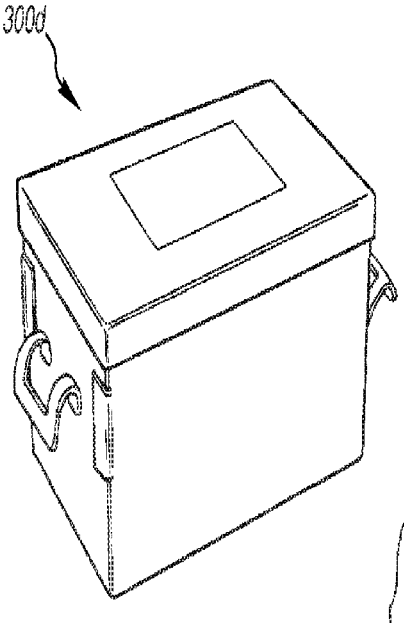
FIGS. 3D and 3E are perspective illustrations of another convertible container box that converts into an activity mat according to another embodiment of the present invention.
Figure 3E:
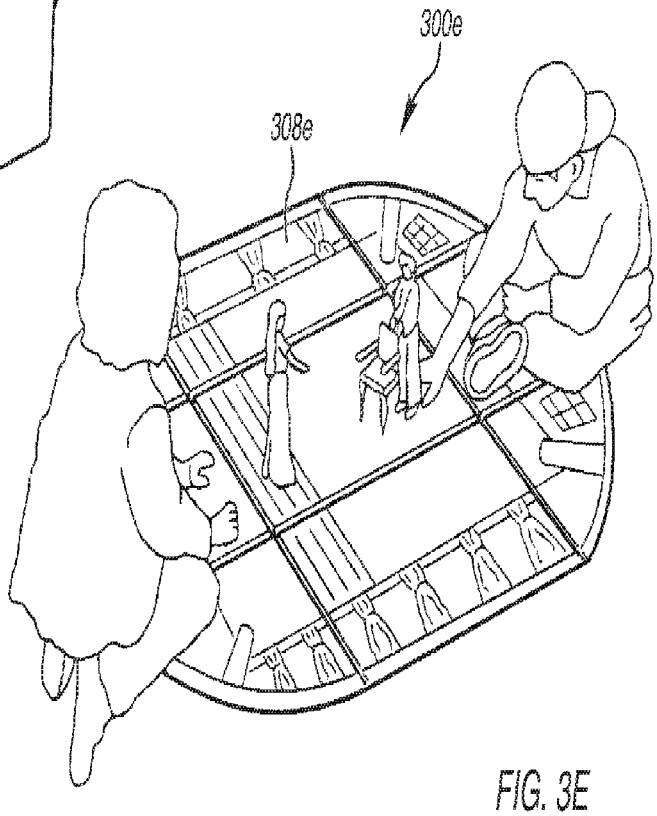

FIGS. 3D and 3E are perspective illustrations of another convertible container box 300*d* that converts into an activity mat 300*e* according to another embodiment of the present invention. The depicted theme is a doll-related theme, whereby the exterior of the container box 300*d* includes a landscape design of the exterior of a dollhouse. When the user opens the container box 300*d* to convert it to the activity mat 300*e*, the sense is that one is entering the dollhouse. Similarly, the activity mat 300*e* depicts an interior of the dollhouse, and as described in connection with FIGS. 8 and 16, one of the walls 308*e* of the activity mat 300*e* can be raised to present a diorama-type environment. When the play activity is completed, the activity mat 300*e* is folded up in accordance with the present invention and converted into the container box 300*d* with all of the articles contained therein, such as dolls, furniture items, and the like.

Figure 3F:
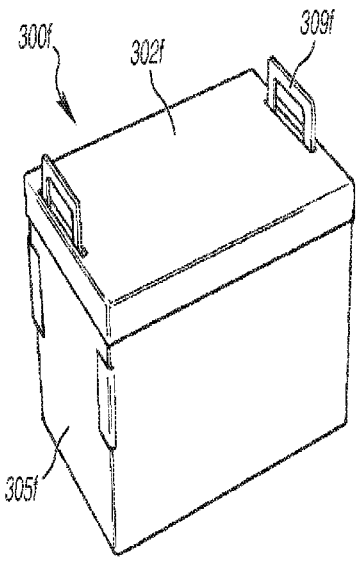
FIGS. 3F and 3G are perspective illustrations of yet another convertible container box that converts into an activity mat according to another embodiment of the present invention.
Figure 3I:
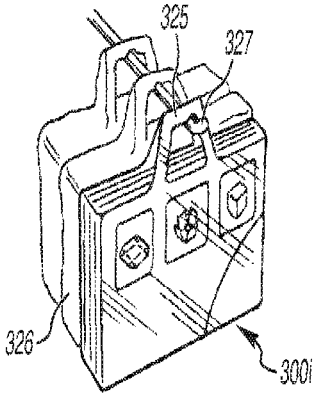
FIG. 3I illustrates an embodiment of the convertible container in the folded, stacked configuration encased in a reusable clear plastic over wrap suitable for retail display.
Figure 3H:
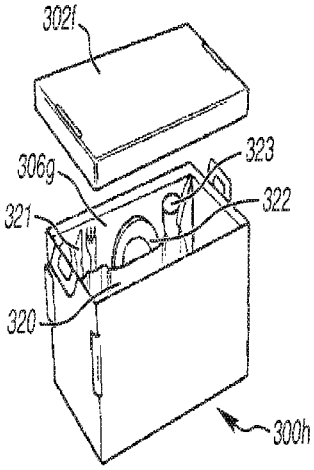
FIG. 3H illustrates an embodiment of the convertible container in an erect configuration with plates and utensils stored on the interior walls of the container.
Figure 3G:
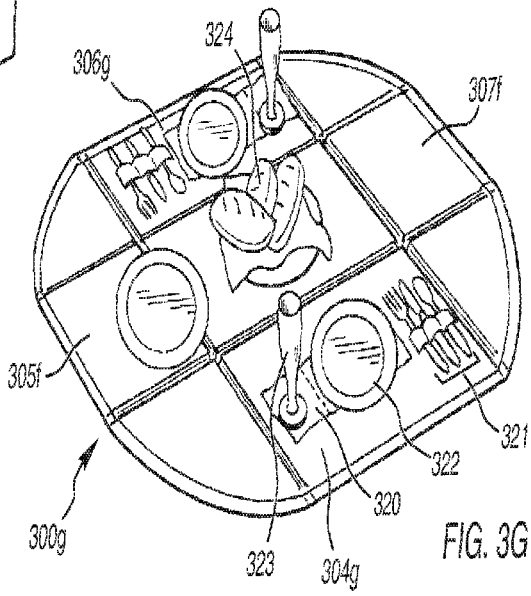

FIGS. 3F and 3G are perspective illustrations of yet another convertible container box 300*f* that converts into an activity mat 300*g* according to another embodiment of the present invention. The container box 300*f* resembles a picnic basket, and a basket-weave pattern is printed on or actually forms the exterior of the container box 300*f*. Handles 309*f* are attached to walls 305*f*, 307*f* and a lid 302*f* includes slots to receive the handles 309*f*. This arrangement further enhances the overall rigidity and integrity of the container box 300*f*. while also serving an aesthetic purpose. The activity mat 300*g* includes a checkerboard pattern traditionally used for picnics to further establish the picnic environment. As mentioned above in connection with FIG. 1G, the activity mat 300*g* can be made of a seamless material so that liquids can be captured therein when the activity mat 300*g* is converted back into the container box 300*f*, making the normally laborious and tedious cleanup after a picnic a fun and quick activity. All of the articles, plates, glasses, silverware, etc., are quickly recaptured within the container box 300*f*.

FIG. 3H illustrates the convertible container 300*h* in its erect, assembled configuration with a strap 320 holding utensils 321, dishes 322 and glassware 323 securely against a wall side 306*h*. Foods may be placed in the center of the container and thereby when the container 300*h* is converted into the activity mat 300*g*, the food and place-settings are in place and ready for the picnic feast. The container can be loaded with articles in either the box configuration 300*h* or the mat configuration 300*g*.

FIG. 3I illustrates the convertible container 300*i* in the folded, stacked configuration and contained within a reusable clear plastic display bag 326. The bag's handles 325 are suitable for hanging on a retail store display peg 327. Alternatively, the package can be displayed on a shelf.

Figure 4:
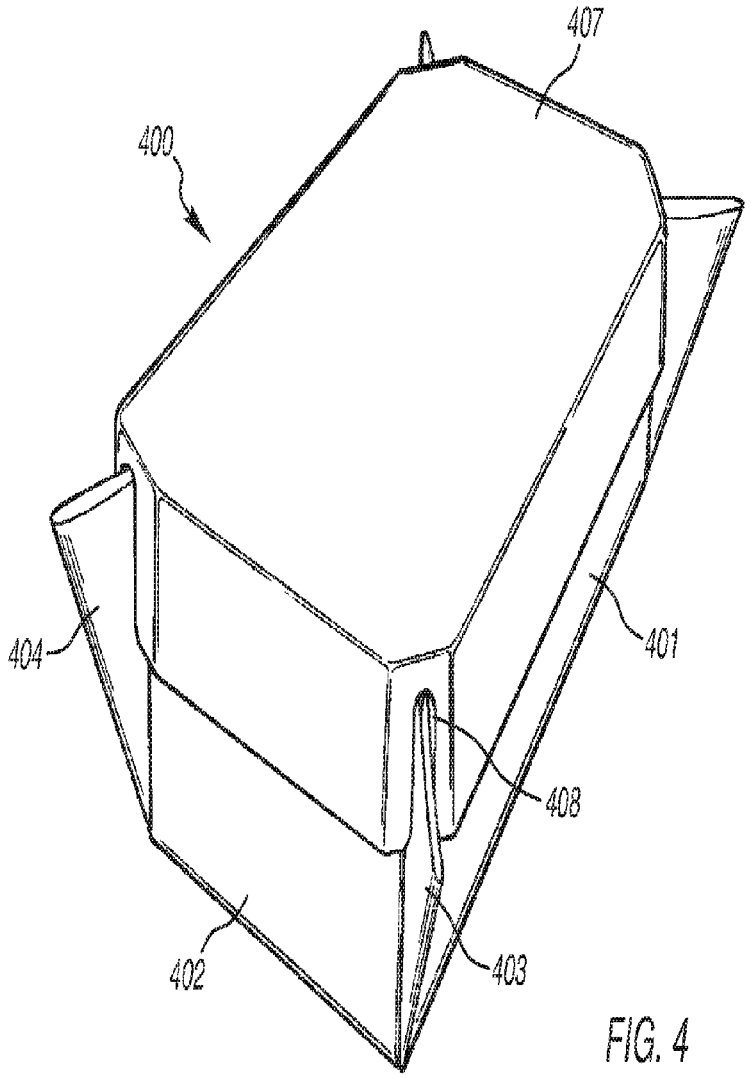
FIG. 4 is a perspective view of a convertible container having an externally biased webbing that fits into slots formed in a lid that helps to secure the container in a closed configuration according to an embodiment of the present invention.

FIG. 4 shows a further embodiment of a convertible container box 400 having a lid 407 that provides additional structure to secure wall sides 401 and wall ends 402 in an erect, assembled configuration. The lid 407 has slots 408 in the corners to receive webbing 403, 404. Supplemental attachment of the webbing 403 and/or the wall sides 401 can attach to each other by way of Velcro, magnets, or other mechanical fastener. Additionally, the lid 407 can be attached to the wall sides 401 and or wall ends 402 by way of Velcro, elastic straps, snaps, buttons and other fastener known in the art.

Figure 5:
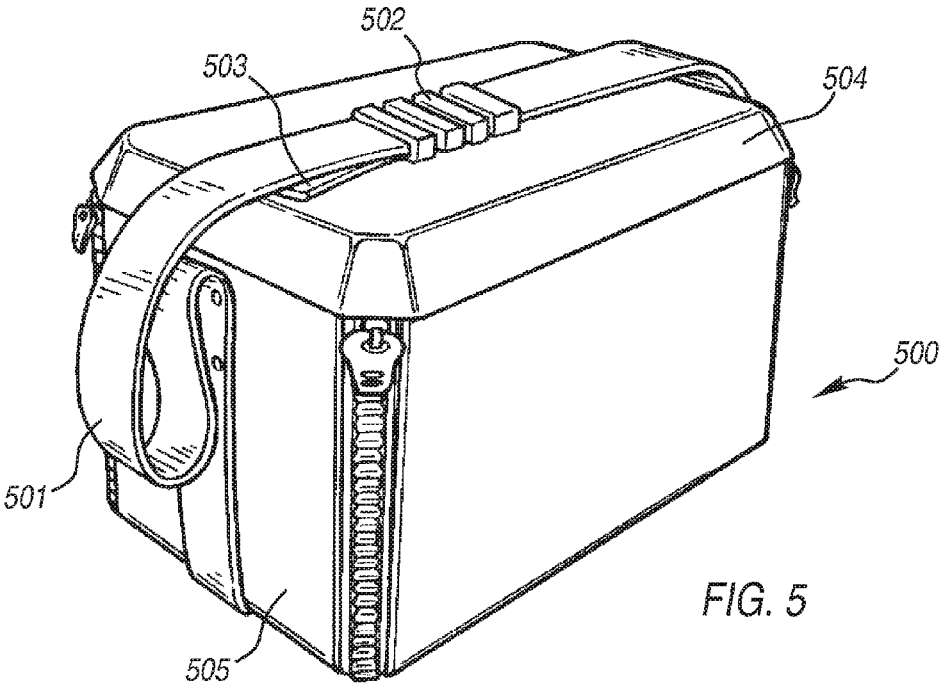
FIG. 5 is a perspective view of a zipper-close convertible container with carry strap according to an embodiment of the present invention.

FIG. 5 illustrates a convertible container box 500, similar to that shown in FIG. 1A, with a carrying strap 501. In this embodiment, the carrying strap 501, which includes a buckle 502, is mounted to the wall sides 505 of the convertible container box 500. By pulling on one end 503 of the carrying strap 501, a lid 504 can be further secured to the convertible container 500 with the tightened carrying strap 501. Thus, for example, if the carrying strap 501 is carried on a person's shoulder, the tension of the carrying strap 501 will tend to compress the sides of the lid 504, restraining the lid 504 in place on the convertible container box 500.

Figure 6:
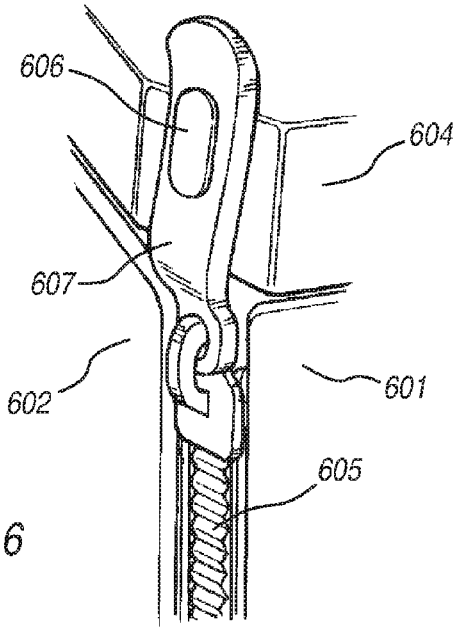
FIG. 6 is a partial detailed view of a corner of a zipper-close convertible container showing a zipper that interlocks with the lid of the container according to an embodiment of the present invention.

FIG. 6 shows a partial perspective view of a corner of a convertible container box having a lid 604 where a zipper grip 607 is connected to a fastener 606 on the lid 604. Fastening the zipper 605 to the lid 604 by way of the zipper grip 607 provides a secure way of keeping the lid 604 on the container box and keeping the zippers 605, wall sides 601, and wall ends 602 closed simultaneously.

Figure 7A:
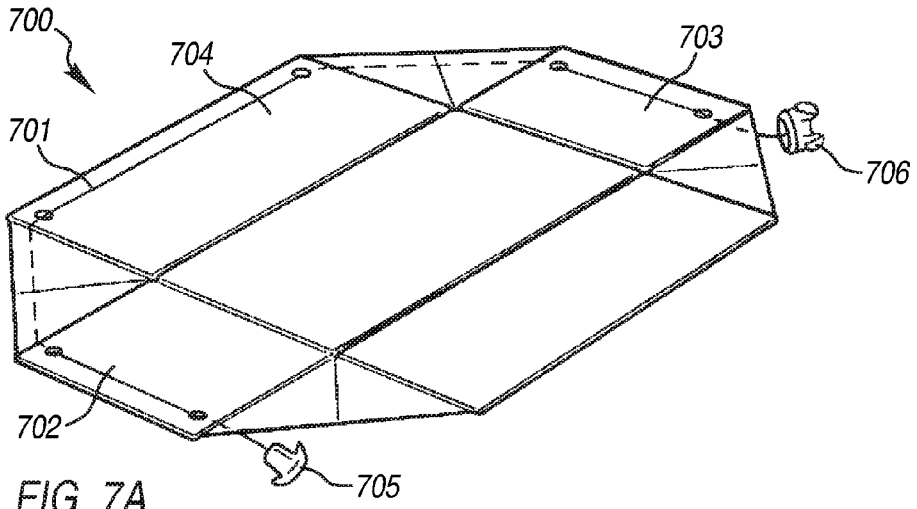
FIG. 7A is a belt-close convertible container in an open activity mat configuration according to an embodiment of the present invention.
Figure 7B:
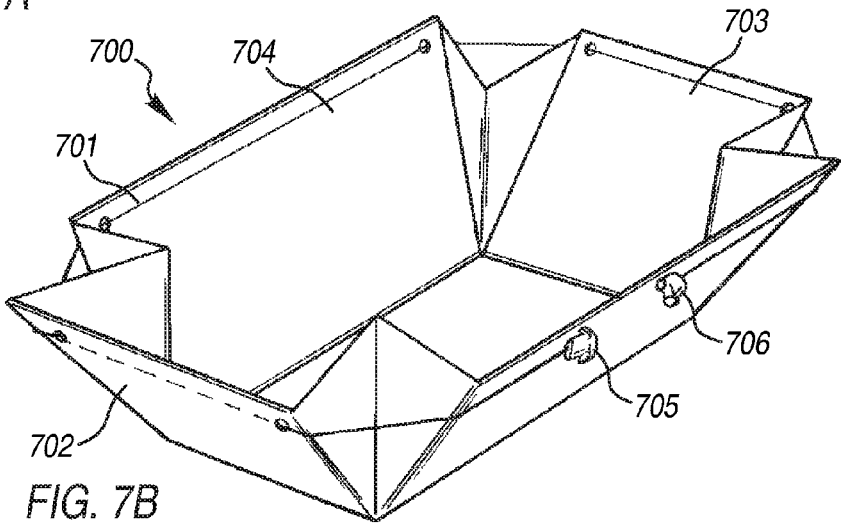
FIG. 7B is the belt-close convertible container of FIG. 7A transitioning from an activity mat configuration to a box configuration.
Figure 7C:
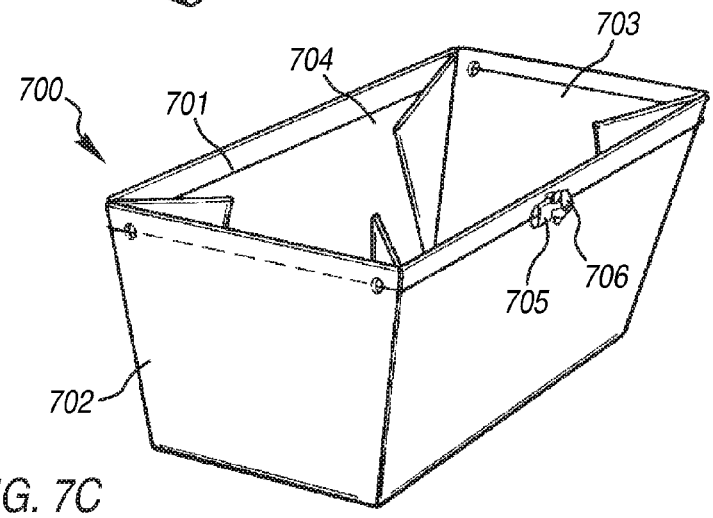
FIG. 7C is the convertible container of FIG. 7A held in an erect box configuration by way of a buckled belt according to an embodiment of the present invention.

FIGS. 7A, B and C illustrate a convertible container box 700 in three configurations: activity mat, transition between activity mat and box, and box, respectively. A belt 701 is constrained along wall end 702, wall end 703 and wall side 704. By grasping, pulling, and attaching the couplings 705 and 706 on the ends of the belt 701, the container box 700 converts from its open, flattened mat configuration of FIG. 7A to its erect, assembled configuration of FIG. 7C, and the container box 700 automatically recaptures any articles distributed on the open surface. Releasing couplings 705 and 706, allows the container box 700 to fall to its open position, exposing the contents of the container. Although the belt 701 is shown in an exposed condition, alternatively it can be embedded within the walls of the container whereby only the couplings 705, 706 and the immediately adjacent belt are exposed. The couplings 705 and 706 can be buckles, snaps, buttons, string ties, or any other fastener.

Figure 7D:
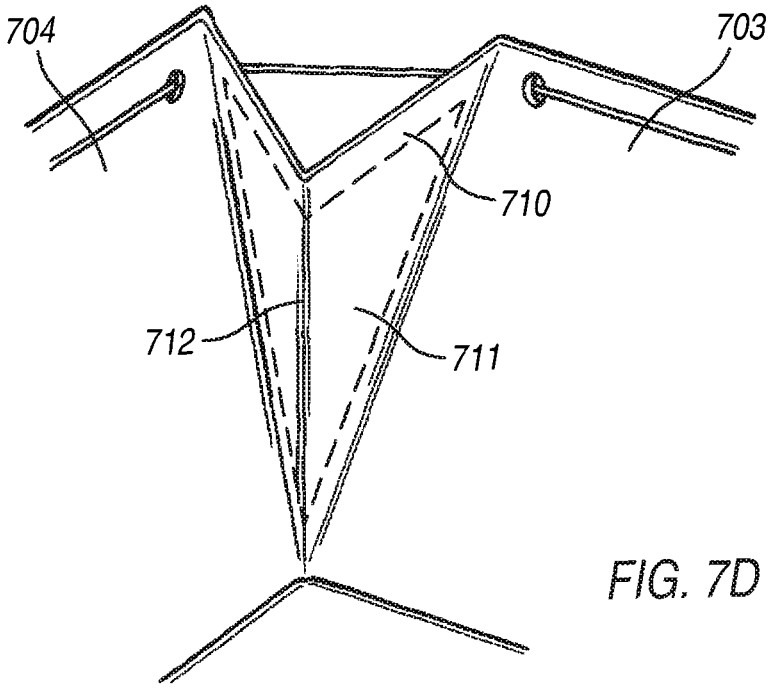
FIG. 7D is a cutaway close-up perspective view of a corner of the convertible container box in transition between its open, flattened configuration and its erect, assembled configuration having a folded biasing member according to an embodiment of the present invention.
Figure 7E:
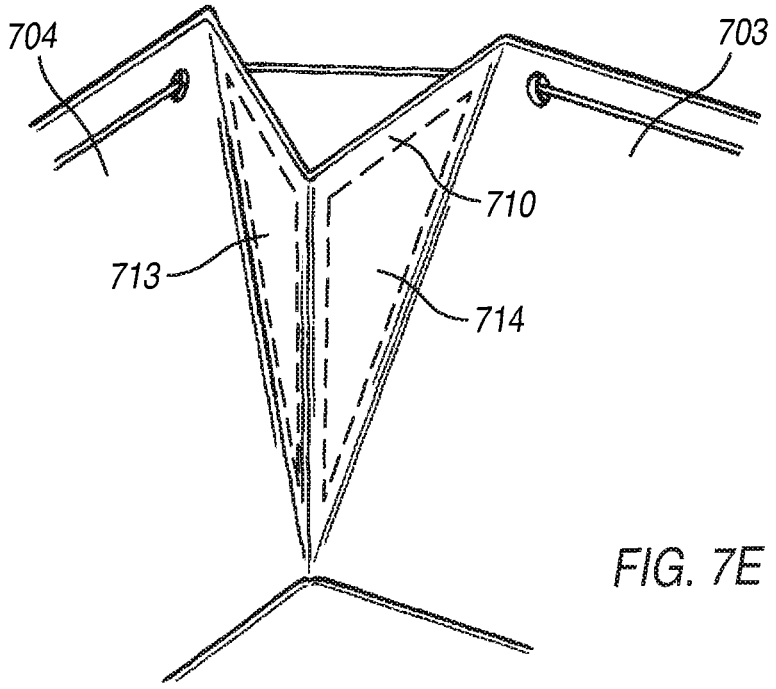
FIG. 7E is a cutaway close-up perspective view of a corner of the convertible box in transition between its open, flattened configuration and its erect, assembled configuration having a separate biasing members formed within the webbing according to another embodiment of the present invention.

FIGS. 7D and 7E is a cutaway close-up perspective view of a corner of the convertible container box 700 in transition between its open, flattened configuration and its erect, assembled configuration. FIG. 7D illustrates a folded biasing member 711. The biasing member 711 is bent or scored along fold line 712 such that when the wall end 703 and wall side 704 of the convertible container box 700 are lifted, the webbing 710 is biased to fold toward the inside of the container along the line 712. In some cases, the webbing may consist entirely of this folded biasing member 711.

FIG. 7E illustrates the inwardly biased webbing 710 where biasing members 713 and 714 are separate pieces sewn or molded into or between the outer material of the inwardly biased webbing 710. These biasing members 713 and 714 are situated such that when the wall end 703 and wall side 704 of the convertible container box 700 are lifted, the webbing 710 is biased to fold toward the inside of the container.

Figure 8:
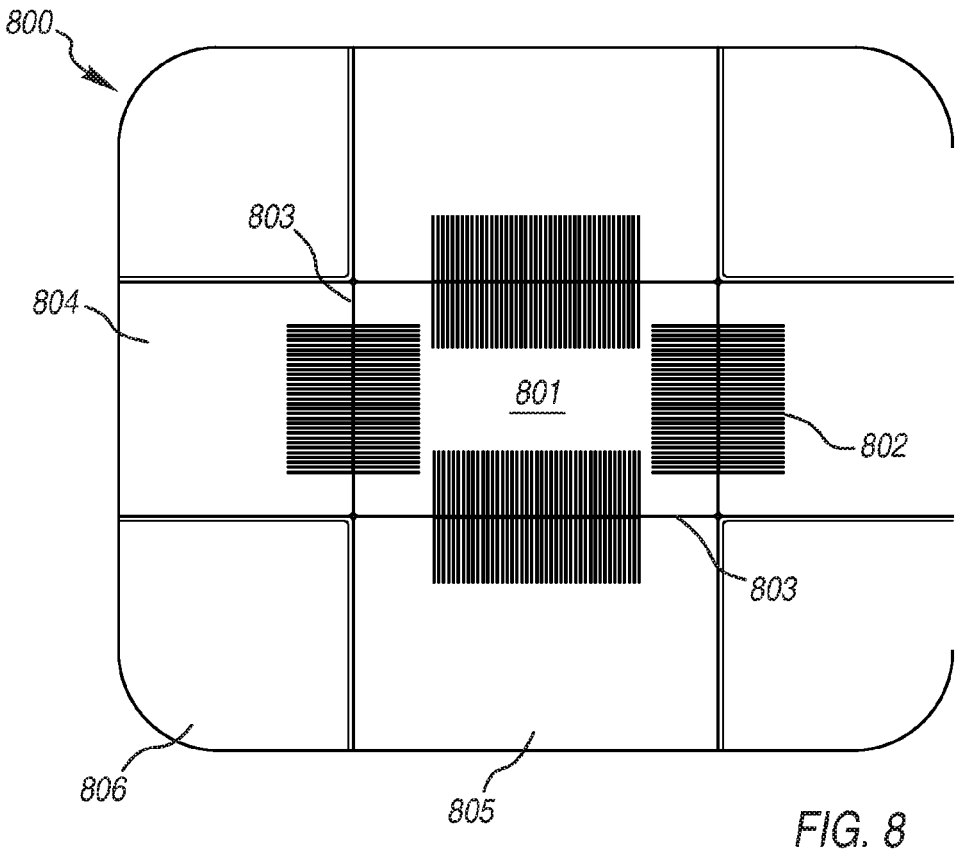
FIG. 8 is top view of a convertible container in an activity mat configuration with stiffening wires across the flexible junction fold lines according to an embodiment of the present invention.

FIG. 8 shows the convertible container 800 in an open, flattened configuration with stiffening wires 802 running across flexible joints 803 that connect a base 801 to wall ends 804 and wall sides 805. These stiffening wires 802 add resilience to the convertible container 800 such that when the wall ends 804 and/or the wall sides 805 are lifted into their upright position relative to the base 801, the walls are biased to stay in an upright position while the user attaches the primary fastening restraint (not illustrated).

Each adjacent wall end 804 and wall side 805 are attached to a webbing 806 according to an embodiment of the present invention. In embodiments such as shown in FIG. 1B, when there is a large volume of small articles to be stored within the convertible container, some articles may tend to fall within the folds of the flexible webbing in the erect, assembled configuration and will not be recaptured within the convertible container. When the convertible container is opened back into its open, flattened configuration, some articles may fall outside the convertible container 800. The flexible webbing 806 addresses this scenario by enlarging the surface area of the webbing in an exemplary manner shown in FIG. 8. When the flexible webbing 806 is folded into the erect, assembled configuration, the folds of the webbing remain at about the same height as the exposed ends of the end and side walls 804, 805, preventing articles from falling within the folds of the flexible webbing 806.

Figure 9:
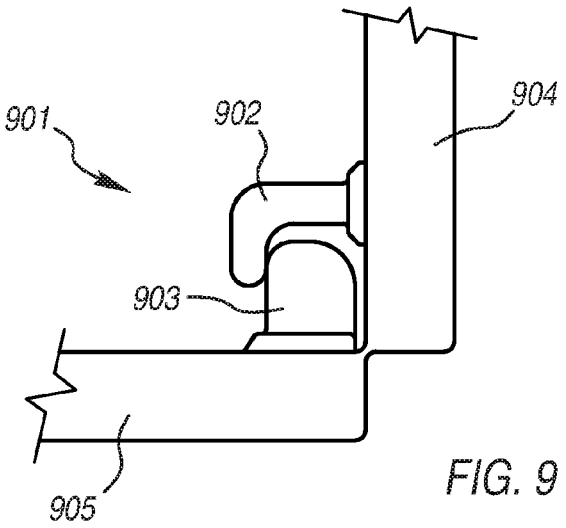
FIG. 9 is side view of a clasp for use in holding convertible container walls in an upright position according to an embodiment of the present invention.

FIG. 9 shows an alternate restraint mechanism in the form of a clasp 901 that couples a base 905 to a wall 904. When the wall 904 is lifted into an upright position, the wall 904 is biased to stay in the upright position relative to the base 905 while the user attaches the primary fastening restraint. The bias is created by a lever 902 that engages a cam 903. The clasp 901 is preferably a molded plastic clip where the lever 902 acts as a living hinge as it engages and disengages the cam 903. Alternatively, the lever 902 or the cam 903 can be made of die cast, sheet metal, or other suitable materials.

The clasp 901 can be alternatively engaged by lifting the wall 904 and pushing it in a downward direction into the clasp 901 until the lever 902 engages the cam 903. Similarly, the clasp 901 can be replaced with a groove and the wall 904 can be positioned into the grove and forced in a downward direction in a slight interference fit. In this embodiment, the flexible joint must have sufficient slack to enable this relative motion of the wall 904 and the base 905. Conversely, the groove can exist in the wall 904, and the base 905 would be forced into the groove in wall 904.

Figure 10A:
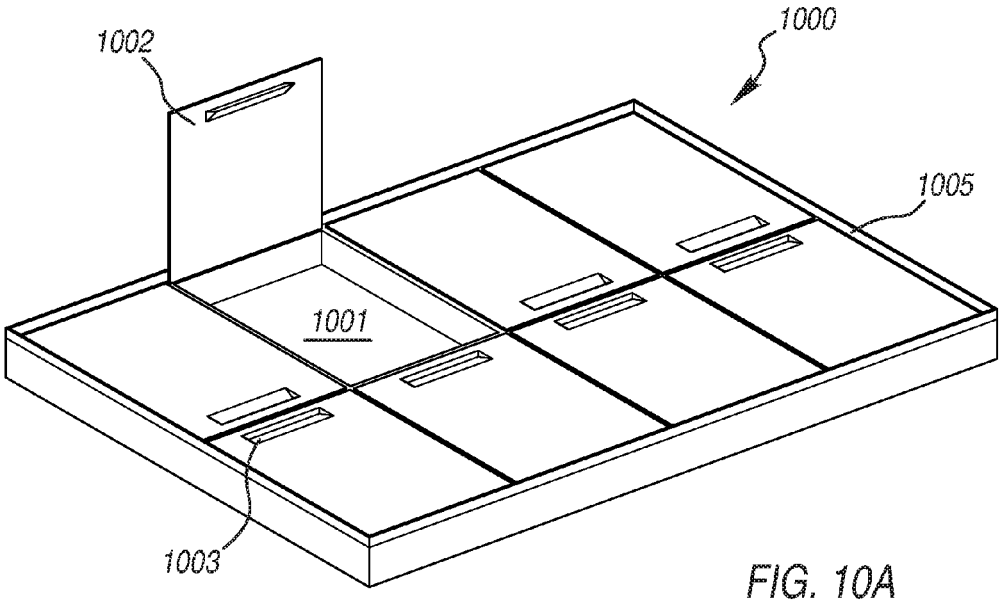
FIG. 10A is perspective view of a convertible container lid showing organizer containers on the top of the lid according to an embodiment of the present invention.

FIG. 10A is a perspective view of a lid 1000 that can be used in embodiments of the present invention, having storage pockets 1001 on one side of the lid 1000 and building block compatible nubs 1004 on the other side. The storage pocket doors 1002 are opened by gripping and pulling the handles 1003. The lid 1000 can be placed on a container according to any embodiment of the present invention with either side up or down. A raised lip 1005 running about the periphery of the lid 1000 is present on the lid 1000 to serve at least two purposes. First, to ensure that the lid 1000 fits securely on a convertible container (not illustrated), and second, to ensure that when stacking multiple convertible containers on top of one another, they stack securely by fitting inside the raised lip 1005 of the underlying container. The raised lip 1005 acts to register the containers in a neatly stacked arrangement. Some or all of the storage pocket 1002 and handle 1003 assemblies shown in FIG. 10A can be removed from the lid 1000 and snapped or press-fit back into the lid in a secure manner.

Figure 10B:
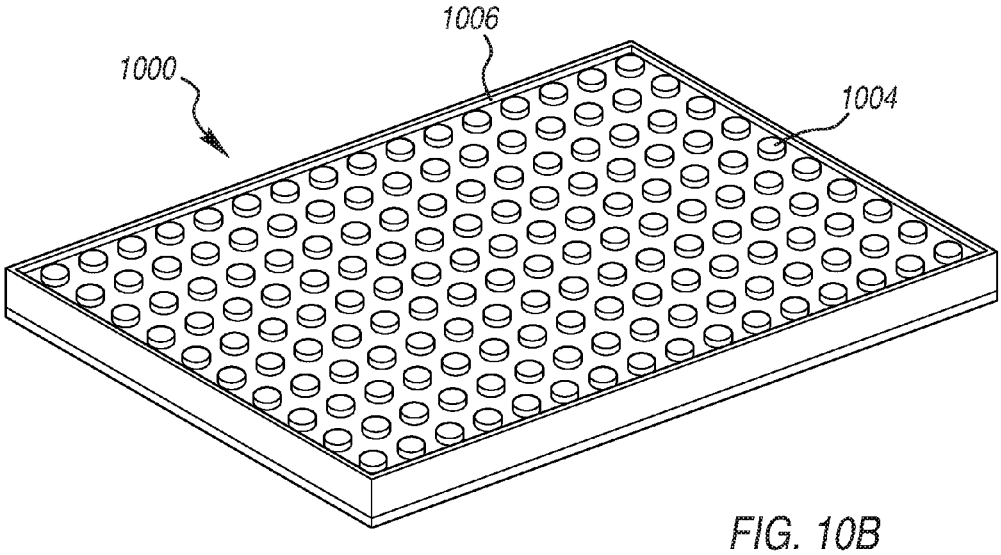
FIG. 10B is a convertible container lid having building block compatibility on a surface of the lid according to an embodiment of the present invention.

FIG. 10B shows the opposite side of the convertible container lid 1000 of FIG. 10A. This side is shown having an interface that is compatible with interlocking plastic building blocks. A lip 1006 about the periphery of the lid 1000 is present on the lid 1000 to serve at least two purposes. First, to ensure that the lid 1000 fits securely on a convertible container (not illustrated), and second, to ensure that when stacking multiple convertible containers on top of one another, they stack securely by fitting inside the lip 1006 of the underlying container. The lip 1006, like the raised lip 1005, acts to register the containers in a neatly stacked arrangement.

Figure 11A:
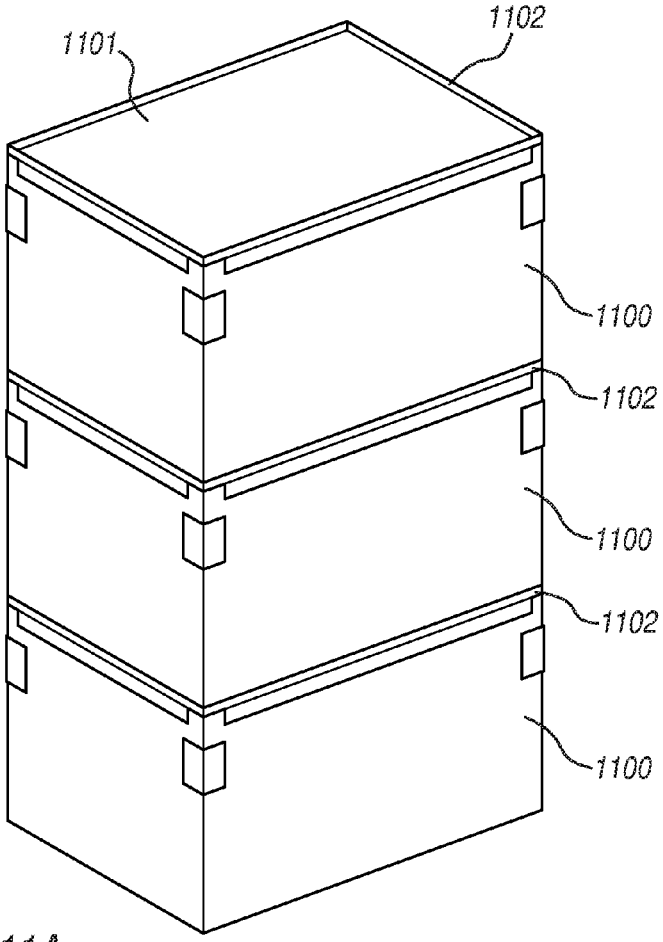
FIG. 11A shows three convertible containers according to embodiments of the present invention with lids in a stacked configuration.

FIG. 11A shows a nested stack of three convertible containers 1100 according to the present invention covered with lids 1101. The fabrication and composition of the boxes and lids are such that the containers are stackable. A registration lip 1102 on each lid 1101 ensures that stacked convertible containers 1100 are positioned properly and securely in a registered position relative to neighboring containers.

Figure 11B:
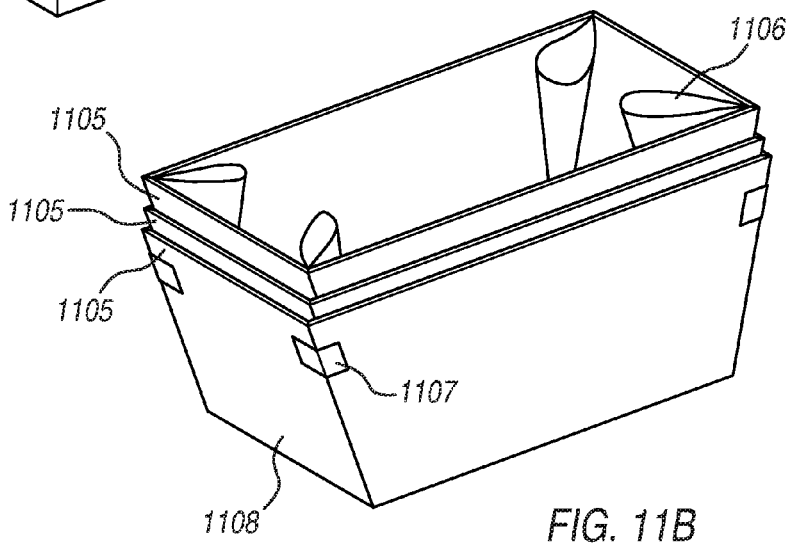
FIG. 11B shows three convertible containers according to embodiments of the present invention without lids in a nested configuration.

FIG. 11B shows a nested stack of three convertible containers 1105 according to the present invention without lids. In this embodiment, walls 1108 are not vertical (though they are still upright), allowing the convertible containers to be nested as shown. The flexible webbing 1106 is pushed against the insides of the walls 1108 when the containers 1105 are nested. The couplings 1107 attach adjacent walls as shown of each individual container 1105. In an embodiment, each of the containers 1105 have the same dimensions. In another embodiment, each nested container 1105 is sized to be smaller than the container 1005 in which it is nested.

Figure 12A:
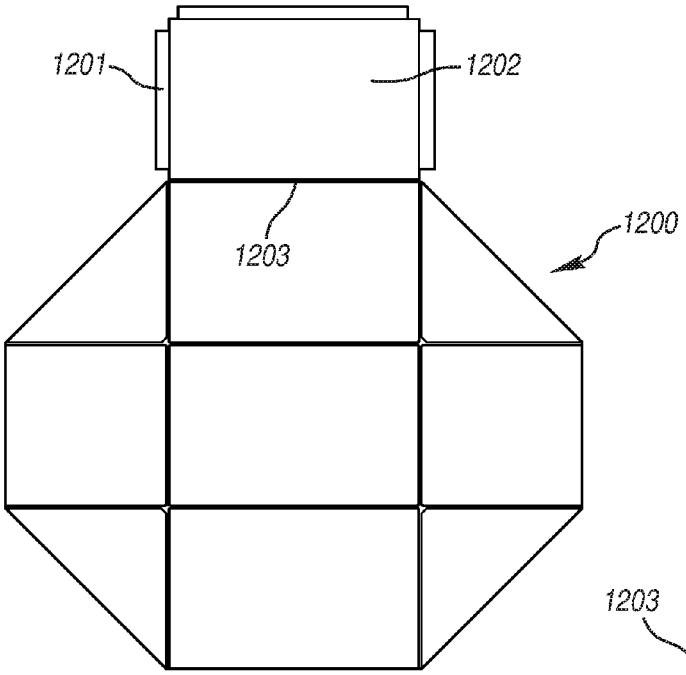
FIG. 12A is a diagrammatic sketch of a convertible container in an activity mat configuration with a lid attached to one of its walls according to an embodiment of the present invention.
Figure 12B:
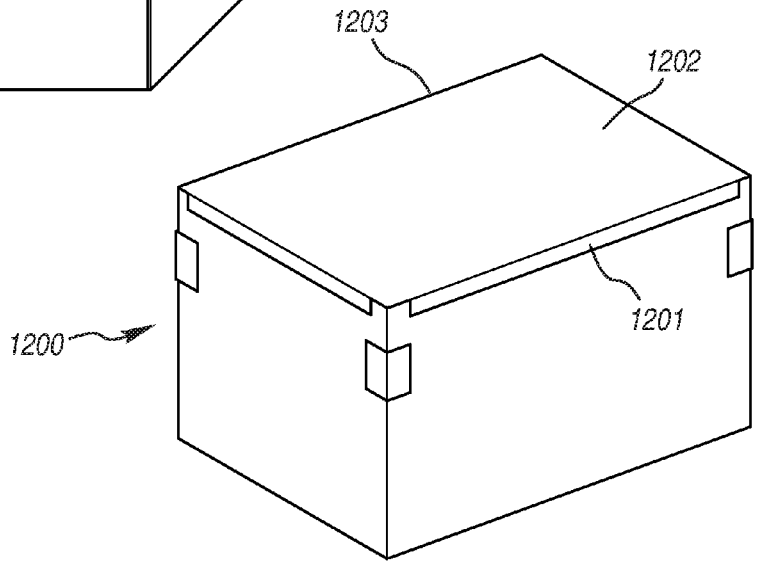
FIG. 12B is a perspective view of the convertible container of FIG. 12A with the attached lid in an erect box configuration.

FIG. 12A shows an open, flattened configuration of a convertible container 1200 having a lid 1202 attached to the container 1200 along a flexible junction 1203. FIG. 12B shows the convertible container 1200 with attached lid 1202 in an erect, assembled configuration with the lid 1202 closed and secured with attachment flaps 1201 to the walls of the container 1200. The attachment flaps 1201 can be Velcro, magnets, releasable adhesives, or any other suitable mechanical fasteners.

Figure 13:
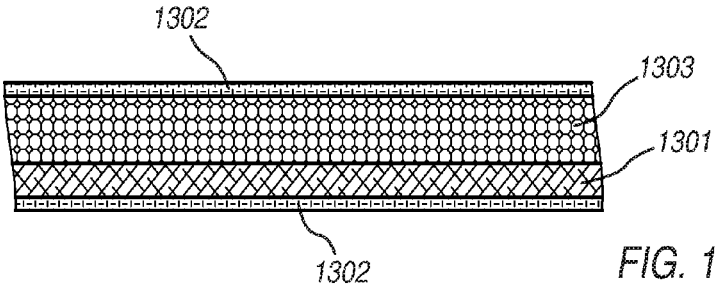
FIG. 13 is a partial cross-section of a portion of a convertible container according to an embodiment of the present invention.

FIG. 13 shows a partial cross-section of a base or a wall portion according to an embodiment of the present invention. The base or wall portion includes a semi-rigid base material 1301 composed of cardboard, paperboard, steel, or plastic, which has an optional overcoat 1302 material such as Vinyl, Nylon, or polypropylene. Padding or insulating material such foam 1303 is optionally placed between the base material 1301 and the overcoat 1302. In some embodiments, the padding 1303 is not present. To make a flexible junction, the base material 1301 and/or the foam 1303 (if rigid) is eliminated. Alternatively, the flexible junctions can be made from a resilient material or constructed with hinges (not illustrated). Friction hinges can be used to encourage the sides to remain upright while the primary wall couplings are secured.

Figure 14A:
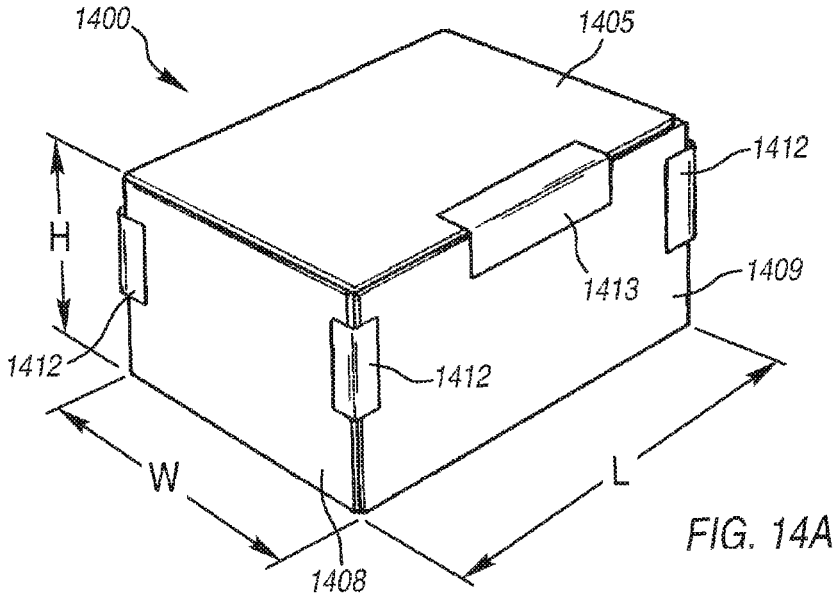
FIG. 14A is a perspective view of a convertible container in a first configuration as a box according to an embodiment of the present invention.
Figure 14B:
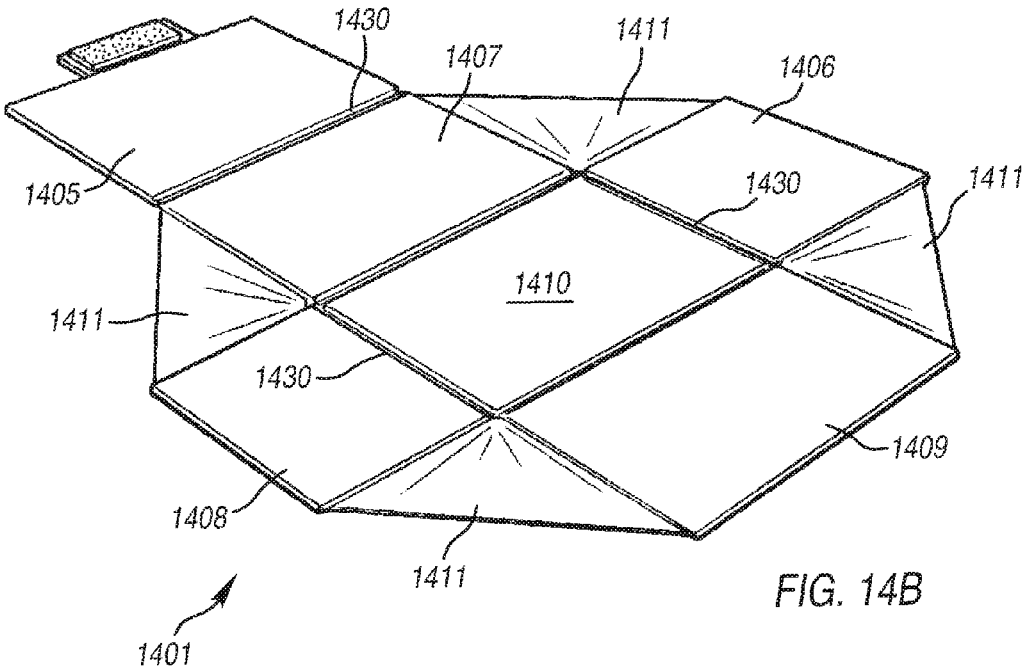
FIG. 14B is a perspective view of the convertible container of FIG. 14A in a second configuration as an activity mat.

FIGS. 14A-G illustrate an exemplary conversion of a convertible container box 1400 from a first erect, assembled configuration as convertible container box 1400 to a second open, flattened configuration as an activity mat 1402 to a third folded, stacked configuration as a folded stack 1403. FIG. 14A illustrates the convertible container 1400 in an erect, assembled configuration having a length L, a width W, and a height H. A lid 1405 is releasably held to a wall side 1409 by way of a Velcro attachment strap 1413. A wall end 1408 is releasably held to the wall sides 1407, 1409 by way of Velcro attachment straps 1412. Similarly, the wall end 1406 is releasably held to the wall sides 1407, 1409 by way of Velcro attachment corner straps 1412. Releasing the lid strap 1413 and releasing the four corner straps 1412 allows the convertible container to convert into the second open, flattened configuration, i.e., as the activity mat 1401, as shown in FIG. 14B.

Any articles contained in the convertible container are now exposed for use and the activity mat 1401 presents a suitable area for making use of the exposed articles. When the user is finished using the exposed articles, the walls 1406-1409 activity mat 1401 can be raised with respect to the base 1410 to re-form the container 1400. The walls 1406-1409 are movable relative to the base by way of the flexible junction 1430.

Raising the walls 1406-1409 causes the inwardly biased webbing 1411 to also raise and all the articles distributed on the activity mat 1401 are thus recaptured into the container. Once the walls 1406-1409 are raised, the attachment corner straps 1412 are used to releasably hold the walls 1406-1409 to one and other. Optional stiffening wires or clasps, described above, can also be incorporated into the flexible junctions 1430 to hold the walls 1406-1409 erect while the user secures the corner straps 1412.

Figure 14C:
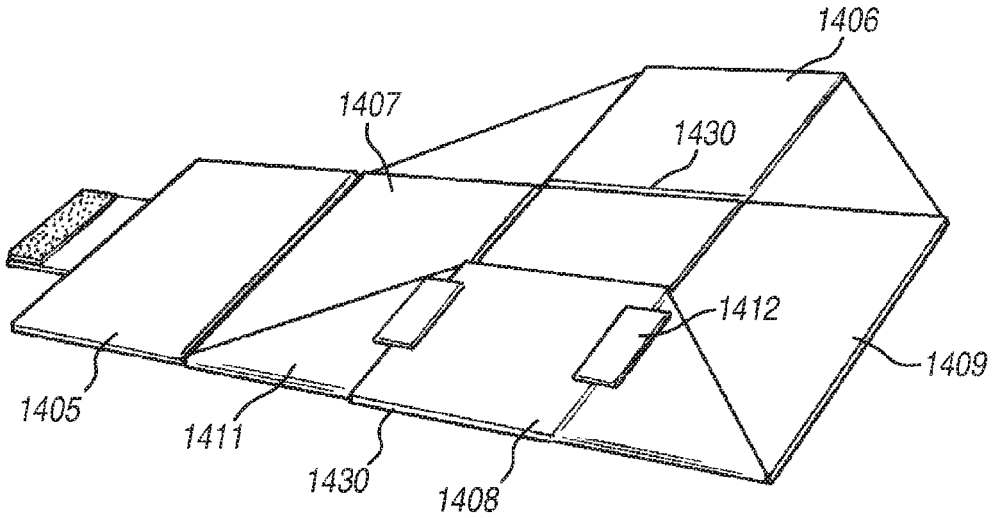
FIG. 14C is a perspective view of the convertible container of FIG. 14B in a partial mat configuration with one end folded inward toward the base.

FIG. 14C illustrates a step in the conversion from the activity mat 1401 to the folded stack 1403. In this step, the wall end 1408 is folded onto the base 1410 as shown. The webbing 1411 attached to the wall end 1408 also folds inward with the wall end 1408 as shown. The attachment straps 1412 that were previously attached to the wall sides 1407 and 1409 do not stick to the webbing 1411, but lay inertly on top of the webbing 1411.

Figure 14D:
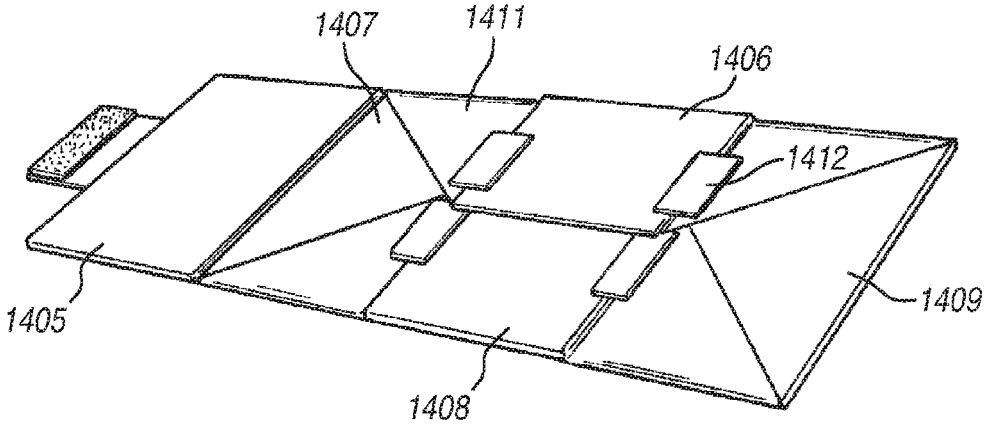
FIG. 14D is a perspective view of the convertible container of FIG. 14C in a partial mat configuration with both ends folded inward toward the base.

FIG. 14D illustrates another step in the conversion from the activity mat 1401 to the folded stack 1403. In this step, the wall end 1406 is folded onto the wall end 1408, which is resting on the base 1410. Once again, the webbing 1411 also folds inward with the wall end 1406 as shown, and the attachment straps 1412 lay inert on the webbing 1411. It must be noted that if the height H of the wall ends 1406 and 1408 is less than or equal to one half the length L of the base 1410, then both wall ends would lay adjacent on the base 1410 and would not overlap one another. Alternatively, the ends 1406 and 1408 can be folded under the base 1410.

Figure 14E:
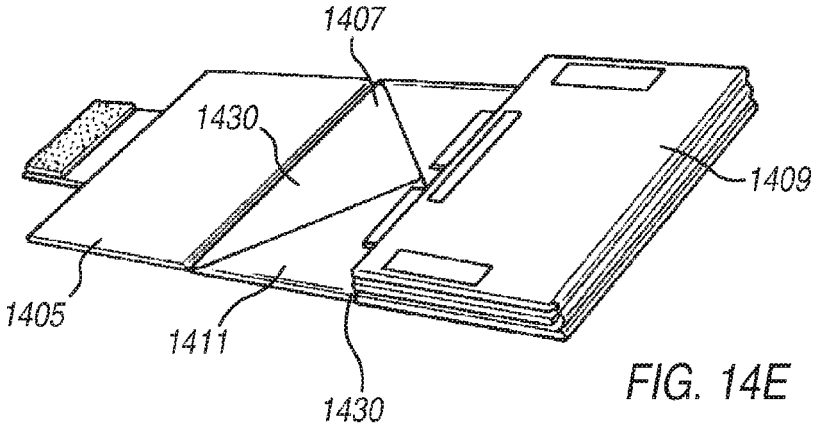
FIG. 14E is a perspective view of the convertible container of FIG. 14D in a partially folded configuration with one side folded inward toward the base.

FIG. 14E illustrates another step in the conversion from the activity mat 1401 to the folded stack 1403. In this step, the wall side 1409 is folded onto the wall end 1406, which is resting on the wall end 1408 and the base 1410. Because of the thickness of the material at this step, the flexible junction 1430 must be of sufficient length or preferably stretch to enable the wall side 1409 to remain attached to the base 1410 while laying flat on the wall ends 1406 and 1408.

Figure 14F:
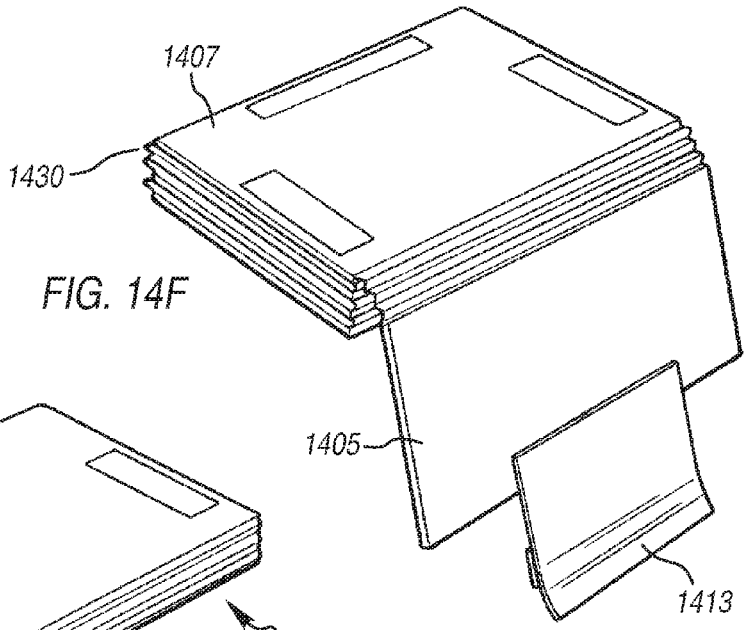
FIG. 14F is a perspective view of the convertible container of FIG. 14E with both sides folded inward toward the base and the lid remaining unfolded.
Figure 14G:
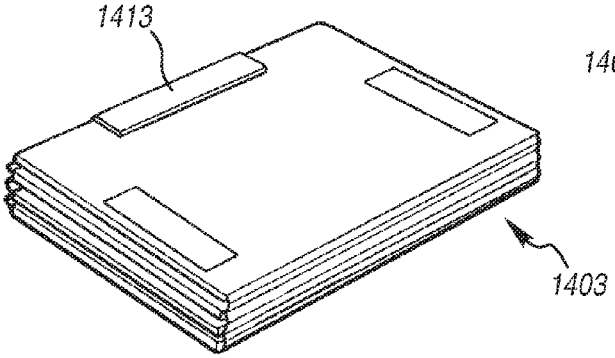
FIG. 14G is a perspective view of the convertible container of FIG. 14F with the lid folded over the stack of sides and ends to form a stacked, folded configuration according to an embodiment of the present invention.

FIG. 14F illustrates yet another step whereby the wall side 1407 is folded flat over the wall side 1409. Again, the flexible joint 1430 allows the fold to take place without separating the folded wall side 1407 from the base 1410, and further allows the wall end 1407 to lay flat over the wall side 1409. In FIG. 14G, the lid 1405 is folded under the base 1410 and the attachment strap 1413 is secured to the Velcro on the wall end 1407. This fold results in the third folded, stacked configuration of the convertible container, or the folded stack 1403. The compact, folded stack 1403 is advantageous for shipping, merchandising, and storage. When the convertible container 1400 is in its erect, assembled configuration, it can be sold with articles, such as building blocks and the like, already loaded in the container 1400. It is also desirable for the convertible container 1400 to be sold empty, in which case it is best configured as the folded stack 1403, thereby requiring relatively little space for storage, shipping, and merchandising. The same is true in use; when the convertible container 1400 is empty and not in use, the user may choose to store the container in the folded, stacked configuration 1403 once again saving space.

Figure 14H:
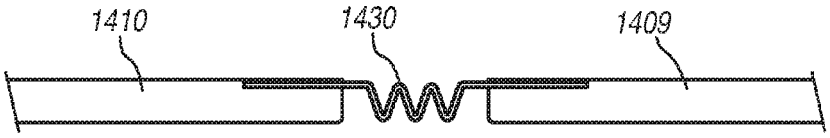
FIG. 14H is a side view of a flexible joint area of any joint shown in FIGS. 14A-G in an unbent configuration. The flexible joint allows the sides and ends to move relative to the base for erecting the box and for stacking the walls.
Figure 14I:
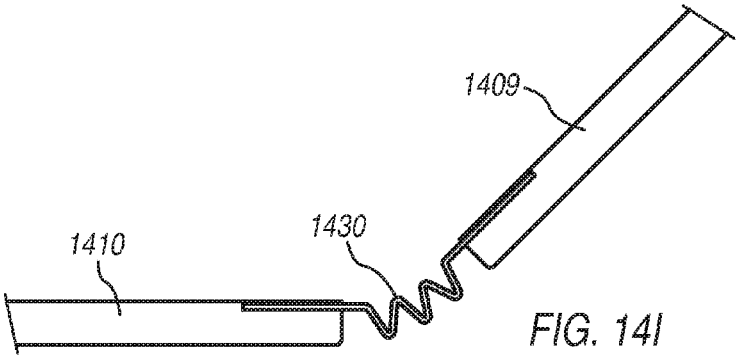
FIG. 14I is a side view of the flexible joint area of FIG. 14H in a partially bent configuration.

FIG. 14H is a close-up view of the flexible junction 1430 of the convertible container 1400. The terms "junction" and "joint" are used interchangeably herein. The flexible junction 1430 is shown connecting a base 1410 to a wall side 1409. In an embodiment, the flexible junction 1430 can bend and stretch—thus it is both flexible and stretchable. The amount of stretch necessary depends on the thickness T and the compressibility of the walls 1406-1409. In another embodiment, the flexible junction 1430 just bends, i.e., it is flexible but not necessarily stretchable. The flexible junction 1430 has an accordion-like interface and can be made from the overcoat 1303 material such as vinyl or nylon. Alternatively, the flexible junction 1430 can be made from a stretchable material such as elastic, Spandex, Lycra, or other suitable materials, or it can be made of a flexible material that is bendable. Additionally, the flexible webbing 1411 can be made from similar stretchable materials. FIG. 14I illustrates the flexible junction 1430 in a partially bent position. The accordion-like interface permits the flexible junction 1430 to extend the wall side 1409 away from the base 1410 to accommodate the thickness of other wall portions that are stacked on top of the base 1410 as the convertible container 1400 is being folded up into its folded, stacked configuration 1403.

Figure 15:
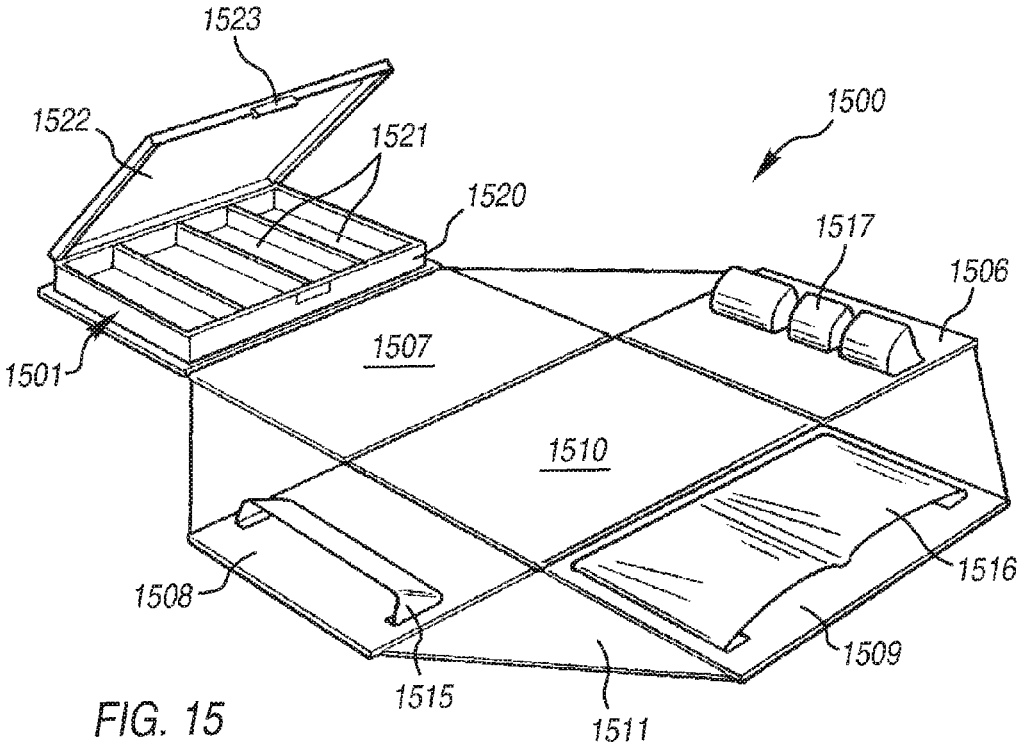
FIG. 15 illustrates a perspective view of a convertible container with collapsible pockets in the wall sides and the wall ends and having a non-collapsible organizer container integral to the lid of the convertible container according to an embodiment of the present invention.

FIG. 15 illustrates an activity mat 1500 having an attached lid 1501 and wall mounted organizer storage pockets 1515-1517. Attached to the lid 1501 is an organizer case 1520 having a cover 1522. Similar to FIG. 14, the mat 1500 can be transformed among various configurations to take the form of the convertible container box 1400 or the folded stack 1403. The storage pockets 1515-1517 are made of a soft material such as cloth, vinyl, nylon, elastic or the like, such that they lie flat when empty thereby allowing the container to take the form of a foldable stack 1403. The storage pockets 1515-1517 may be opaque, translucent, or transparent and may have elastic bands, zippers, or the equivalent (not illustrated) located at the open ends to hold securely articles therein.

The organizer case 1520 is attached to the lid 1501 and provides further storage for articles that are to be used on the activity mat 1500. The organizer case 1520 includes compartments 1521 for organizing such articles and keeping them organized and separated from those articles distributed on the activity mat 1500. The cover 1522 secures to the organizer case 1520 by way of a clasp 1523.

Converting the activity mat 1500 into the folded stack 1403 configuration requires that, similar to what is shown in FIG. 14F, the wall side 1507 be folded under the base 1510 such that the lid 1501 is wrapped over the side 1509, which results in the organizer case 1520 being left in an exposed position on top of the folded stack 1403.

When the convertible container is used to house a board game, the need for the actual board is replaced by the use of the convertible container box in its activity mat configuration. Using the game Monopoly® as an example, the pockets in the four walls can be used to hold each player's money and title deeds. The bank's money, community chest, chance cards and game tokens stored in pockets on the base of the mat. The board itself can be printed on surface of the mat. Closing the mat will recapture the game pieces and retain the individual player's cash and property standings. The game can also be reset with the base amounts on each side such tat the game is ready for instant play upon opening the convertible container.

Similarly, when used for a poker game, the interior surface is green felt and the walls provide playing area and storage pockets for decks of cards, poker chips, the dealer's shoe, etc.

Figure 16:
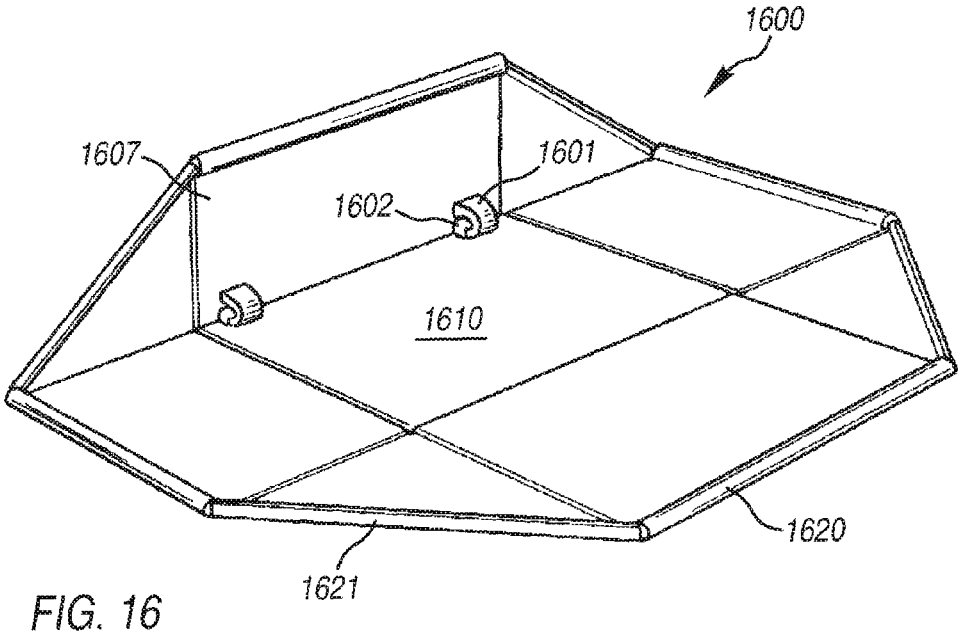
FIG. 16 illustrates a convertible container with clasps to keep a wall side in a rigid, upright position with or without the use of coupling devices to attach the wall sides to one another in accordance with an embodiment of the present invention.

FIG. 16 illustrates clasp members 1601 and 1602 similar to those shown in FIG. 9. The clasp members 1601, 1602 bias the side wall 1607 in an upright position relative to the base 1610 when the wall side 1607 is raised to the upright position. The clasp members 1601, 1602 can be used in addition to or independent of attachment straps similar to the attachment straps 1412 shown in FIG. 14A. Clasp members 1601, 1602, like the clasp 901 of FIG. 9, engage when the wall sides 1607 and 904, respectively, are pivoted into an upright position, and alternatively, the wall side 1607 or the wall side 904 (FIG. 9) is raised to the upright position and pressed downward into the clasp 1601, 1602.

With the wall side 1607 in an upright position as shown in FIG. 16, the activity mat 1600 offers privacy such as from other playmates in the play area. In addition, the upright wall side 1607 can include a design that creates a changeable background for the play area that may be used as a diorama or display for articles such as Playmobil toys. For example, the design can depict a water scene appropriate for use as a backdrop for water-related toys, such as boats. Or, as a further example, the design can depict an outer space scene appropriate for use as a backdrop for space-related toys, such as starships. These designs may be changeable to adapt for different environments.

FIG. 16 also illustrates a bulbous end 1620 and a collapsible raised lip 1621 along the perimeter of the activity mat 1600. This edge feature helps to keep the articles on the activity mat.

Figure 17:
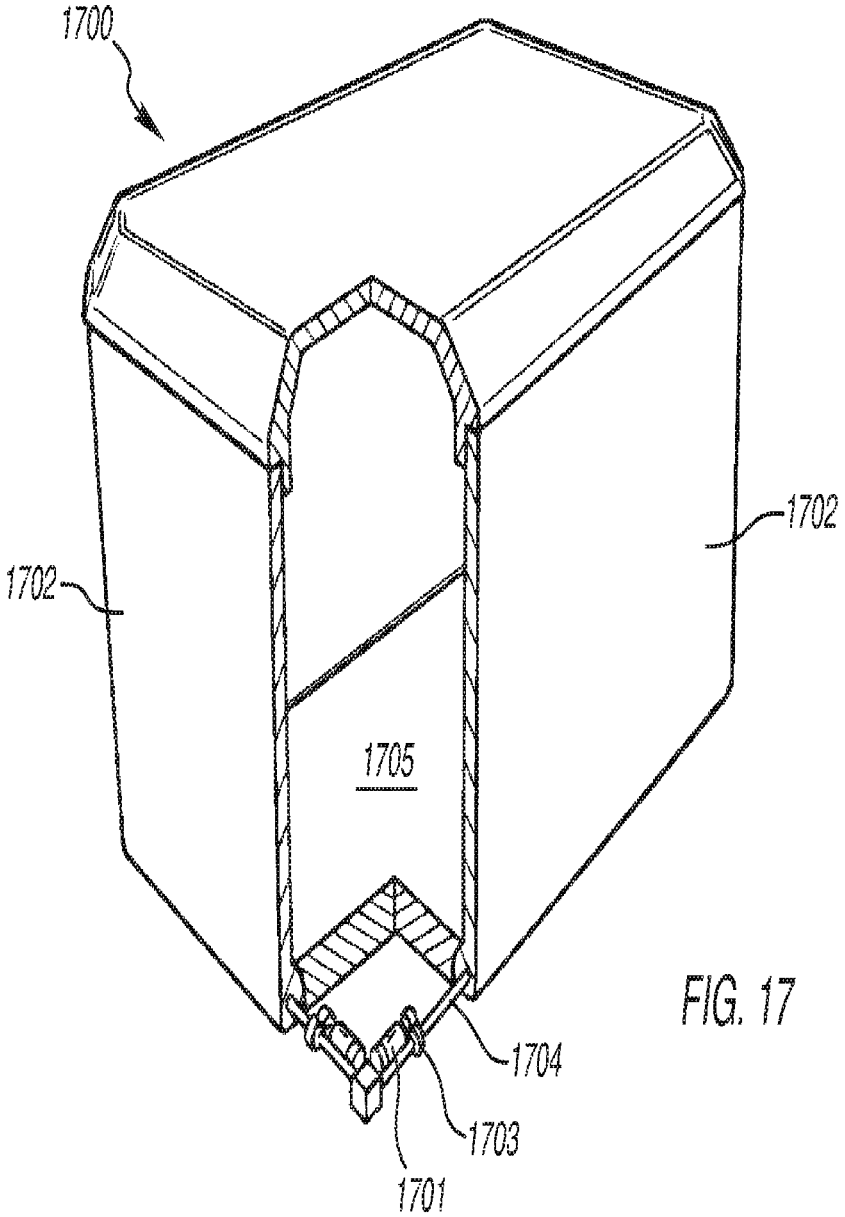
FIG. 17 illustrates a convertible container having motors and gears to raise and lower the wall sides and the wall ends of the container in accordance with an embodiment of the present invention.

FIG. 17 illustrates an embodiment of a convertible container box 1700 having walls that are raised and lowered electrically. In this embodiment, battery-powered electric motors 1701 are used to raise and lower the walls 1702 of the container box 1700 relative to its base 1705. At the push of a button (not illustrated), the electricity flows to the motors 1701, which turn gears 1703 and rotate shafts 1704 that are attached to the walls 1702 of the container. A conventional slip clutch (not illustrated) ensures that the motors 1701 do not burn out in the event that the load is too high for the motors 1701. As an alternative to the shaft drive 1704, the motors 1701 can draw cables and or levers to raise the wall sides, in embodiments described below. A position sensor (not illustrated) stops the motor 1701 when the wall sides are in raised or lowered positions. As a further alternative, the motor 1701 can be a spring motor that ratchetably winds up as the walls 1702 are lowered, and when the ratchets are released, the walls 1702 are pulled back up to an upright position.

Figure 18A:
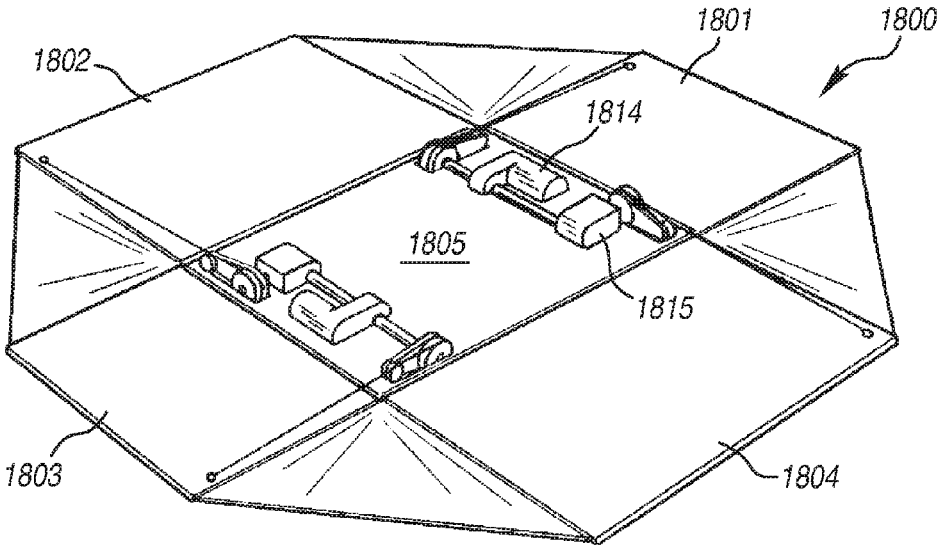
FIG. 18A is a perspective illustration of a convertible container having motors, gears, pulleys, and cables arranged in a manner to raise and lower the walls of the container in accordance with an embodiment of the present invention.
Figure 18B:
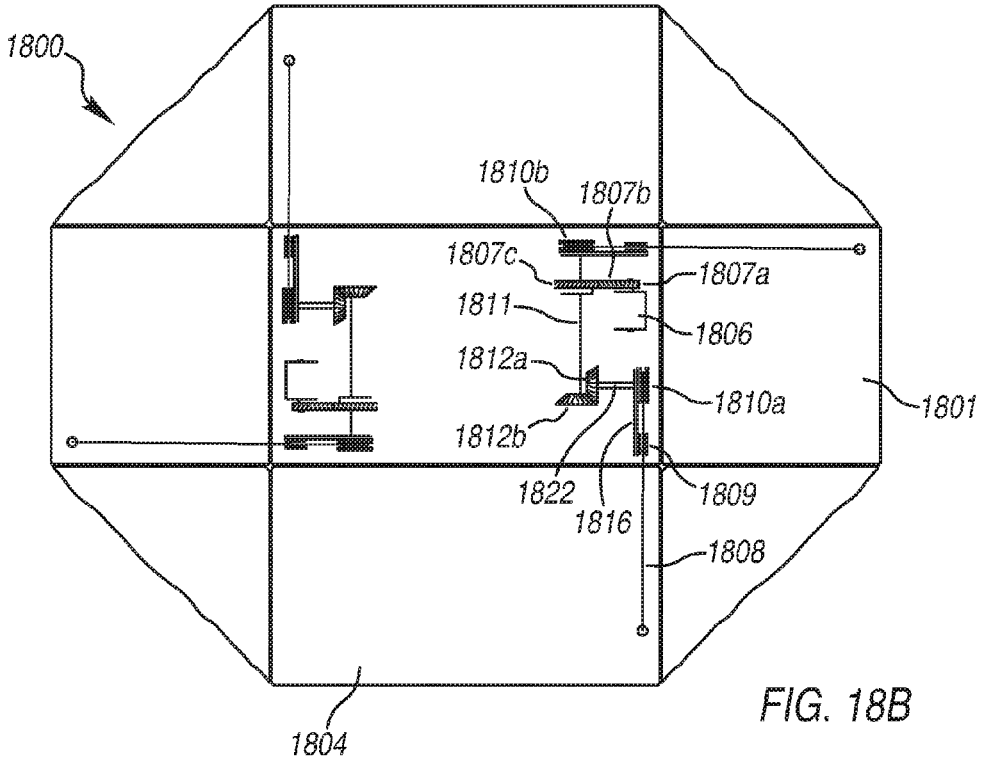
FIG. 18B illustrates a top view of a convertible container having exposed motors, gears, pulleys, and cables arranged in a manner to raise and lower the walls of the container in accordance with an embodiment of the present invention.

FIG. 18A is a perspective illustration of another motorized embodiment of the convertible container shown configured as an activity mat 1800. FIG. 18B shows a top view of the embodiment of FIG. 18A with the motors and gears exposed. As illustrated, the walls 1801-1804 are raised and lowered by battery-powered motors 1806, which drive gears 1807*a-c*, shafts 1811, levers 1816, pulleys 1809, and spooling pulleys 1810*a* and 1810*b*, which in turn pull cables 1808 that raise and lower the walls 1801-1804 relative to the base 1805. Conventional slip clutches are employed at various gears 1807 and pulleys 1809, 1810 for safety and to protect the motors 1806 from becoming overloaded should the load on the walls 1801-1804 exceed the capacity of the motors. A timing circuit (shown in flow chart form in FIG. 19) on the motor 1806 can also be provided to stop driving the motors 1806 should the walls 1801-1804 not reach the raised or lowered position in a predetermined time. Helical gears 1812*a* and 1812*b* are utilized to cause a common direction of rotation of the spooling pulleys 1810*a* and 1810*b* such that one motor 1806 can be used to move end wall 1801 and side wall 1804 simultaneously and in the same direction of travel. Alternatively, each wall 1801, 1802, 1803, 1804 can be driven by its own motor, or a similar gear train can be utilized to drive all four walls with one motor.

Figure 18C:
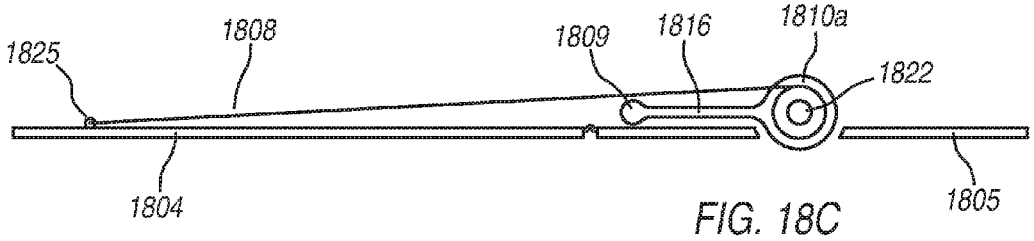
FIG. 18C-F illustrate various positions of a lever and pulley in progressively closed positions, which provide sufficient leverage to raise the walls of the convertible container.

FIG. 18C-F are close-up end views of the wall 1804, the base 1805, the cable 1808, the pulley 1809, the lever 1816 and the spooling pulley 1810*a*. FIG. 18C shows the "at rest" position of the convertible container motorized drive system in the activity mat 1800 configuration.

It has been determined that significant torque is required to lift the walls 1801-1804 of the activity mat 1800 from their positions in the open, flattened configuration. It was determined that leverage was needed to make the system work properly. The embodiment detailed as follows solved this starting torque situation.

When the convertible container is in its open, flattened configuration as the activity mat 1800, the cable 1808 is in a slack and unloaded condition. As a result, when the motor 1806 is initially energized, the lever 1816 is driven by the shaft 1822 and rotates upward without any load from the cable 1808.

Figure 18D:
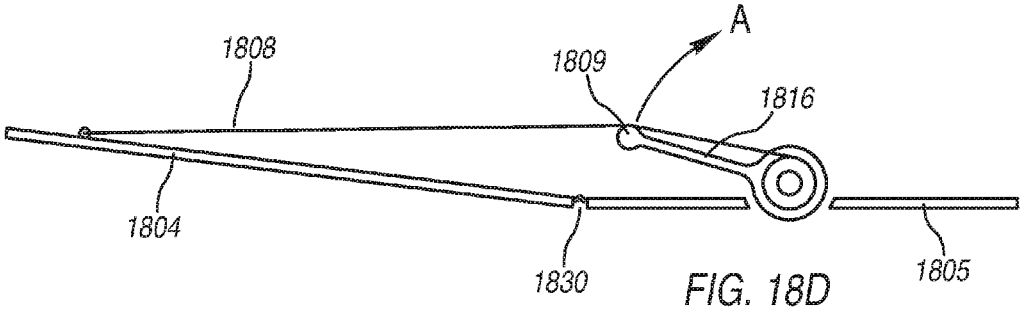
Figure 18E:
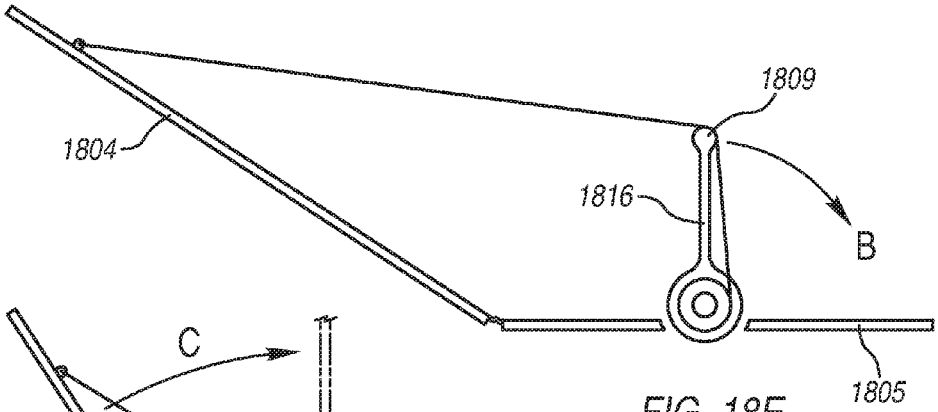
Figure 18F:
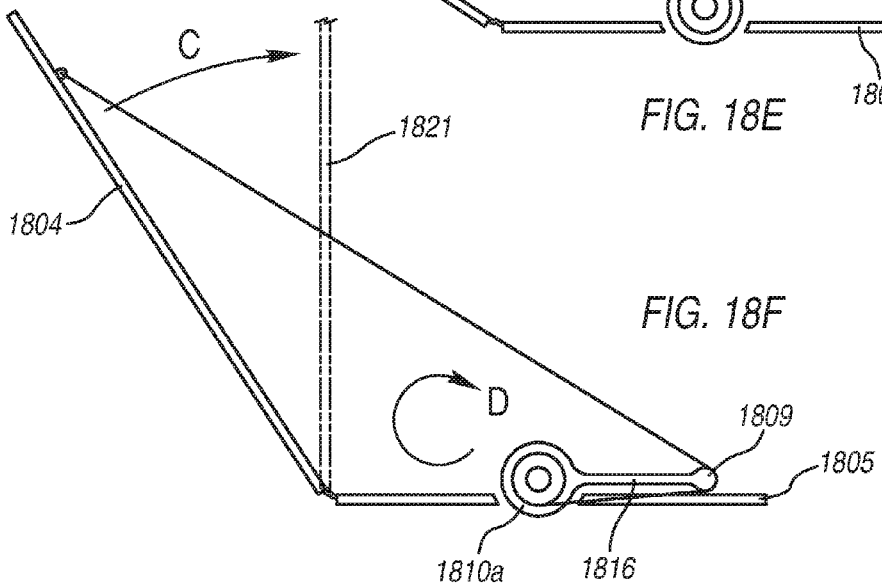

FIG. 18D shows the direction of travel A of the lever 1816 and the pulley 1809 engaged with the cable 1808 and beginning to lift wall 1804 relative to the base 1805 by way of the flexible junction 1830. FIG. 18E shows further rotation of the lever 1816 in direction B and the continued raising of the wall 1804. FIG. 18F shows the continued raising of the wall 1804 in direction C. Once the lever 1816 has rotated about 180 degrees, the spooling pulley 1810*a* continues to rotate and begins to spool the cable 1808 onto itself until the wall 1804 has reached an upright position 1821. At this point, attachment straps such as attachment straps 1412, zippers 105, or a belt 701 can be used to further secure adjacent walls to one another.

Alternatively, the cable 1808 can be connected directly to the pulley 1809 where the length of the cable 1808, the position of the fastener 1825, and the length of the lever 1816 are related such that the 180 degree rotation of the pulley 1809 and the lever 1816 are sufficient to move the wall 1804 from its lowered position with the slack cable to the raised position 1821 without the need for the spooling pulley 1810*a*.

Furthermore, a spooling pulley 1810*a* large enough to raise the cable 1808 above the base 1805 to command sufficient initial lifting leverage over the base 1805 would eliminate the need for the lever 1816 and the pulley 1809.

Sufficient slack on the cable 1808 may be provided such that the walls of the convertible container 1800 may be folded under the base 1805 to form the folded, stacked configuration such as shown in FIG. 14G. The difference is that in the motorized configuration the base 1805 and the drive system will be on a surface external to the stack.

A further alternative to the motorized embodiment is a combination of the spooling pulley and the belt-close convertible container detailed in connection with FIG. 7. In this embodiment, the motor spools the perimeter belt and erects the activity mat into an assembled box shape.

In these motorized embodiments, the base is thicker than the walls. In such cases, a plurality of handles and the like may be used to keep the open activity mat 1400 in a flat configuration (for example, the walls when opened could rest on the handles so that the walls do not slope downward away from the thicker base). Alternatively, the walls can be made to match or approximate the thickness of the base.

Figure 18G:
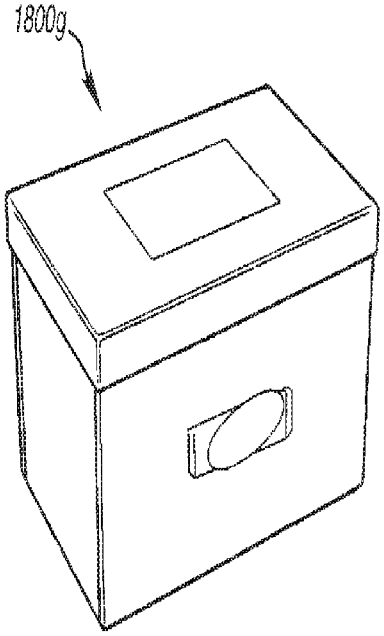
FIG. 18G is a perspective illustration of an exemplary motorized convertible container box according to the present invention in an erect, assembled configuration.
Figure 18I:
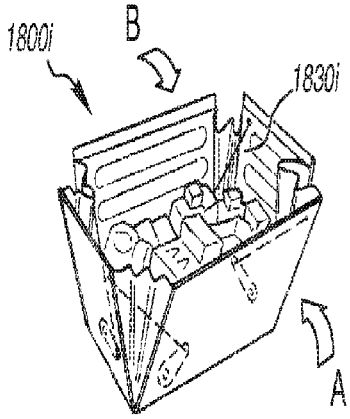
FIG. 18I is a perspective illustration of another motorized convertible container box in accordance with an embodiment of the present invention.
Figure 18H:
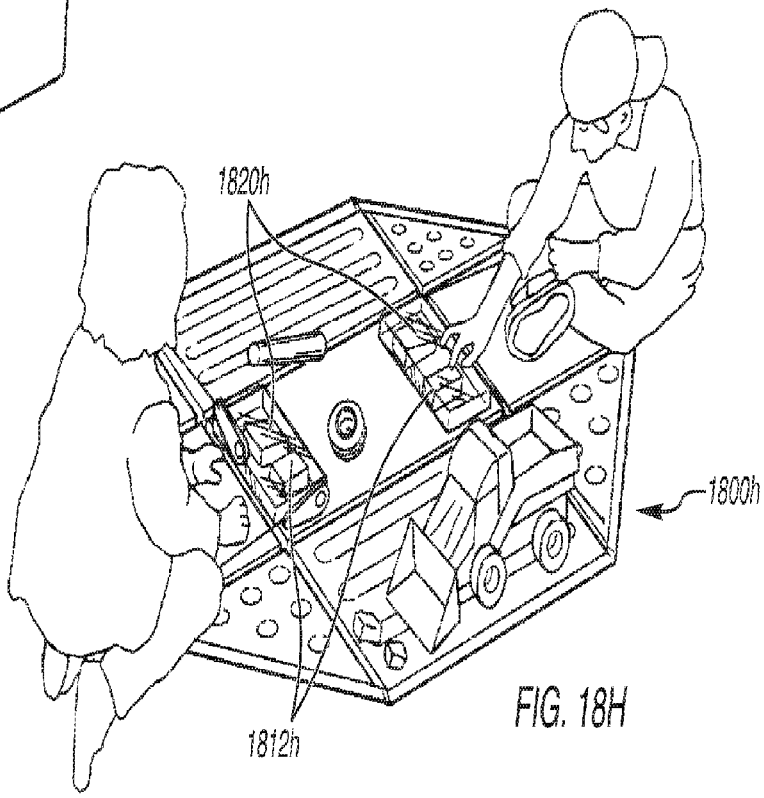
FIG. 18H is a perspective illustration of the container box of FIG. 18G in an open, flattened configuration as an activity mat.

FIGS. 18G and H are perspective illustrations of an exemplary motorized convertible container box 1800*g* according to the present invention in an erect, assembled configuration (FIG. 18G) and in an open, flattened configuration as an activity mat 1800*h* (FIG. 18H). The container box 1800*g* includes a drive system 1812*h* that is covered by a translucent or transparent cover 1820*h* to permit viewing of the drive system 1812*h* in action as the activity mat 1800*h* is converted to the container box 1800*g* and vice versa.

FIG. 18I is a perspective illustration of another motorized convertible container box 1800*i* in accordance with an embodiment of the present invention. Cables 1830*i* are tightened and released by electric or spring motors as described above.

Figure 19:
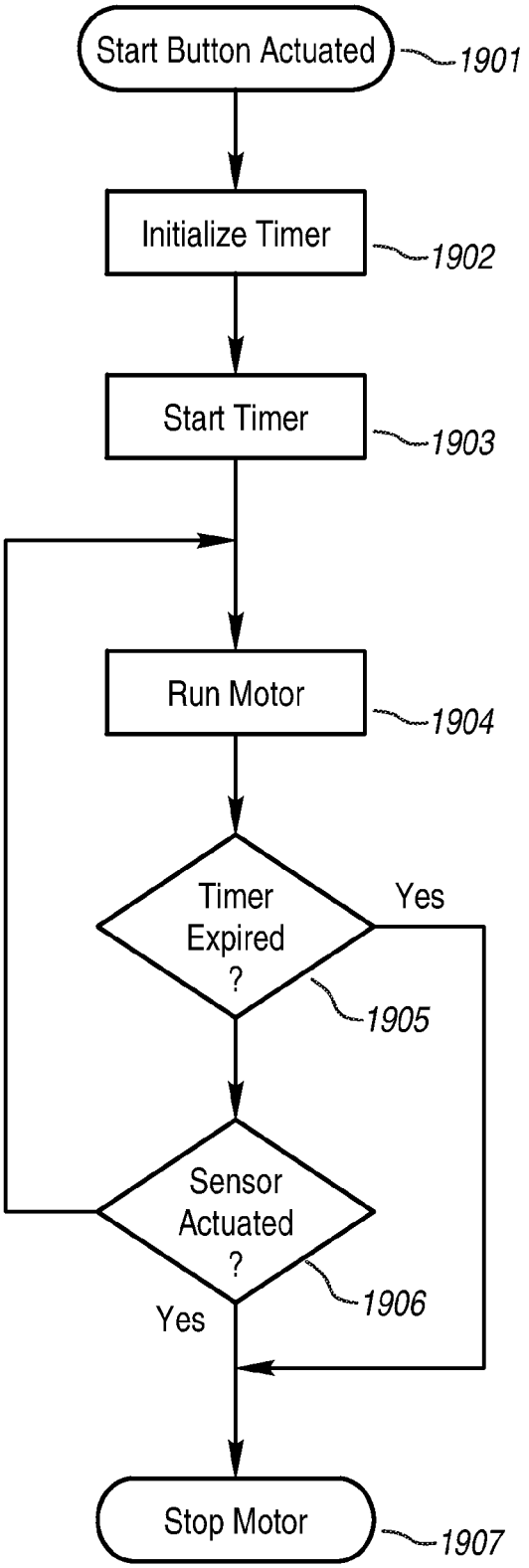
FIG. 19 is a functional flow chart of a procedure for starting and stopping a motor used to raise and lower walls of a convertible container according to an embodiment of the present invention.

FIG. 19 is a flow chart diagram of a procedure for automatically stopping and running a motor in the motorized embodiments, such as the motor 1806. In an alternate embodiment, the motor 1086 can be actuated manually, i.e., one or more buttons can be depressed until the walls are completely raised or lowered.

According to an embodiment, a start button is actuated (1901) by a user to either raise or lower walls of a convertible container according to the present invention. The end-point detection for the motor 1806 can be accomplished by the expiration of a timer and/or activation of a sensor. A timer is initialized (1902) and started (1903) until an expiration period has elapsed. The motor 1806 is run (1904) and a determination is made as to whether the timer has expired (1905). If so, the motor is stopped (1907). Additionally or alternatively, a sensor can be checked (1906) to determine whether the sensor has been actuated. If so, the motor is stopped (1907), otherwise, the motor continues to run (1904) and the loop is restarted.

FIG. 20A-D is a close up illustration of the drive system of a further motorized embodiment of a convertible container. A wall 2001 of the convertible container is connected to a base 2002 by way of a flexible junction 2012. The drive system includes a slider link 2004, a mounting anchor 2005, a driven link 2008, a motor 2009, a motor controller 2013 mounted to the base 2002, a shaft drive 2015, and an actuation switch 2003 mounted to the wall 2001. When the actuation switch 2003 is pressed, the control sequence illustrated in FIG. 19 is initiated (electrical wires and connections are not shown for clarity of illustration). Accordingly, the motor 2009 begins to rotate its drive shaft 2015 in direction A. The driven link 2008 is attached to the drive shaft 2015 and the driven link 2008 rotates accordingly. A conventional slip clutch (not illustrated) can be implemented at the junction between the driven link 2008 and the drive shaft 2015. The slip clutch slips if the torque required to move the link exceeds the torque limit of the slip clutch. This prevents motor overload and/or burn-out.

Figure 20A:
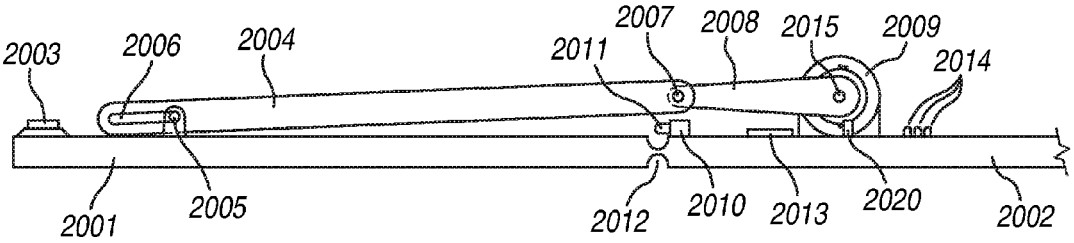
FIG. 20A is a partial end view of part of a convertible container in an open, flattened configuration showing a drive system according to an embodiment of the present invention.

The driven link 2008 is attached to the slider link 2004 at a coupling 2007. The slider link 2004 attaches to the wall 2001 by way of mounting anchor 2005. The slider link 2004 is free to move back-and-forth with respect to the mounting anchor 2005 by way of a slot 2006 in the slider link 2004. FIG. 20A illustrates the slider link 2004 with the mounting anchor 2005 in the horizontal at-rest position of the slot 2006.

Figure 20B:
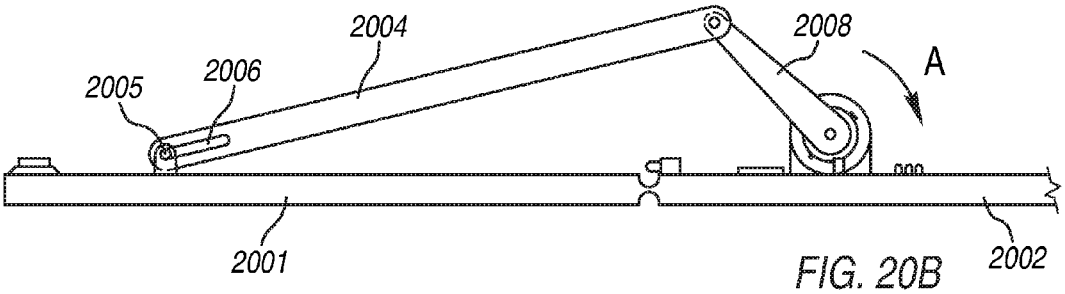
FIG. 20B illustrates the drive system of FIG. 20A in a slightly raised position.

As the driven link 2008 begins to rotate, the slider link 2004 lifts. Initially, the wall 2001 does not move because the slider link 2004 pivots and slides about mounting anchor 2005. FIG. 20B illustrates the slider link 2004 with the mounting anchor 2005 in the lift position of the slot 2006. At this point, the wall 2001 will begin to lift.

Figure 20C:
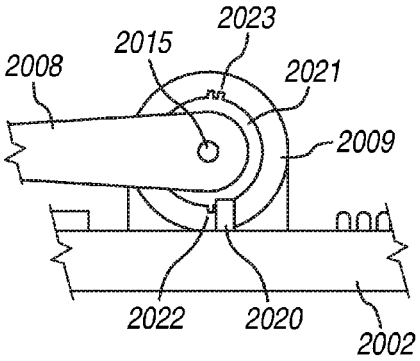
FIG. 20C illustrates a detailed view of a portion of the drive system of FIG. 20A.
Figure 20D:
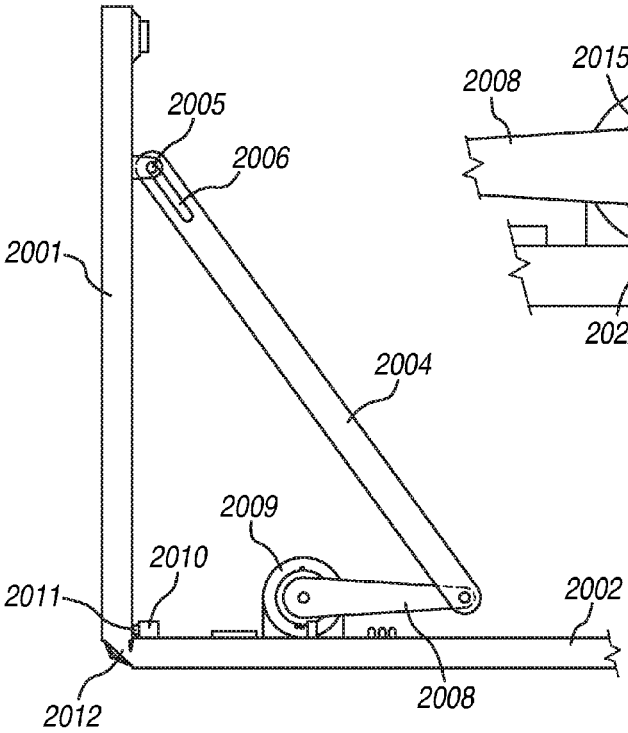
FIG. 20D illustrates the drive system of FIG. 20A holding a wall of the convertible container in an upright position.

FIG. 20D illustrates the driven link 2008 in a position 180 degrees from the initial position shown in FIG. 20A. This rotation caused the wall 2001 to move from its at-rest horizontal position to its at-rest upright position. The gearing ratios of the motor 2009 and/or a motor brake (not illustrated) keep the wall from returning to the horizontal position when the motor 2009 is not powered by the motor controller 2013. Furthermore, the relationship of the slot 2006 and the mounting anchor 2005 results in the wall 2001 being held in the position shown. In order for the wall 2001 to move past the vertical position, the mounting anchor 2005 would need to travel downward in the slot 2006 and the flexible junction 2012 substantially inhibits this motion.

Reversing the direction of the motor 2009 will drive the linkage in the opposite direction and result in the lowering of the wall 2001.

The motor controller 2013 follows the flow chart illustrated in FIG. 19 and can use the proximity switch 2010 and/or an encoder sensor 2020 to determine the position of the wall 2001 and the driven link 2008. The proximity switch 2010 utilizes an actuator 2011 to determine the position of the wall 2001. When the wall 2001 is not in the upright position, as shown in FIGS. 20A and 20B, the actuator 2011 is not pressed. When the wall 2001 is in the upright position as shown in FIG. 20D, the actuator is pressed and the motor controller 2013 senses that the wall 2001 is in the upright position. Similarly, a second sensor or a multi-position sensor can be used to allow the motor controller 2013 to sense the up and down positions of the wall 2001.

FIG. 20C is a close up view of the motor 2009, the driven link 2008, the encoder sensor 2020, and an encoder disk 2021. The encoder disk 2021 is mounted to the driven link 2008 such that in the event that the motor 2009 and the link 2004 are not moving together as a result of slippage in the slip clutch (not shown), the motor controller 2013 can determine the position of the driven link 2008 and therefore the wall 2001.

The encoder disk 2021 has a horizontal wall position flag 2022 and a vertical wall position flag 2023. Two flags are illustrated for clarity, but in other embodiments more flags can be used to provide greater resolution of the location of the linkage 2008 and correspondingly the wall 2001.

As the driven lever 2008 rotates, the encoder disk 2021 rotates and the flags 2022 or 2023 pass by the encoder sensor 2020. The flags 2022, 2023 cause a signal to be produced by the encoder sensor 2020, which is read by the motor controller 2013 and determines the location of the linkage 2008 and correspondingly, the wall 2001. The encoder sensor 2020 can be an optical switch, a mechanical switch, a capacitive sensor or other type of sensor generally known in the art.

A second encoder and sensor (not illustrated) which sense the position of the motor shaft 2015 can be used to determine if the linkage 2008 is slipping with respect to the motor shaft 2015. Information regarding slippage can be used by the motor controller 2013 to stop the motor 2009, reverse the motor 2009 and/or to signal the user through the use of lights such as LEDs 2014 or a speaker (not illustrated). Furthermore, a torque sensor (not illustrated) can be used to similarly monitor the motor 2009.

The LEDs 2014 can be used for a variety of purposes including: entertainment; communication of power status; communication that the device is in motion; warning the user of a motor slip or overload; warning of a battery low condition; or other purposes.

The sliding of the slider link 2004 between FIG. 20A and FIG. 20B is representative of the slack condition described regarding the cable 1818. In a similar condition, the motor 2009 does not experience the load of lifting the wall 2001 until there is sufficient leverage to lift the wall 2001 by way of the driven link 2008. Sufficient stretch of the flexible junction 2012 and the strategic location of the coupling 2007 are required in order for the lever linked device to take the form of the folded, stacked configuration.

Figure 21A:
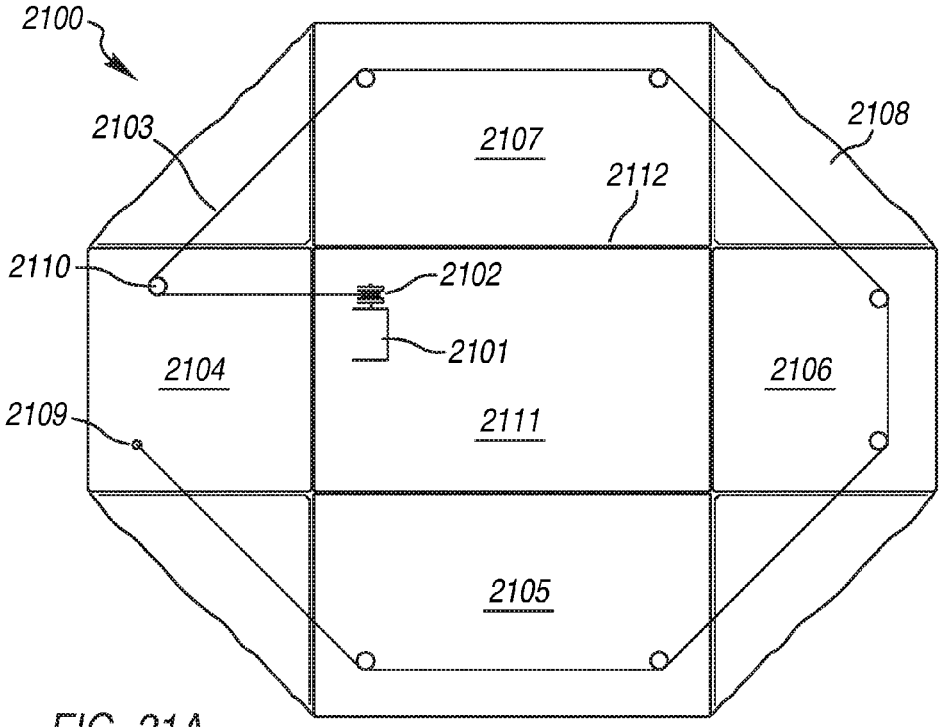
FIG. 21A illustrates a single motor embodiment of a motorized convertible container in an open, flattened configuration as an activity mat having a motor that drives a spooling pulley, which spools a string that lifts walls of the activity mat by way of a flexible junction, according to an embodiment of the present invention.

FIG. 21A illustrates a single motor embodiment of a motorized convertible container in an open, flattened configuration as an activity mat 2100 having a motor 2101 (with or without gearing) that drives a spooling pulley 2102, which spools a string 2103 that lifts walls 2104-2107 of the activity mat 2100 with respect to a base 2111 by way of a flexible junction 2112. The lifting action resembles that shown in FIG. 7B. The string 2103 is affixed to a wall end 2104 by way of an anchor 2109. As the string 2103 is spooled onto the pulley 2102, the string 2103 slips through ringlets 2110 which act as idler pulleys. As the amount of string 2103 on the spooling pulley 2102 increases, the wall ends 2104 and 2106 and wall sides 2105 and 2107 continue to rise.

Figure 21B:
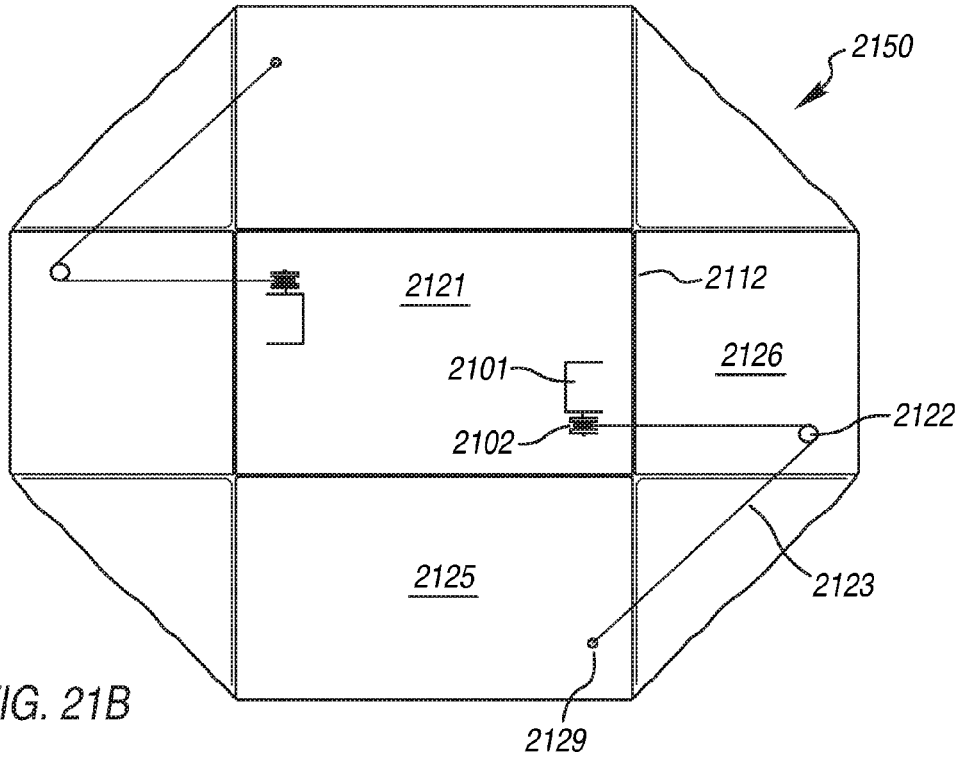
FIG. 21B illustrates a two-motor embodiment of a motorized convertible container similar to that shown in FIG. 21A, according to an embodiment of the present invention.

FIG. 21B illustrates a two-motor embodiment of a motorized convertible container in an open, flattened configuration as an activity mat 2150 where each motor 2101 drives a spooling pulley 2102, which spools a string 2123 that lifts one wall end 2126 and one wall side 2125 of the activity mat 2150 with respect to a base 2121 by way of a flexible junction 2112. The lifting action resembles that shown in FIG. 7B. The string is affixed to wall end 2125 by way of an anchor 2129. As the string 2123 is spooled onto the pulley 2102, the string 2123 slips through ringlet 2122 which acts as an idler pulley. As the amount of string 2123 on the spooling pulley 2102 increases, the wall end 2126 and wall side 2125 continue to rise.

Figure 21C:
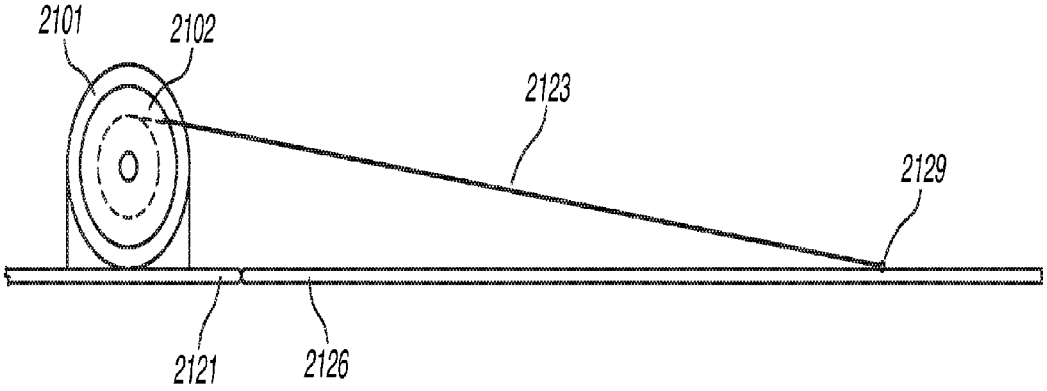
FIG. 21C is a close-up end view of the drive system shown in FIG. 21B.

FIG. 21C is a close-up end view of the drive system shown in FIG. 21B. The drive system in FIG. 21A is similar. The string 2123 is spooled by the spooling pulley 2102 connected to the motor 2101, which is mounted to the base 2121. Because the string 2123 wraps over the spooling pulley 2102, leverage is created with respect to the anchor 2129. Just as described in FIGS. 18 and 19, when the convertible container box is in the activity mat configuration 2150, the string 2123 is in a slack condition (not illustrated). Alternatively, the string 2123 may be or contain an elastic section to provide the slack condition necessary for the convertible container to be converted into a folded, stacked configuration.

Figure 22A:
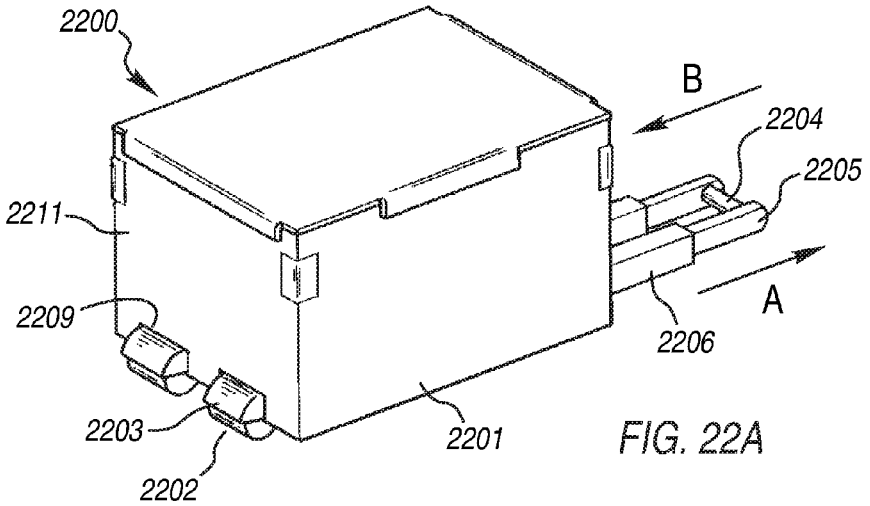
FIG. 22A is a perspective view of a convertible container in an erect, assembled configuration having rollers and a telescoping handle according to an embodiment of the present invention.

FIGS. 22A, B and C illustrate a convertible container 2201 in an erect, assembled configuration 2200 and in an open, flattened configuration 2200*a* as an activity mat. A pair of rollers 2202 positioned at one edge of the convertible container 2201 and covered with fenders 2203. The fenders 2203 mount to a base 2210 of the container and there are cut outs 2209 in a wall end 2211 of the convertible container 2201 such that when it is converted from the erect, assembled configuration 2200 to the open, flattened configuration 2200*a*, the fenders 2203 remain in place and wall end 2011 moves about the fenders 2203.

Telescoping struts 2205 and 2006 are mounted under the base 2210. Plates 2208 mount to the struts 2205 and 2206 and are attached to the base 2210 with fasteners 2208.

Figure 22B:
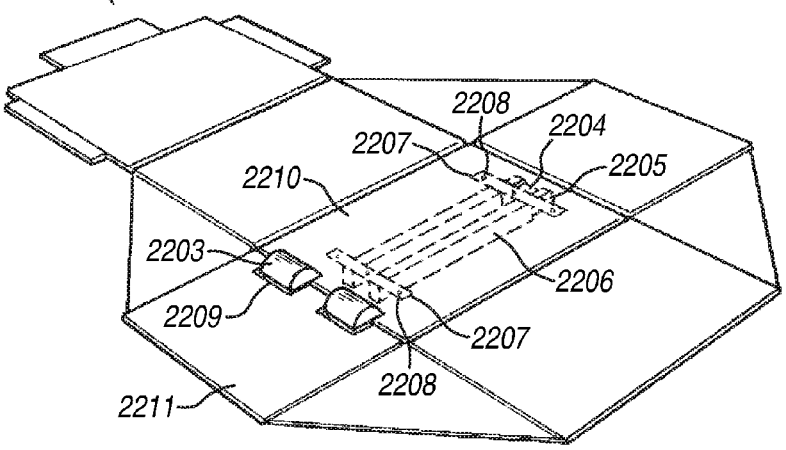
FIG. 22B shows the convertible container of FIG. 22A in an open, flattened configuration.
Figure 22C:
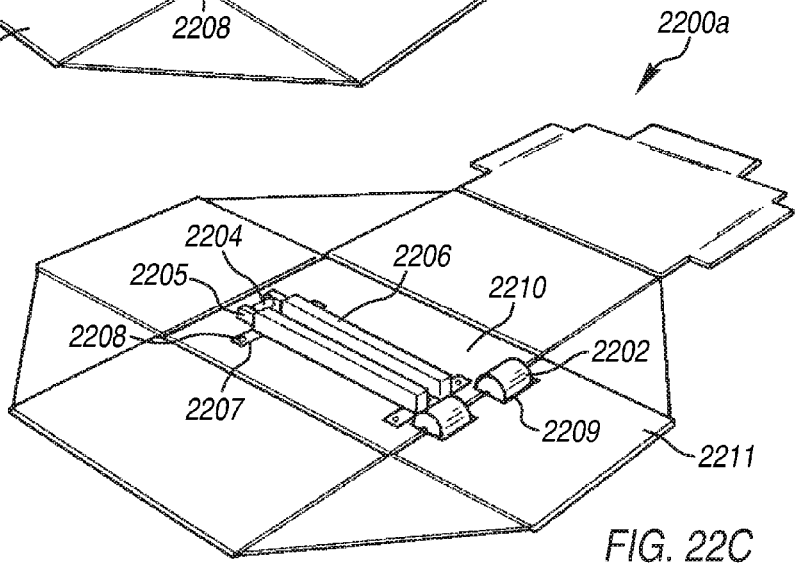
FIG. 22C shows the reverse side of the convertible container shown in FIG. 22B.

FIG. 22A shows the handle 2204 in its extended position, which is achieved by pulling the handle 2204 in direction A. FIGS. 22B and 22C show the handle in a retracted position, which is achieved by pushing the handle 2204 in direction B.

The rollers 2202 and the handle 2204 allow the convertible container 2201 to easily transport articles from place to place, and can be adapted into all the various embodiments of the invention described herein.

Any of the convertible containers herein can be fitted with conventional over-the-shoulder straps to operate as a backpack. Thus, for example, the convertible container 2201 may also include backpack straps, and thus be carried on a person's back or wheeled along the floor by the handle 2204.

Figure 23A:
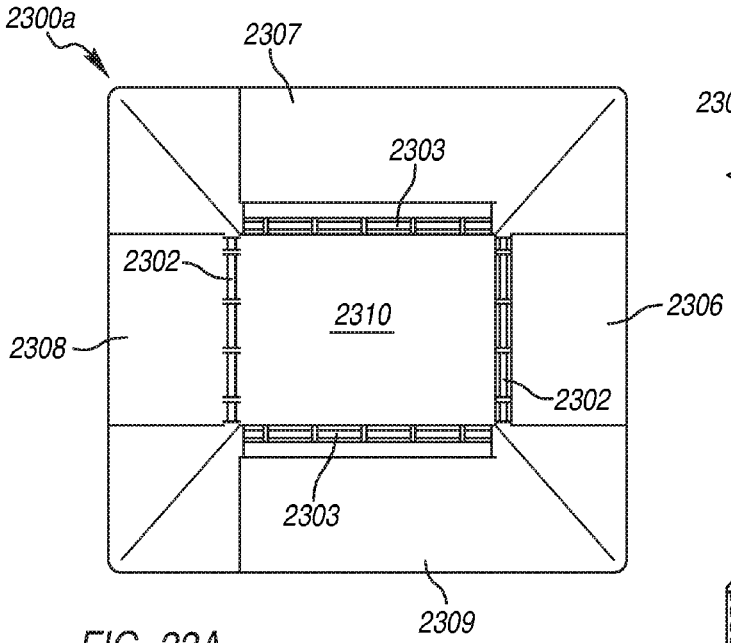
FIG. 23A is a top view of a convertible container according to an embodiment of the invention with hinges located at the junctions.

FIG. 23A illustrates a top view of the activity mat 2300*a* according to another embodiment of the invention where the junctions connecting wall ends 2306 and 2308 to a base 2310 are hinges 2302 and where the junctions connecting the wall sides 2307 and 2309 to the base 2310 are offset hinges 2303. Standard hinges can be attached to the base 2310 and the wall ends 2306 and 2308 and the wall sides 2307 and 2309. Preferably, the hinges are molded extensions of the molded wall ends 2306 and 2308, wall sides 2307 and 2309, and the base 2310.

Figure 23G:
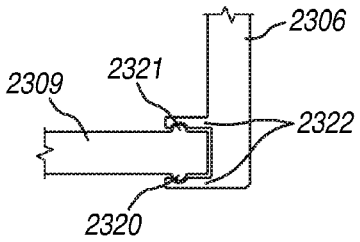
FIG. 23G illustrates a close-up view of wall side and wall end joined by a connector that is integral to the wall side and wall end.
Figure 23D:
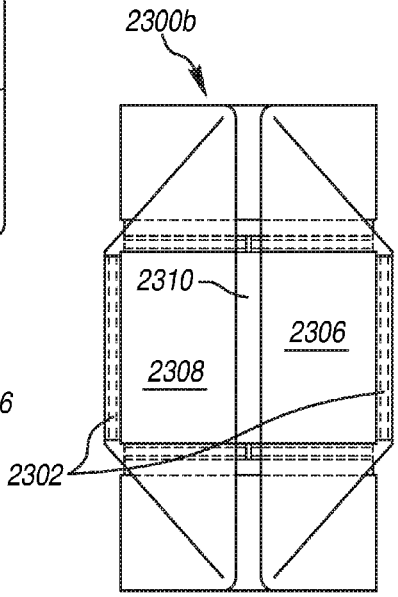
FIG. 23D is a partially folded convertible container according to an embodiment of the invention.
Figure 23B:
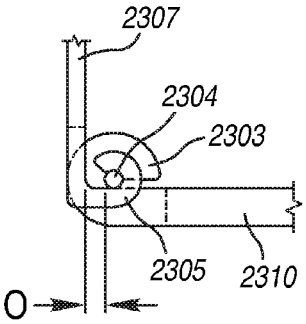
FIGS. 23B and C are close-up illustrations of the hinges in the configuration where the walls of the convertible container are upright.

FIG. 23B is a close-up view of the hinge 2303. The end of the wall side 2307 wraps around the hinge pin 2304 and the end of the base 2310 also wraps around the hinge pin 2304 creating the knuckles of the hinge 2303. In this case, the wall side 2307 has an offset 2305 of distance O which corresponds to the thickness T of the wall ends 2306 and 2308. The hinge 2303 that connects wall side 2309 to the base 2310 is similarly constructed.

Figure 23C:
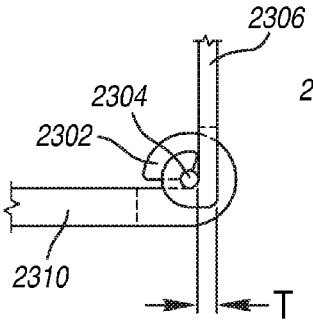
FIG. 23E is a close-up of the hinges in a configuration where the walls are folded flat.
FIG. 23F illustrates the folded, stacked configuration of the hinged embodiment of the convertible container.

FIG. 23C is a close-up view of the hinge 2302. The end of the wall end 2306 wraps around the hinge pin 2304 and the end of the base 2310 also wraps around the hinge pin 2304 creating the knuckles of the hinge 2302. The hinge 2302 which connects wall end 2308 to the base 2310 is similarly constructed.

The hinge pin 2304 can be made of metal, plastic, or hard rubber. A tight fitting metal, plastic or rubber hinge pin 2304 will create friction which can be used to keep the walls in vertical positions during fastening. Alternatively, dimples and sockets can be molded into the walls and base 2310 to create a similar hinge means.

Figure 23E:
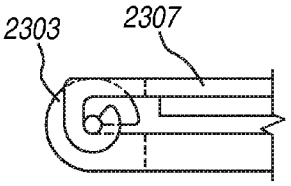
Figure 23F:
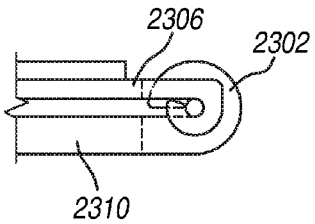
Figure 23F:
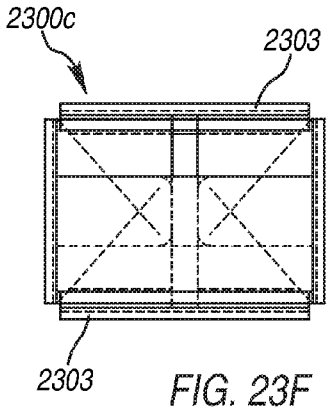

FIG. 23D illustrates a top view of the activity mat 2300*b* in a partially folded configuration where the wall ends 2306 and 2308 have been pivoted about the hinges 2302 and lying on the base 2310. Note that in this view, the wall ends 2306 and 2308 do not overlap. The offset hinge 2303 provides the clearance necessary for the wall sides 2307 and 2309 to be folded on top of the wall ends 2306 and 2308. FIG. 23E illustrates the height relationships between the folded end wall 2306 and the folded side wall 2307. FIG. 23F illustrates the hinged convertible container 2300*c* in a folded, stacked configuration.

FIG. 23G illustrates a close-up view of an attachment mechanism for connecting the walls of the convertible container in the erect, assembled configuration whereby wall side 2309 and wall end 2306 are affixed together by an interference fit of a molded protrusion feature 2322 in the wall end 2306. The protrusion feature 2322 has sockets 2320 and the wall side 2309 has pins 2321 that engage into the sockets 2320 thereby fastening the wall end 2306 to the wall side 2309. This means of attachment can be molded directly into the walls. Alternatively, these molded-in attachment features can take the form of snaps, clasps and other interference fit connectors.

The motorized embodiments of the convertible container converts a frustrating clean-up to a fun and fascinating activity. Accordingly, the motorization can be made a focal point of the device by encasing the drive system under a transparent or translucent cover or housing. The motors, gears, pulleys, shafts, and cables can all be made in various colors to further enhance the entertaining aspects of the device. The housings 1814 and 1815 can fit tightly over the components, or a continuous cover of the size of the base 1805 can be placed over the entire motor drive assembly. A continuous cover needs to have an opening for the cables and optionally a dome for the levers. Additionally, the cable 1808 should be placed inside the overcoat 1302 or under a separate covering for safety and convenience purposes. Furthermore, the opaque, translucent, or transparent continuous cover can still be compatible with interlocking building blocks.

Moreover converting a convertible container according to the present invention into an activity mat creates an activity area that is substantially greater than the footprint of the container in its erect, assembled configuration. Given a convertible container as shown in FIG. 14A where height=H, width=W, and length=L, the footprint of the container is defined as:

$$\text{Convertible Container Footprint Area} = W \times L = WL$$

Opening the same convertible container into the activity mat configuration as shown in FIG. 8, for example, results in an activity mat with a footprint area as defined by:

$$\begin{aligned}\text{Activity Mat Footprint} &= (H+W+H)\times(H+L+H)-4\times(1/2\times H\times H)\\ &= (2H+W)\times(2H+L)-2H^2\\ &= 2H^2+2H+WL\end{aligned}$$

Thus, the ratio of the activity mat footprint to the convertible container box footprint is dependent upon the height of the convertible container box. For use as a convertible container box as herein described, the ratio of the activity mat footprint to the box footprint should exceed 2. The footprint of the activity mat in the open, flattened configuration in the embodiments described herein ranges from approximately 0.5 square feet to 15 square feet. The overall weight of the convertible container box according to the embodiments described herein is less than about 10 pounds.

Figure 24:
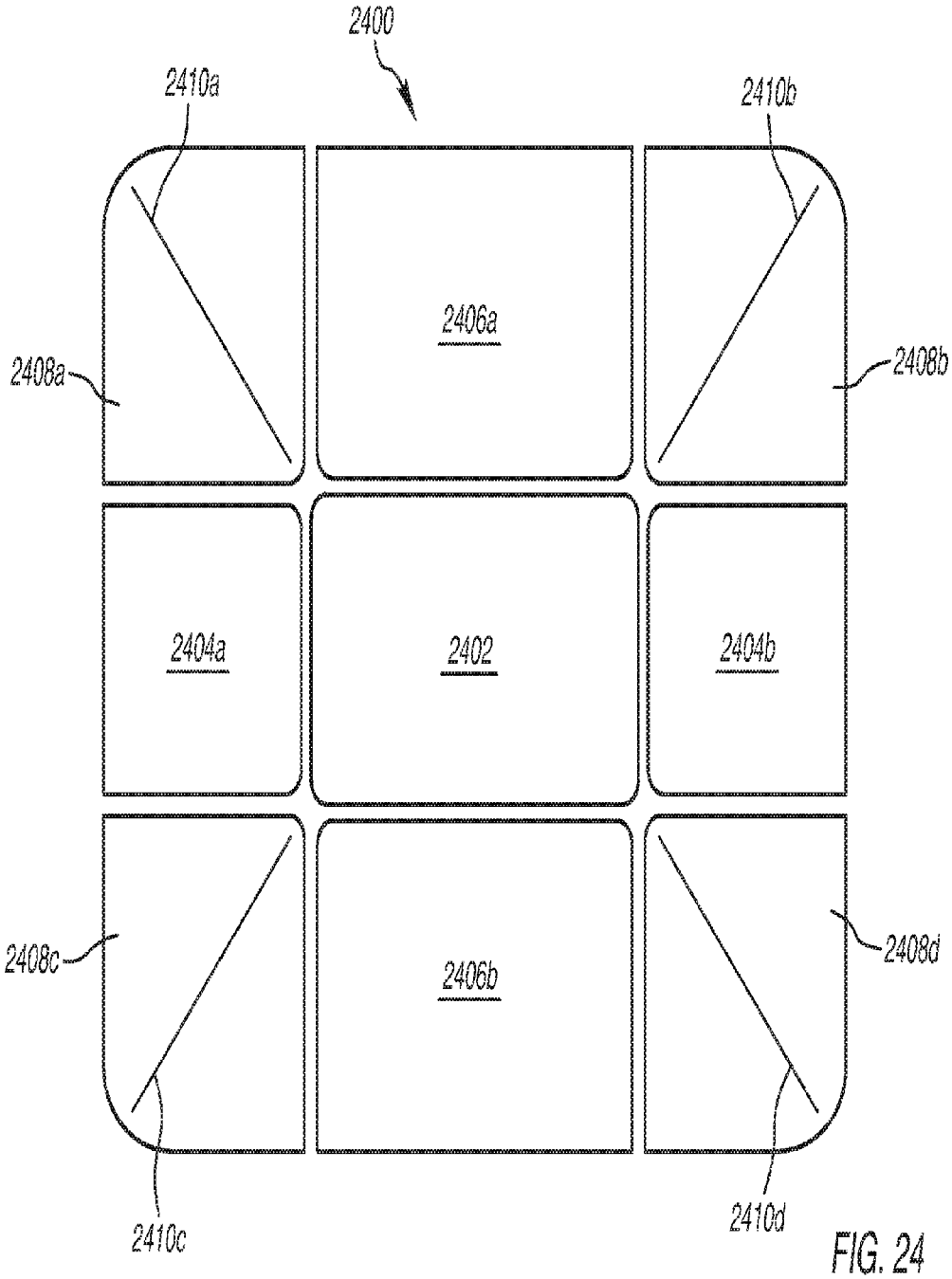
FIG. 24 is a top view of the semi-rigid panels used in connection with various embodiments of the present invention.

FIG. 24 is a top view of a configuration 2400 of semi-rigid panels that are used to form the wall sides, ends, and biasing members of a convertible container according to various embodiments of the present invention. The configuration 2400 includes a base panel 2402, wall side panels 2404*a,b*, wall end panels 2406*a,b*, and biasing members 2408*a,b,c,d*. The biasing members are scored or folded along fold lines 2410*a,b,c,d*, respectively, such that the biasing members tend to fold inward toward the interior of the convertible container that is formed when the wall side panels 2404 and end panels 2406 are folded. It is important to note that the wall end panels 2406*a,b* have a width that is smaller than the base 2402 so as to help bias the biasing members 2408*a,b,c,d* toward the wall side panels 2404*a,b* when the configuration 2400 is folded into a convertible container in accordance with the present invention. In addition, the width of the wall side panels 2404*a,b* is smaller than the width of the biasing members 2408*a,b,c,d*. This biasing system is described further in connection with FIG. 32. This biasing system prevents the biasing members 2408*a,b,c,d* from tending toward the center of the convertible container and remain flush against one of the wall sides of the convertible container.

Figure 25A:
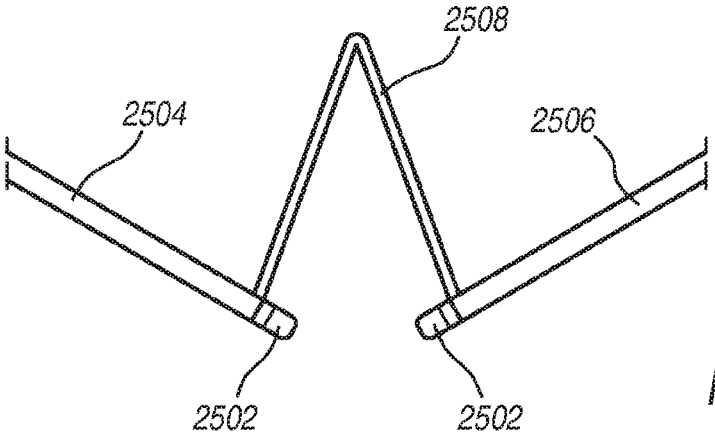
FIG. 25A is a top view of a corner of a convertible container in which the zipper tape is hidden according to an embodiment of the present invention.

FIG. 25A a top view of a corner of a convertible container in which zipper tape is hidden according to an embodiment of the present invention. Only teeth 2502 of the zipper coil are exposed and extend beyond a wall side 2504 and wall end 2506. The zipper tape (not shown) is hidden within the side wall 2504 and the wall end 2506. A corner baffle 2508 connects the wall side 2504 to the wall end 2506.

Figure 25B:
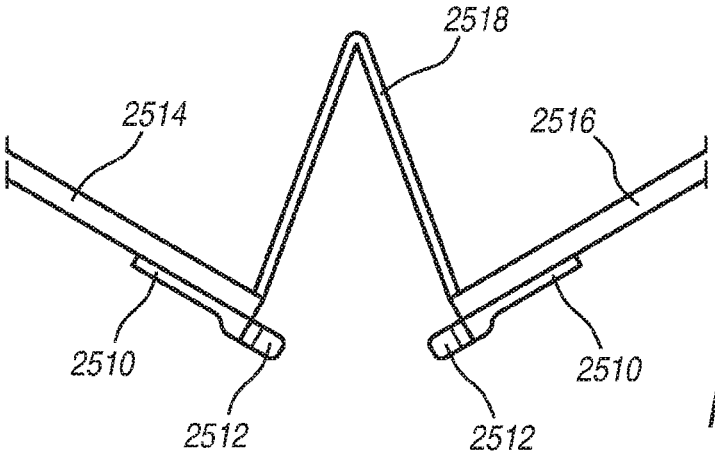
FIG. 25B is a top view of a corner of a convertible container in which the zipper tape is exposed outside of the convertible container according to an embodiment of the present invention.

FIG. 25B moves a zipper tape 2510 to the exterior of a wall side 2514 and wall end 2516, which are connected by a corner baffle 2518. The thickness of the zipper tape 2510 has been exaggerated for clarity of illustration.

Figure 25C:
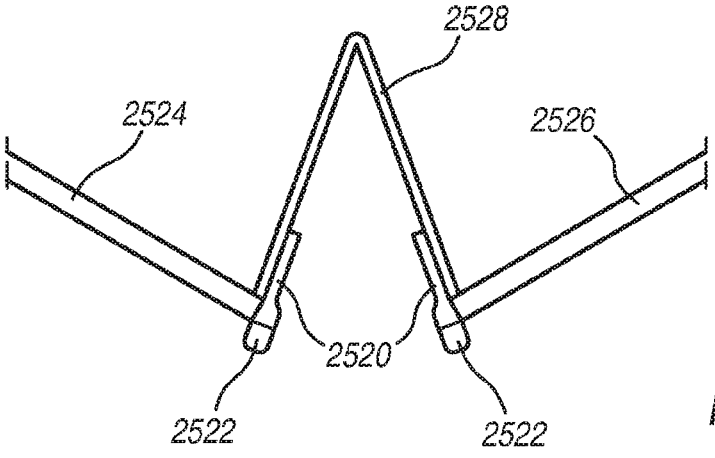
FIG. 25C is a top view of a corner of a convertible container in which the zipper tape is exposed inside the corner baffles of the convertible container according to an embodiment of the present invention.

FIG. 25C shows a zipper tape 2520 attached to the inside a corner baffle 2528 of a convertible container according to an embodiment of the present invention. Zipper teeth 2522 extend beyond the zipper tape 2520. The zipper tape is concealed from view when the zipper teeth 2522 are engaged.

Figure 26A:
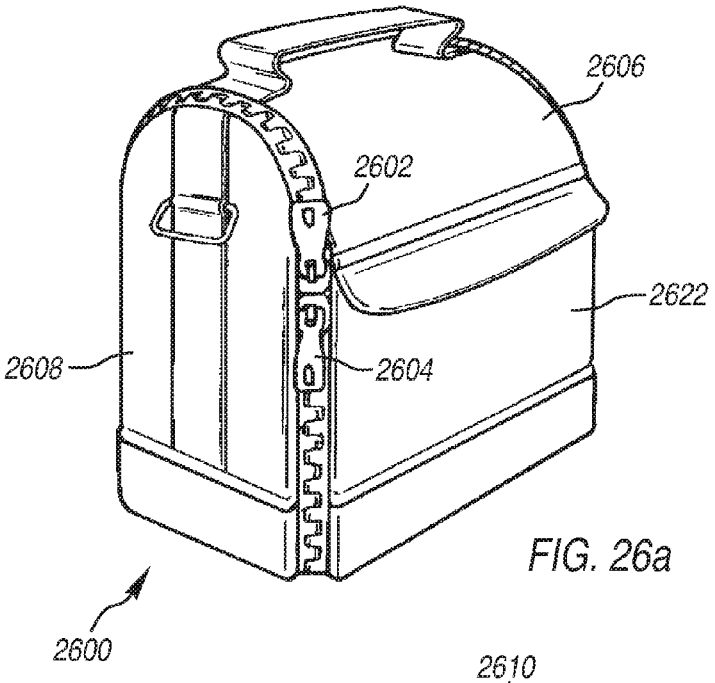
FIG. 26A is a perspective view of a convertible container in an erect, assembled configuration having zippers to close a top portion of the wall ends of the convertible container according to an embodiment of the present invention.
Figure 26B:
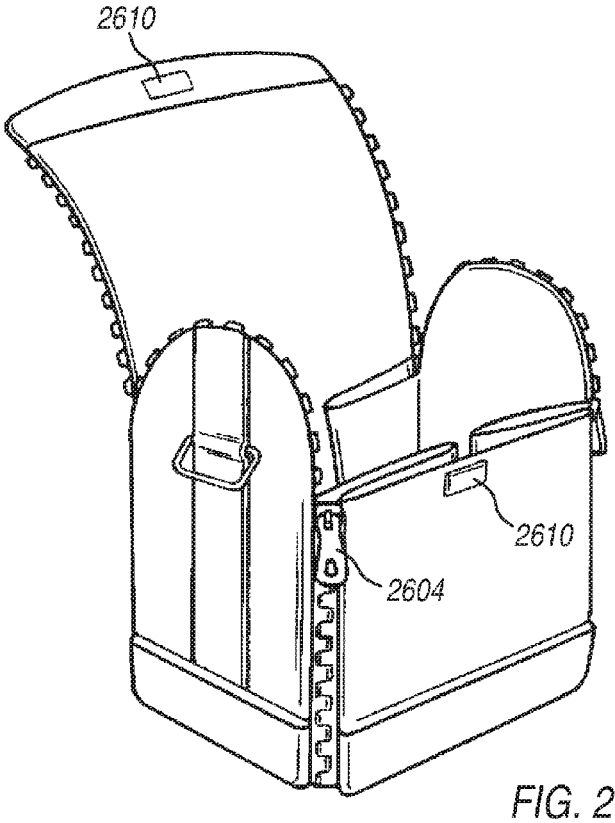
FIG. 26B is a perspective view of the convertible container shown in FIG. 26A with the top portion unzipped to reveal a Velcro flap.
Figure 26C:
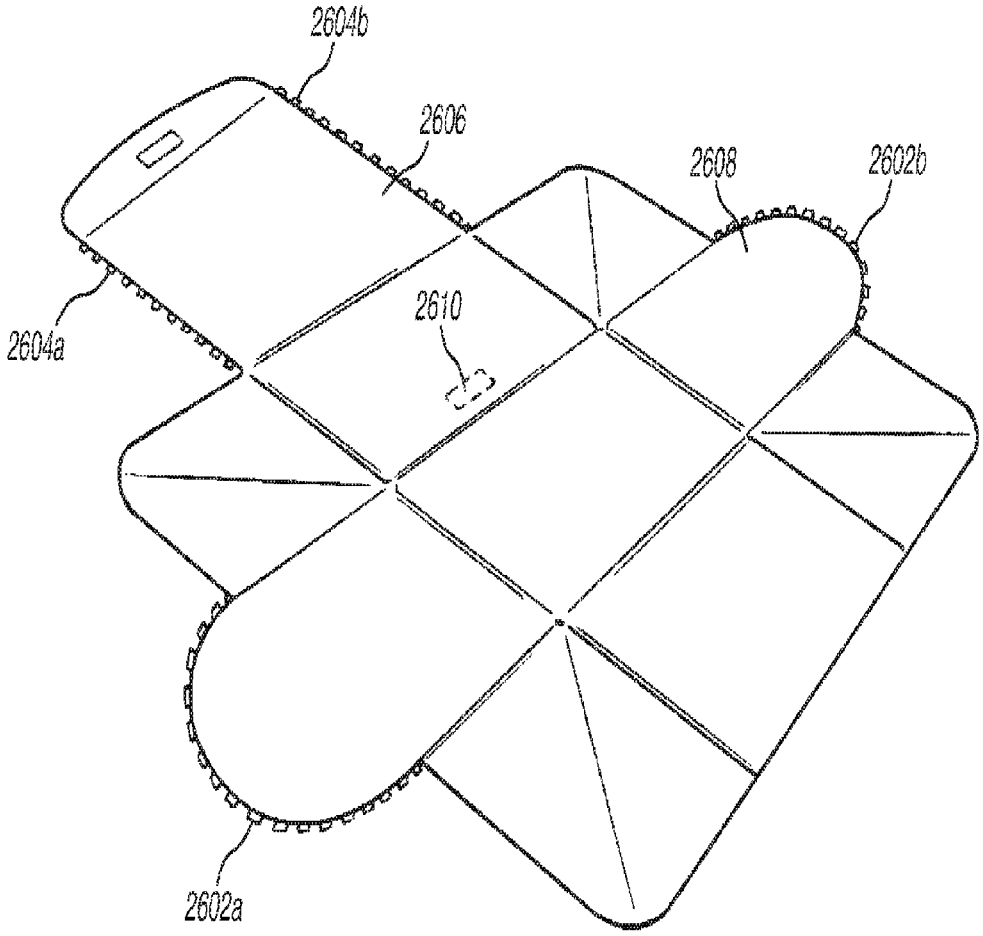
FIG. 26C is a perspective view of the inside of the convertible container shown in FIG. 26A in an open, flattened configuration.

FIG. 26A is a perspective view of a convertible container 2600 in an erect, assembled configuration having zippers 2602, 2604 to close a top portion 2606 of the wall ends 2608 of the convertible container 2600 according to an embodiment of the present invention. The top portion 2606 of the convertible container 2600 is partially unzipped in FIG. 26B to reveal a Velcro flap 2610. When the zipper 2604 is unzipped (as well as the corresponding zipper on the hidden side of the convertible container 2600), the convertible container 2600 is unfolded into an open, flattened configuration shown in FIG. 26C. Zipper teeth 2602*a,b* corresponding to the zipper 2602 and zipper teeth 2604*a,b* corresponding to the zipper 2604 are shown. An application of the convertible container 2600 is a lunch box. The convertible container 2600 carries food and drink items when in its erect, assembled configuration and unfolds into a convenient placemat during mealtime. After the meal has been consumed, cleanup is simply a matter of returning the convertible container 2600 to its erect, assembled configuration or to a stacked, folded configuration. A damp cloth can be used to wipe the surfaces of the convertible container 2600 with tight seams formed along the wall-baffle interfaces to prevent leak-through and absorption of liquids into the padding or insulation of the convertible container 2600.

Figure 26D:
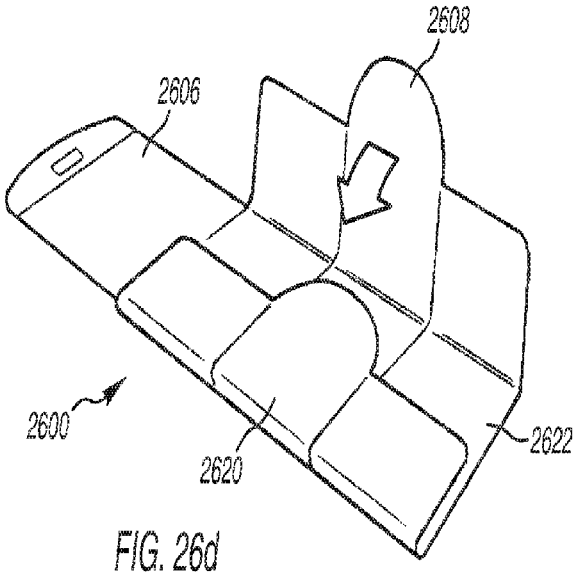
FIGS. 26D-G illustrate various views of a folding method transforming the convertible container of FIG. 26C from its open, flattened configuration into a stacked, folded configuration according to an embodiment of the present invention.
Figure 26E:
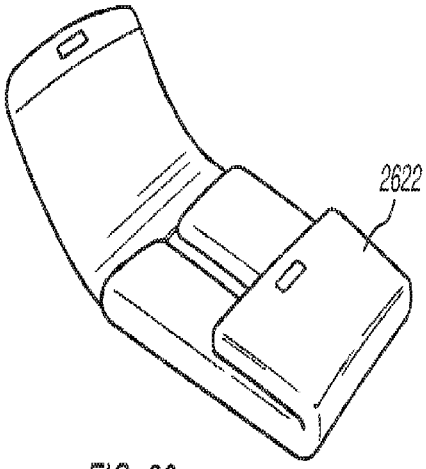
Figure 26F:
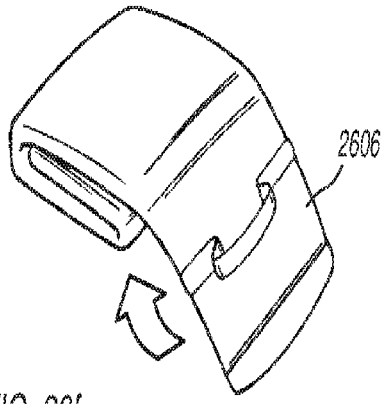
Figure 26G:
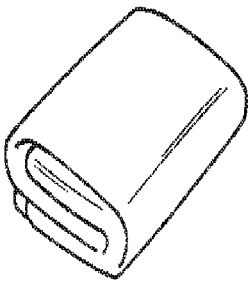

FIGS. 26D-G illustrate various views of a folding method transforming the convertible container 2600 of FIG. 26A from its open, flattened configuration (FIG. 26C) into a stacked, folded configuration (FIG. 26G) according to an embodiment of the present invention. Wall end 2620 is folded inward, then wall end 2608 is folded thereover, as shown in FIG. 26D. In FIG. 26E, wall side 2622 is then folded over wall ends 2608, 2620, and the convertible container 2600 is flipped over (FIG. 26F) and the top portion 2606 is folded under to produce a stacked, folded configuration (FIG. 26G).

Figure 27A:
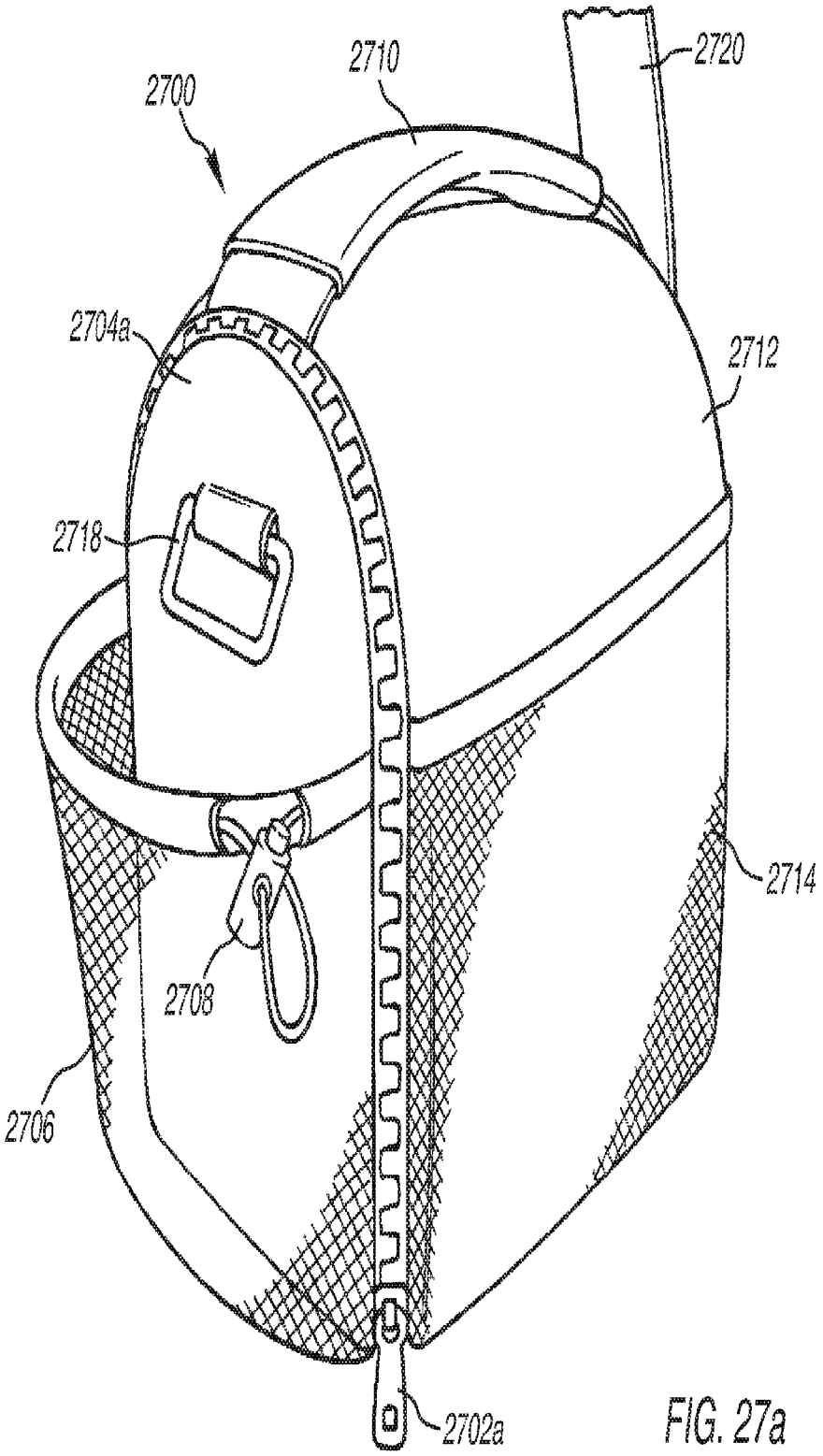
FIG. 27A is a perspective view of a convertible container in an erect, assembled configuration with a single zipper on each wall end to maintain the erect, assembled configuration.

FIG. 27A is a perspective view of a convertible container 2700 in an erect, assembled configuration with a single zipper 2702*a* on each wall end 2704*a* instead of two zippers as shown in FIG. 26A. The convertible container 2700 includes an exterior mesh pocket 2706 with a closable drawstring 2708 to adjust the opening size of the pocket 2706. A flexible handle 2710 is attached to a top portion 2712 of the convertible container 2700, and a mesh pocket 2714 is attached to an end portion of the top portion 2712. In a specific embodiment, the footprint of the convertible container 2700 in the erect, assembled configuration is about 5 inches by 8.25 inches. An optional mounting bracket 2718 receives a removable shoulder strap 2720. An application for the convertible container 2700 is a lunch box, as discussed above in connection with FIG. 26A.

Figure 27B:
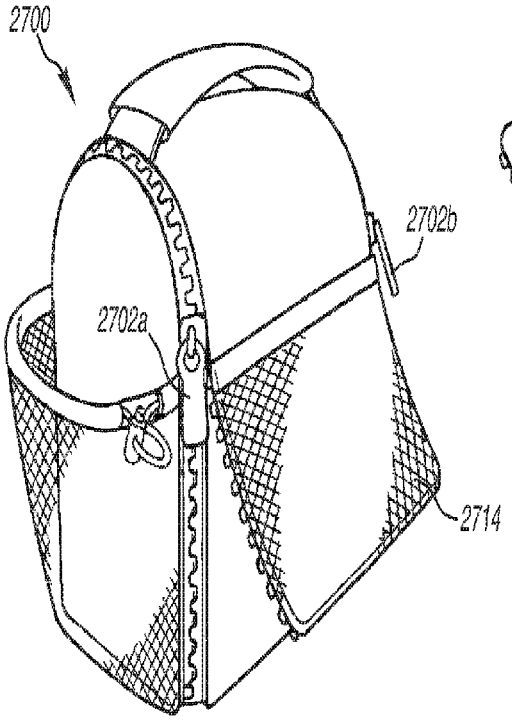
FIG. 27B is a perspective view of the convertible container shown in FIG. 27A with the zippers partially unzipped.
Figure 27C:
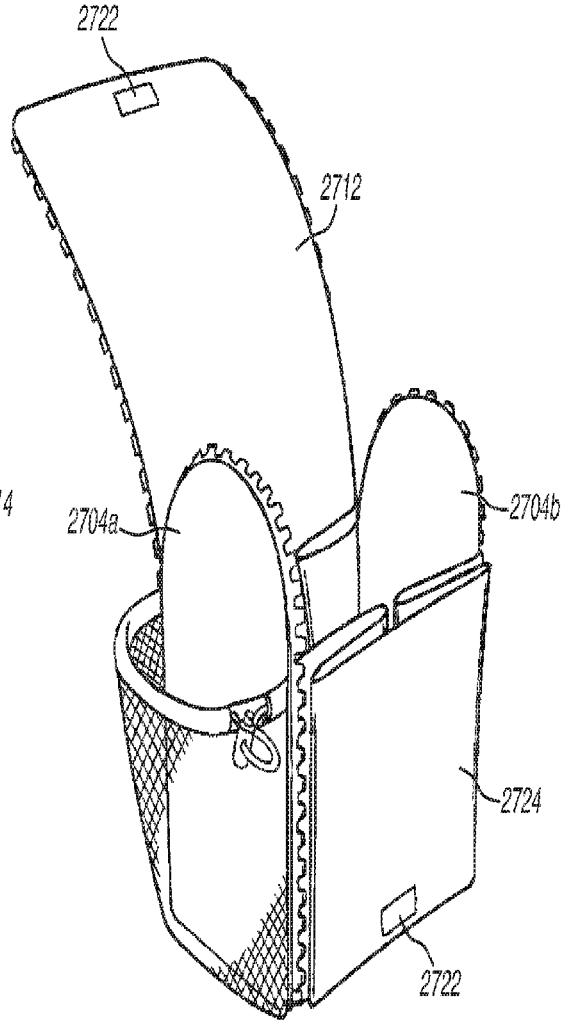
FIG. 27C is a perspective view of the convertible container shown in FIG. 27B with the zippers completely unzipped.
Figure 27D:
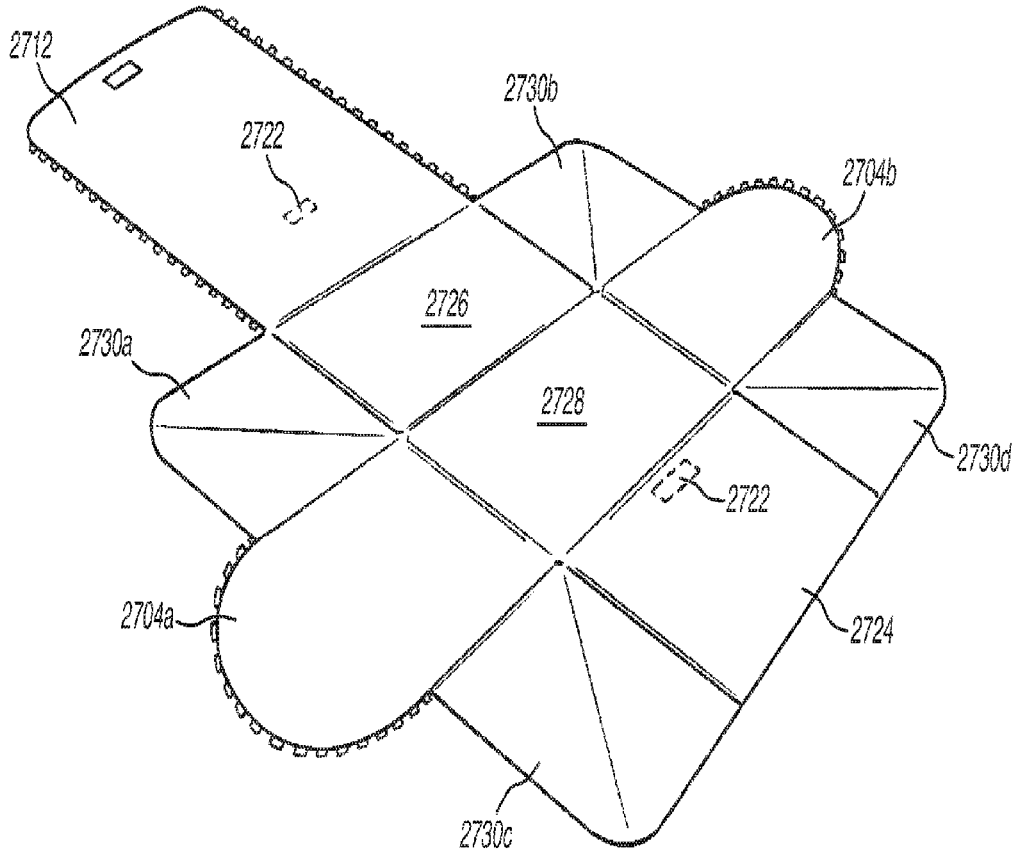
FIG. 27D is a perspective view of the convertible container shown in FIG. 27A in an open, flattened configuration.

FIG. 27B is a perspective view of the convertible container shown in FIG. 27A with the zipper 2702*a* partially unzipped (a corresponding zipper 2702*b* is also shown partially unzipped). The mesh pocket 2714 begins to separate when it is detached from a Velcro strap 2722 (FIG. 27C). As the zippers 2702*a,b* are unzipped completely, the top portion 2712 detaches from the wall ends 2704*a,b*. A wall side 2724 is revealed and unfolded along with wall side 2726 until the convertible container 2700 is in an open, flattened configuration (FIG. 27D). In this configuration, the convertible container 2700 has a base 2728, wall ends 2704*a,b*, wall sides 2724, 2726, a top portion 2712, and corner baffles 2730*a,b,c,d*. In a specific embodiment, the approximate footprint of the convertible container 2700 in the open, flattened configuration shown in FIG. 27D without the top portion 2712 is approximately 16 inches by 19.25 inches. The top portion adds an additional footprint approximately 8.25 inches by 13.4 inches. Each corner baffle 2730*a,b,c,d* measures approximately 5.5 inches by 5.5 inches. These measurements are exemplary only, and are intended to show the footprint size of the convertible container 2700 in its erect, assembled configuration (5"×8.25") versus in its open, flattened configuration (16"×19.25"), a nearly 7.5-fold increase in surface area.

Figure 27E:
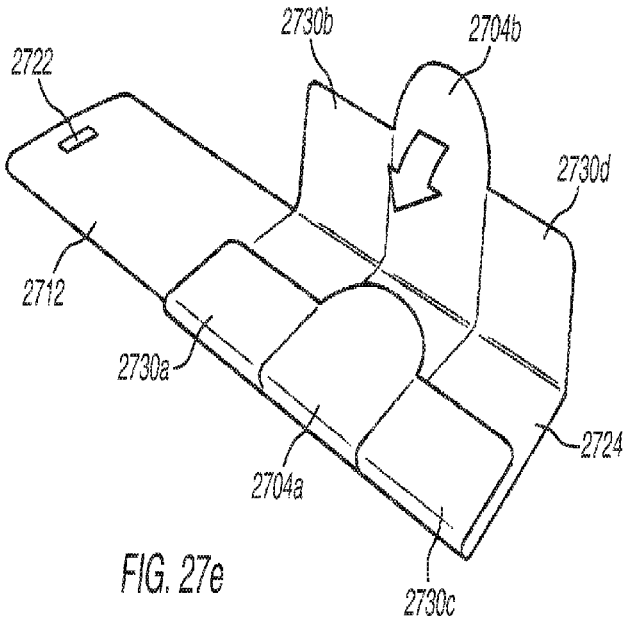
FIGS. 27E-H illustrate various views of a folding method transforming the convertible container of FIG. 27D from its open, flattened configuration into a stacked, folded configuration according to an embodiment of the present invention.
Figure 27F:
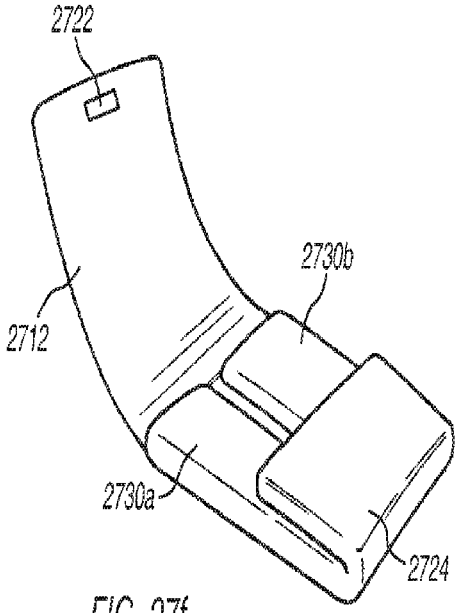
Figure 27G:
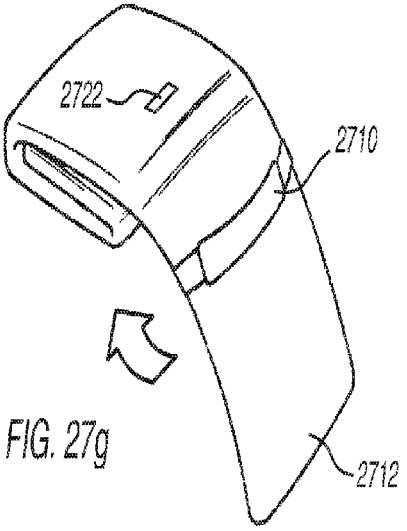
Figure 27H:
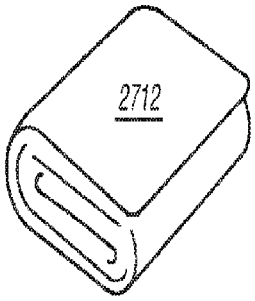

FIGS. 27E-H illustrate various views of a technique for transforming the convertible container of FIG. 27D from its open, flattened configuration into a stacked, folded configuration according to an embodiment of the present invention. The wall end 2704*a* is folded inward, which also folds the corner baffles 2730*a,c* (FIG. 27E). The wall end 2704*b* is then folded over the wall end 2704 (FIG. 27E). The wall side 2724 is folded over the wall ends 2704*a,b* (FIG. 27F), and then the top portion 2712 is folded over the wall side 2724, resulting in a stacked, folded configuration (FIG. 27H).

Figure 28A:
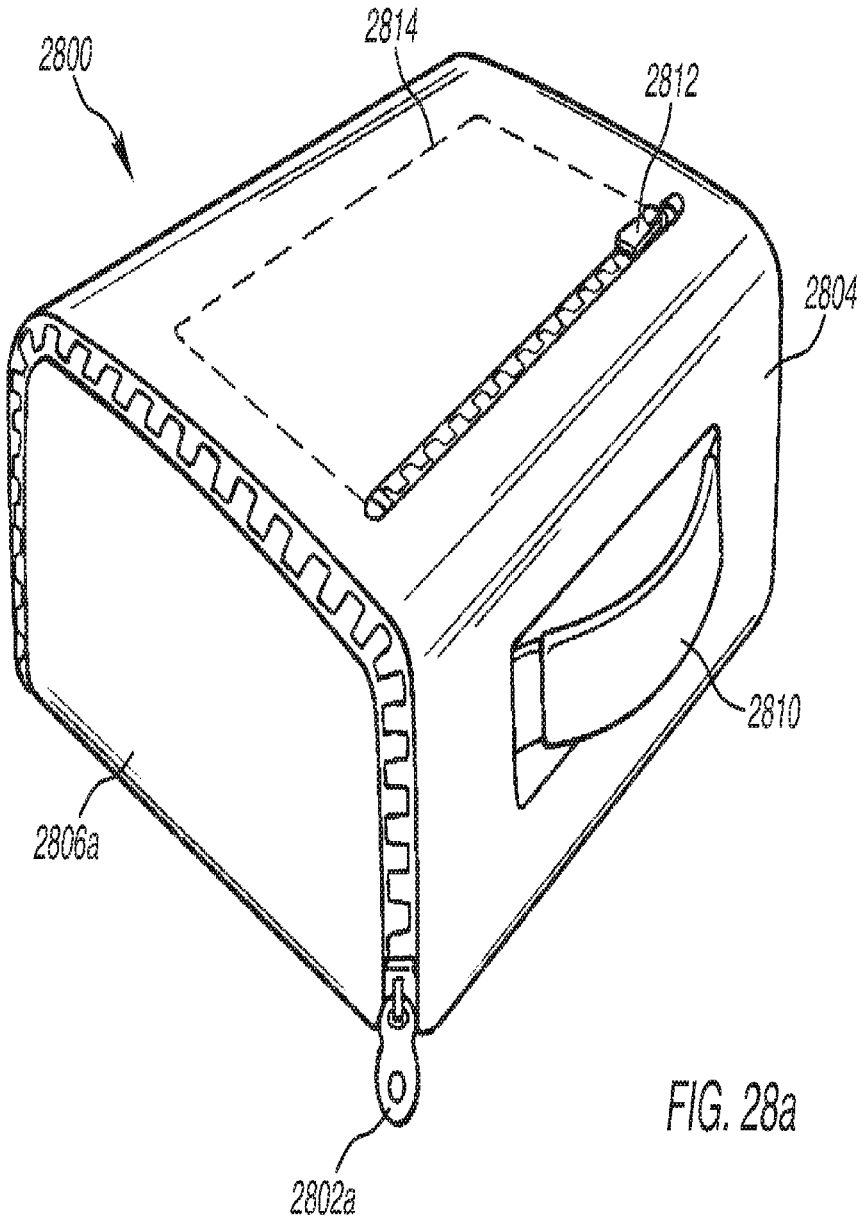
FIG. 28A is a perspective view of a convertible container lying on a side having a substantially rectangular shape in an erect, assembled configuration according to an embodiment of the present invention.

FIG. 28A is a perspective view of a convertible container 2800 lying on a side having a substantially rectangular shape in an erect, assembled configuration according to an embodiment of the present invention. The convertible container 2800 includes a zipper 2802*a* (and a corresponding zipper 2802*b*, not shown due to perspective view), a top portion 2804, an end wall 2806*a* (and a corresponding hidden end wall 2806*b*), a handle 2810, a zipper 2812 that is reclosable to permit access to a pocket 2814 formed in the top portion 2804 of the convertible container 2800. In a specific embodiment, the convertible container 2800 has a footprint of approximately 9 inches by 3.75 inches and a height of about 6 inches.

Figure 28C:
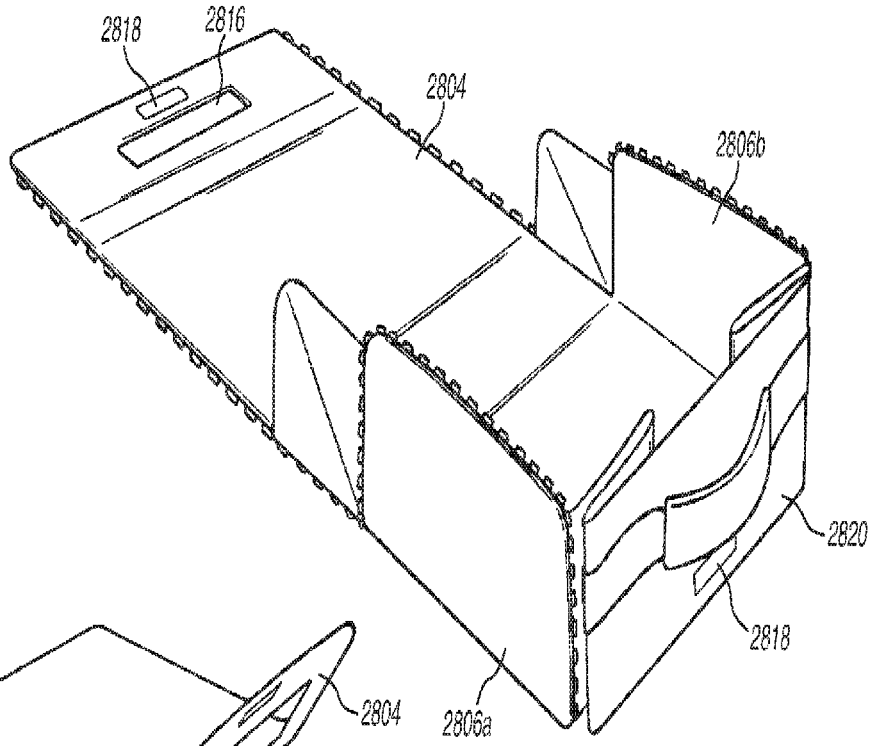
FIG. 28C is a perspective view of the convertible container shown in FIG. 28B in which the zippers are completely unzipped.
Figure 28B:
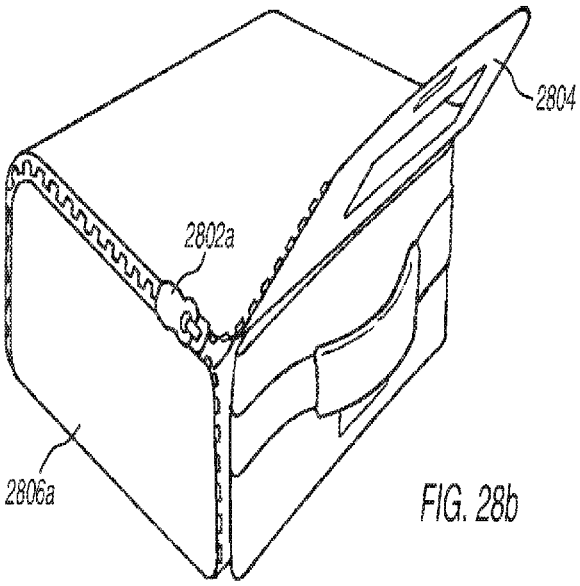
FIG. 28B is a perspective view of the convertible container shown in FIG. 28A in which the top flap is partially unzipped.

To convert the convertible container 2800 from its erect, assembled configuration into an open, flattened configuration, the zippers 2802*a,b* are unzipped to free the top portion from the end walls 2806*a,b* (FIG. 28B), which are removably secured together by a Velcro strap 2818 (FIG. 28C). The zippers 2802*a,b* follow a generally U-shaped path along three of the four sides of the corresponding end walls 2806*a,b*. FIG. 28C shows the convertible container with the zippers 2802*a,b* completely unzipped, freeing the top portion 2804 from the wall ends 2806*a,b*. The handle 2810 passes through an aperture 2816 formed in the top portion 2804. The wall ends 2806*a,b* are folded down, which also opens a side wall 2820, resulting in an open, flattened configuration shown in FIG. 28D. In a specific embodiment, the footprint of the convertible container 2800 expands from about 9"×3.75" to about 16.5"×13.5" excluding the top portion 2804, yielding an approximately 6.6-fold increase in surface area. The top portion 2804 adds an additional footprint of about 9.75"×9". Each corner baffle 2824*a,b,c,d* measures about 3.75"×3.75". Note that the dimension (3.75 inches) of the wall end 2806*a* is shorter than the dimension (9 inches) of the base to facilitate folding into the stacked, folded configuration. In general, for the configuration shown in FIG. 28, it is desirable to have the dimension of the wall ends to be equal to or shorter than the dimension of the base to ensure that both wall ends fold over the base.

Figure 28D:
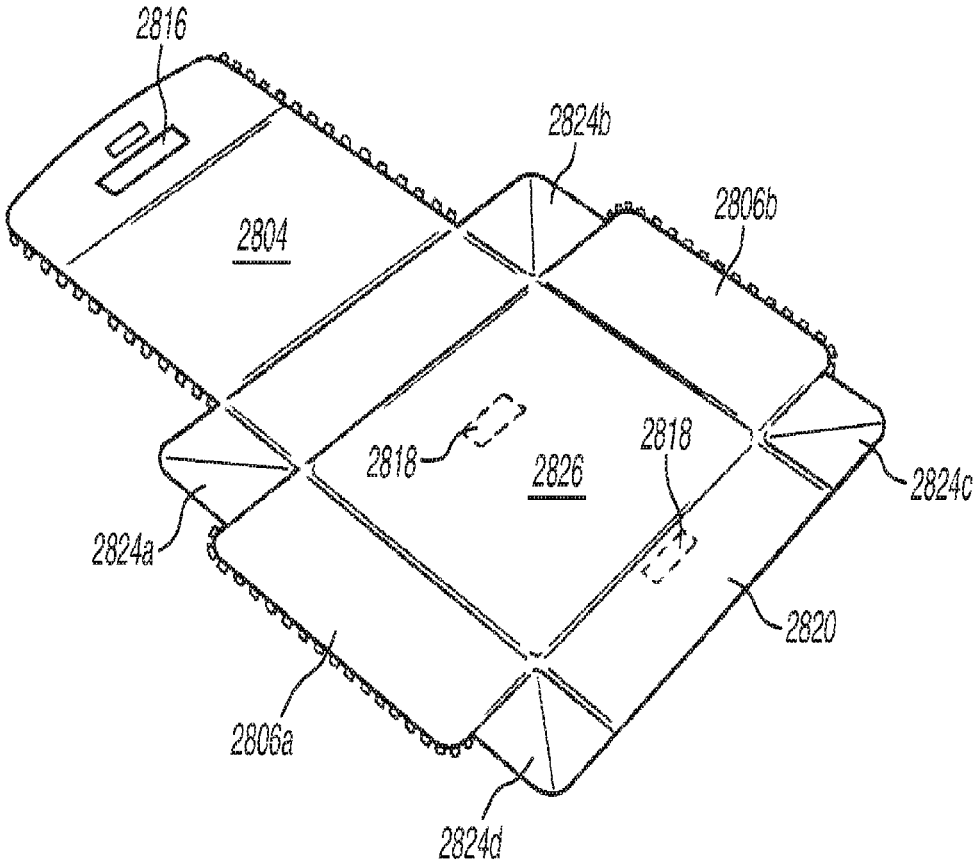
FIG. 28D is a perspective view of the convertible container shown in FIG. 28A in an open, flattened configuration.
Figure 28E:
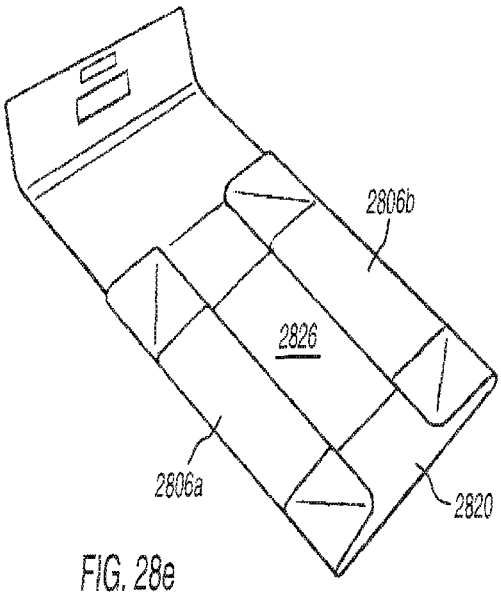
FIGS. 28E-H illustrate various views of a folding method transforming the convertible container of FIG. 28D from its open, flattened configuration into a stacked, folded configuration according to an embodiment of the present invention.
Figure 28F:
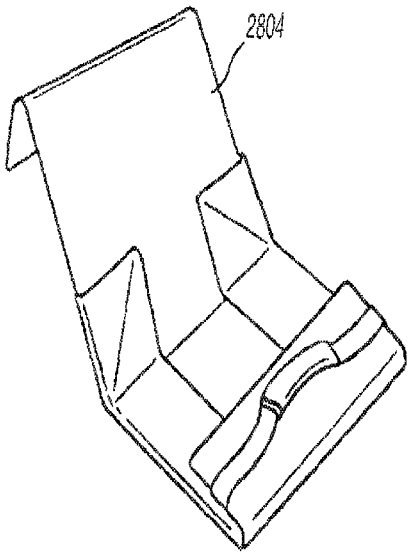
Figure 28G:
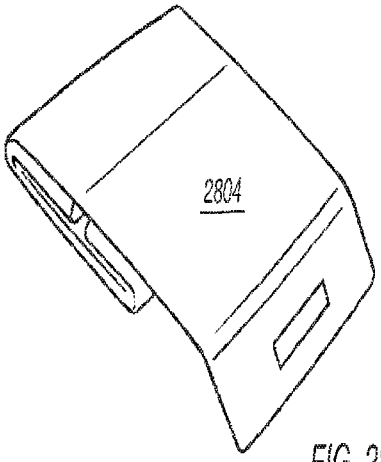
Figure 28H:
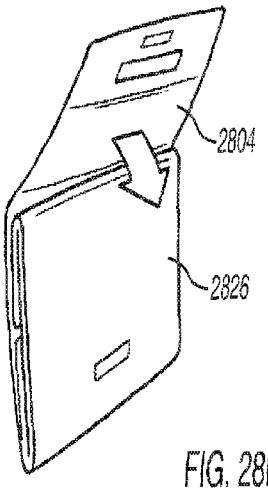

FIGS. 28E-H illustrate various views of a technique for transforming the convertible container 2800 of FIG. 28D from its open, flattened configuration (FIG. 28D) into a stacked, folded configuration according to an embodiment of the present invention. Wall ends 2806*a,b* are folded inward toward a base 2826 (FIG. 28E), and the wall side 2820 is folded over the folded wall ends 2806*a,b* (FIG. 28F). The top portion 2804 is folded over the base 2826 (FIG. 28H), resulting in a stacked, folded configuration.

Figure 29A:
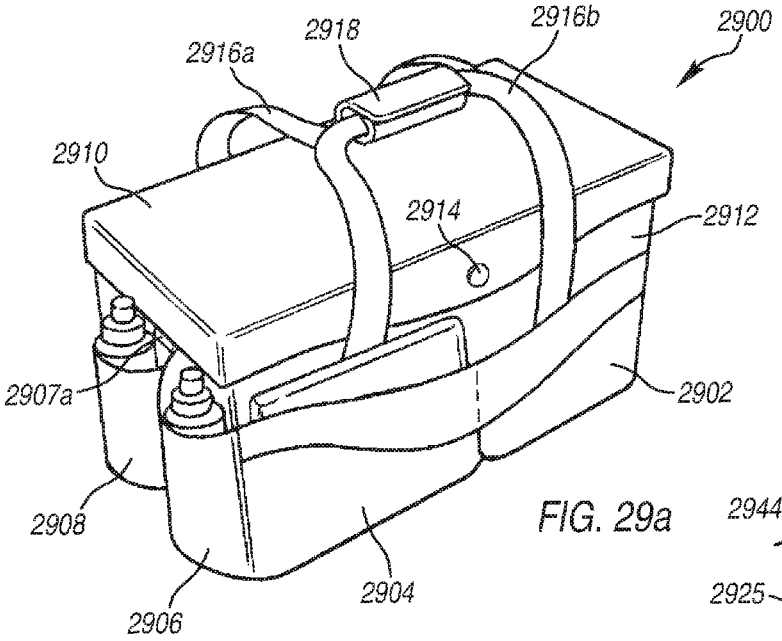
FIG. 29A is a perspective view of a convertible container in an erect, assembled configuration showing exterior pockets.

FIG. 29A is a perspective view of a convertible container 2900 in an erect, assembled configuration showing exterior pockets 2902, 2904, 2906, 2908. Other pockets 2903, 2905 are also shown in FIG. 29B. The convertible container 2900 includes a lid portion 2910 that is secured to a wall side 2912 by a snap 2914, which can be, in other embodiments, any other reclosable fastening mechanism such as Velcro or a button. The convertible container 2900 further includes handle straps 2916*a,b* that are coupled together via a strap 2918 that may include Velcro to secure the strap around the handle straps 2916*a,b*. The pockets 2903, 2905, 2906, 2908 are made from a flexible material so that they fold flat when the convertible container 2900 is in an open, flattened configuration. An application for the convertible container 2900 is a container for holding baby-related items, such as bottles (which can be inserted into the pockets 2906, 2908, for example), baby wipes (which can be inserted into pockets 2902 or 2904, for example), a mobile phone (which can be inserted into pocket 2903, for example), and pens/pencils (which can be inserted into pocket 2905, for example). Shoulder strap hooks 2907*a,b* can receive an optional shoulder strap (not shown) for ease of carrying.

FIG. 29B is a perspective view of the convertible container of FIG. 29A in which the lid portion 2910 and a wall side 2920 is opened to reveal inner pockets 2924, 2925, 2926, 2927, 2928, 2929, 2930, 2931, 2932, some of which are detachable (see FIG. 29C), according to an embodiment of the present invention. In the partially opened configuration shown in FIG. 29B, the convertible container 2900 functions, in a specific embodiment, as an instant baby changing mat with the necessary baby-changing items within close reach. For example, baby wipes, powder, baby toys, towels, diapers, and the like can be stored in any of the pockets 2924-2932. A vent hole 2950, which is optionally covered by a mesh, vents odors and moisture away from the interior of the convertible container 2900 when in an erect, assembled configuration (FIG. 29A). Vent holes can be incorporated into any convertible container discussed herein.

Figure 29C:
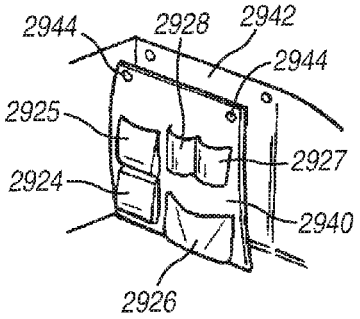
FIG. 29C is a partial perspective view of a removable inner wall end that includes various pockets, where the removable inner wall end snaps to the interior of the convertible container shown in FIG. 29B.
Figure 29B:
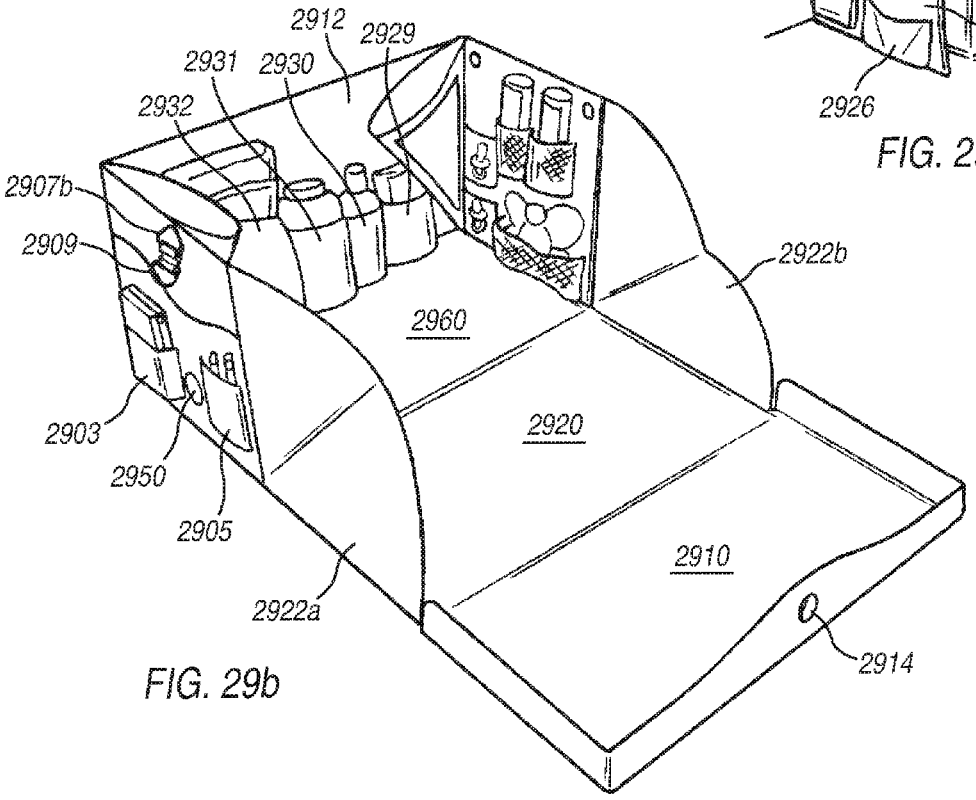
FIG. 29B is a perspective view of the convertible container of FIG. 29A in which one side is opened to reveal inner pockets, some of which are detachable, according to an embodiment of the present invention.

FIG. 29C is a partial perspective view of a removable inner wall end 2940 that includes pockets 2924-2927. The removable inner wall end 2940 is removably secured to a wall end 2942 of the convertible container 2900 by snaps 2944.

Figure 29D:
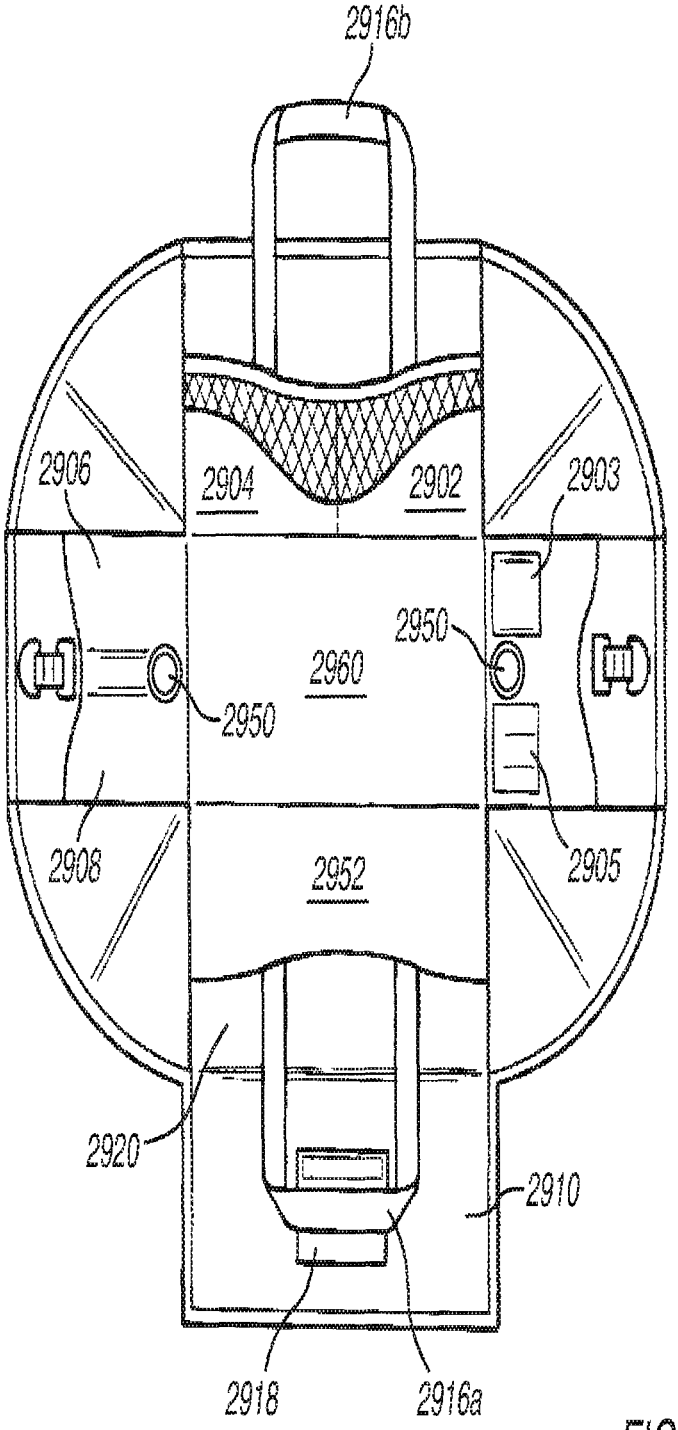
FIG. 29D is a top view of the exterior of the convertible container shown in FIG. 29A in an open, flattened configuration.

FIG. 29D is a top view of the exterior of the convertible container shown in FIG. 29A in an open, flattened configuration. The pockets 2902, 2903, 2904, 2905, 2907*a,b*, and 2952 are flexible so that they fold substantially flat when positioned against a flat surface.

Figure 29E:
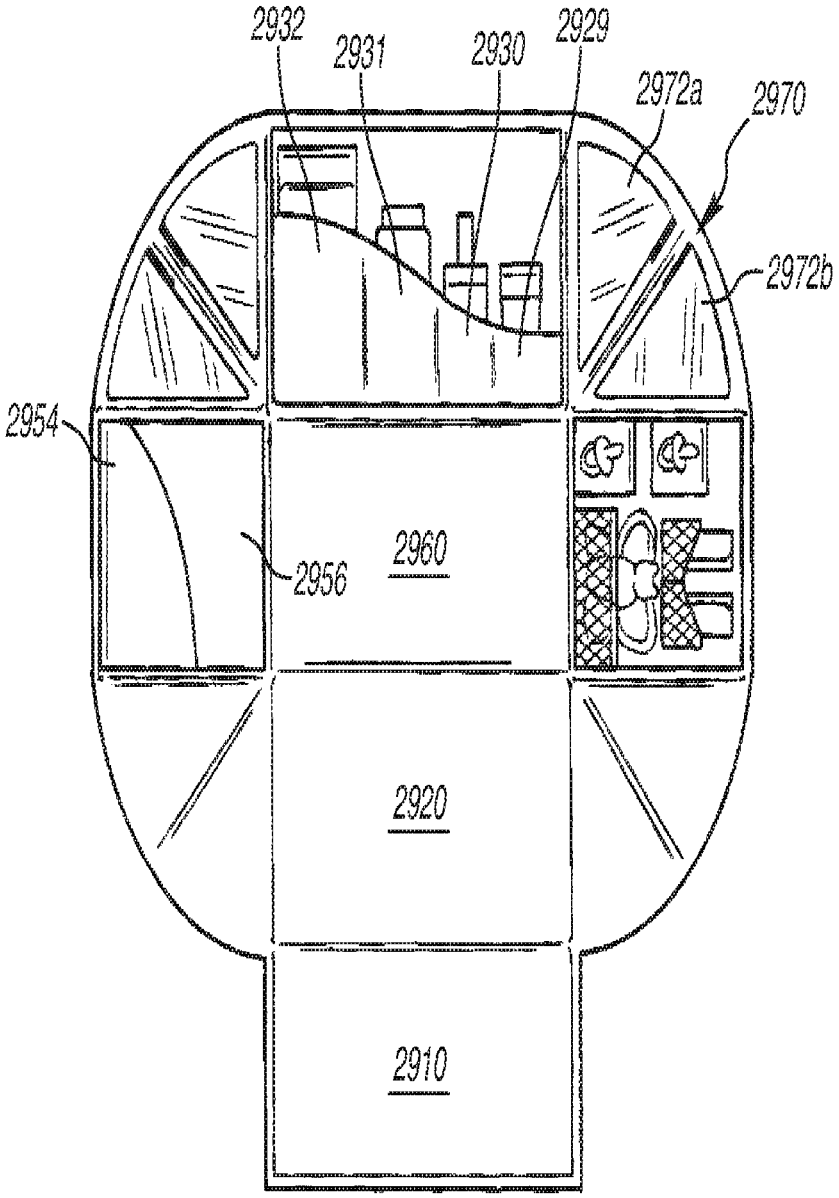
FIG. 29E is a top view of the interior of the convertible container shown in FIG. 29A in an open, flattened configuration.

FIG. 29E is a top view of the interior of the convertible container 2900 shown in FIG. 29A in an open, flattened configuration. An additional pocket 2954 is shown, which can store baby wipes, for example. An access hole 2956 is formed in the pocket 2954 for this purpose. One of the inwardly biased corner baffles 2929 is shown with clear plastic wedges 2972*a,b* sewn onto the interior of the inwardly biased corner baffle 2929. The plastic wedges 2972*a,b* stiffen the corner baffle 2929 to provide rigidity and to encourage the corner baffle 2929 to fold toward the interior of the convertible container 2900.

Figure 30A:
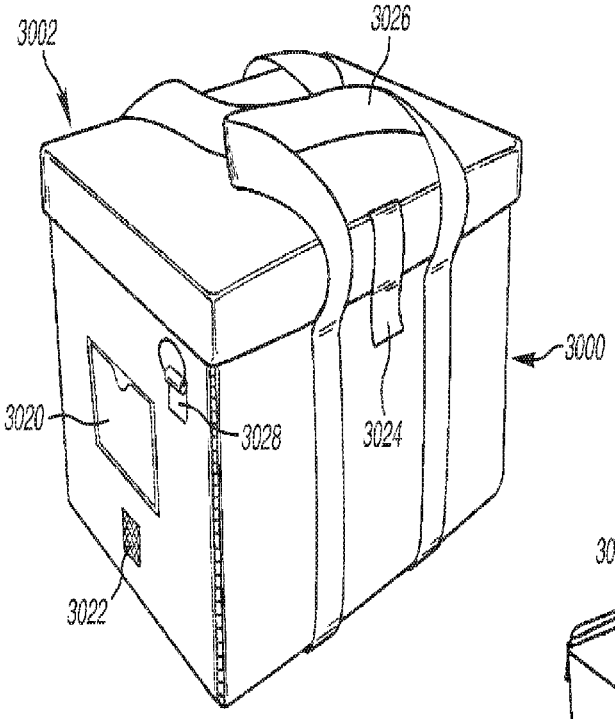
FIG. 30A is a perspective view of a convertible container and removable lid in an erect, assembled configuration showing Velcro securing straps, a vent, a loop for shoulder strap, and a clear window that also accepts a label, according to an embodiment of the present invention.
Figure 30B:
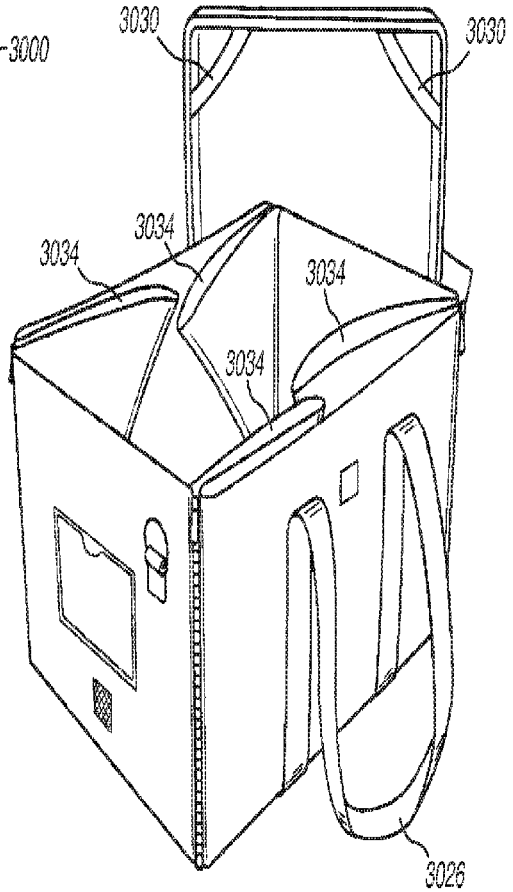
FIG. 30B is a perspective view of the convertible container shown in FIG. 30A with the removable lid removed to reveal elastic straps for holding within the lid the convertible container when assembled into a stacked, folded configuration.

FIG. 30A is a perspective view of a convertible container 3000 and a removable lid 3002 in an erect, assembled configuration showing a Velcro securing strap 3024, a vent 3022, a loop for an optional shoulder strap 3028, and a clear window 3020 that also accepts a label, according to an embodiment of the present invention. Handle straps 3026 provide a convenient way to carry the convertible container 3000. The convertible container 3000 includes pleated corner baffles 3034 that fold inward and lie generally flush against wall sides of the convertible container 3000.

Figure 30C:
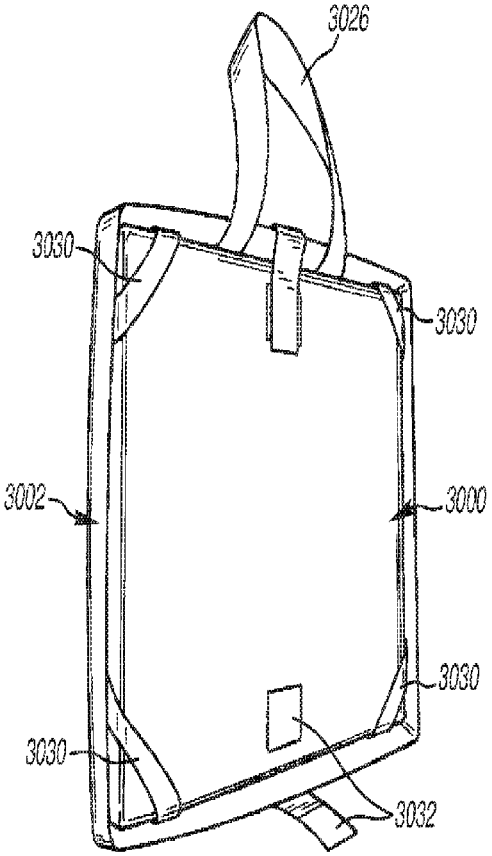
FIG. 30C is a perspective view of the convertible container shown in FIG. 30A in a stacked, folded configuration and retained within the elastic straps in the removable lid with a handle of the convertible container serving as a handle for the container-plus-lid assembly.
Figure 30D:
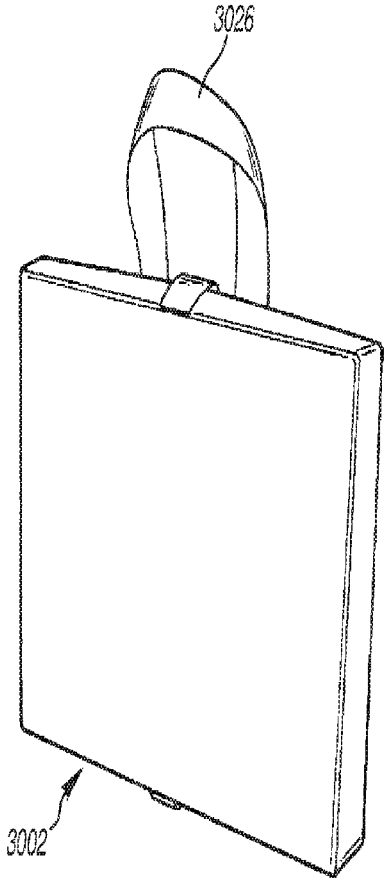
FIG. 30D is a perspective view of the reverse side of the assembly shown in FIG. 30C.

The removable lid 3002 includes elastic straps 3030 that retain the convertible container 3000 when assembled into a stacked, folded configuration (FIG. 30C). The handle strap 3026 also doubles as a handle for the stacked, folded convertible container 3000 and the removable lid 3002 (FIG. 30C). Alternatively, instead of or in addition to the elastic straps 3030, the lid 3002 may include a hook-and-loop fastener 3032 such as Velcro on a strap, which retains the lid 3002 in the convertible container 3000 when assembled in a stacked, folded configuration. To remove the convertible container 3000 from the lid, the hook-and-loop fasteners 3032 are separated.

Figure 31A:
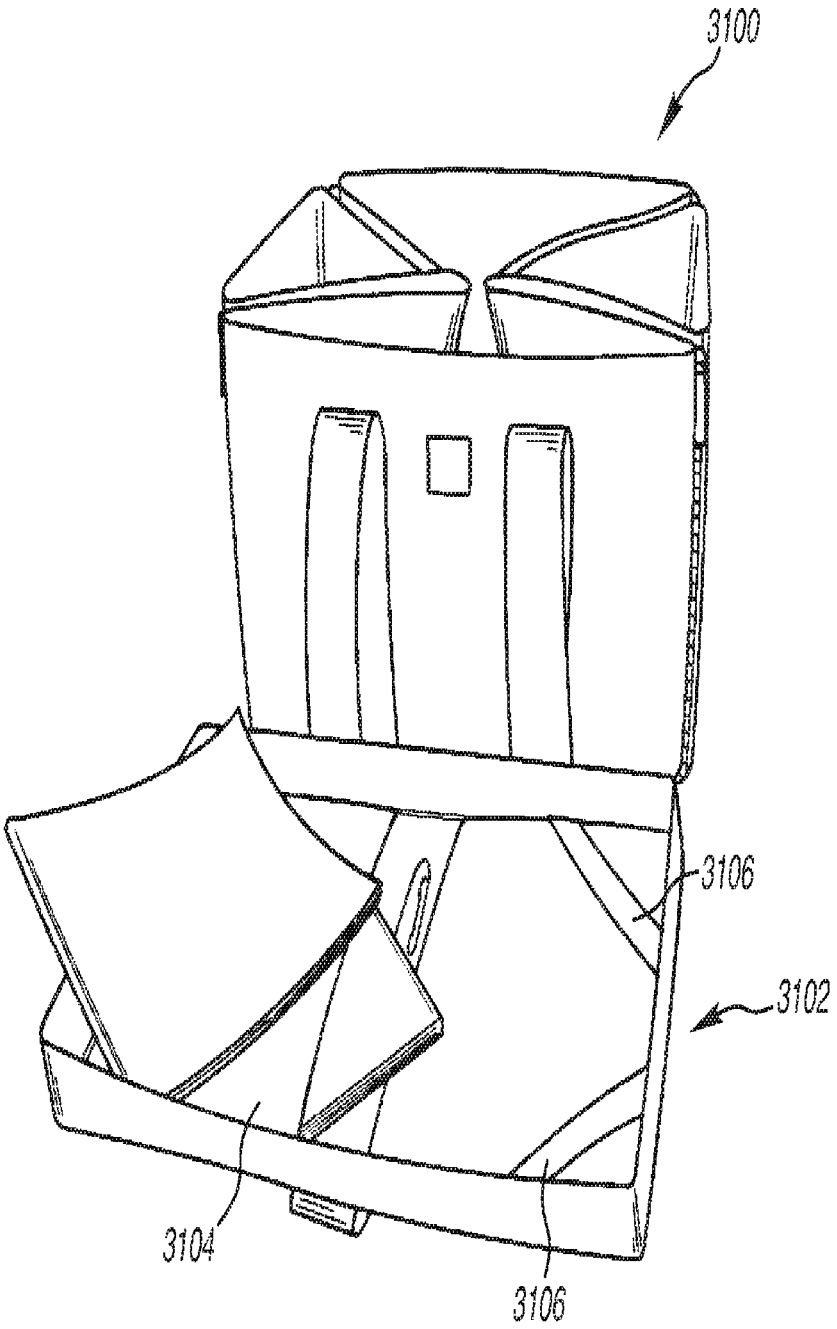
FIG. 31A is a perspective view of a convertible container with a removable lid having interior pockets within the lid and elastic straps according to an embodiment of the present invention.

FIG. 31A is a perspective view of a convertible container 3100 with a removable lid 3102 having interior pockets 3104 within the lid 3102 and elastic straps 3106 according to an embodiment of the present invention.

Figure 31B:
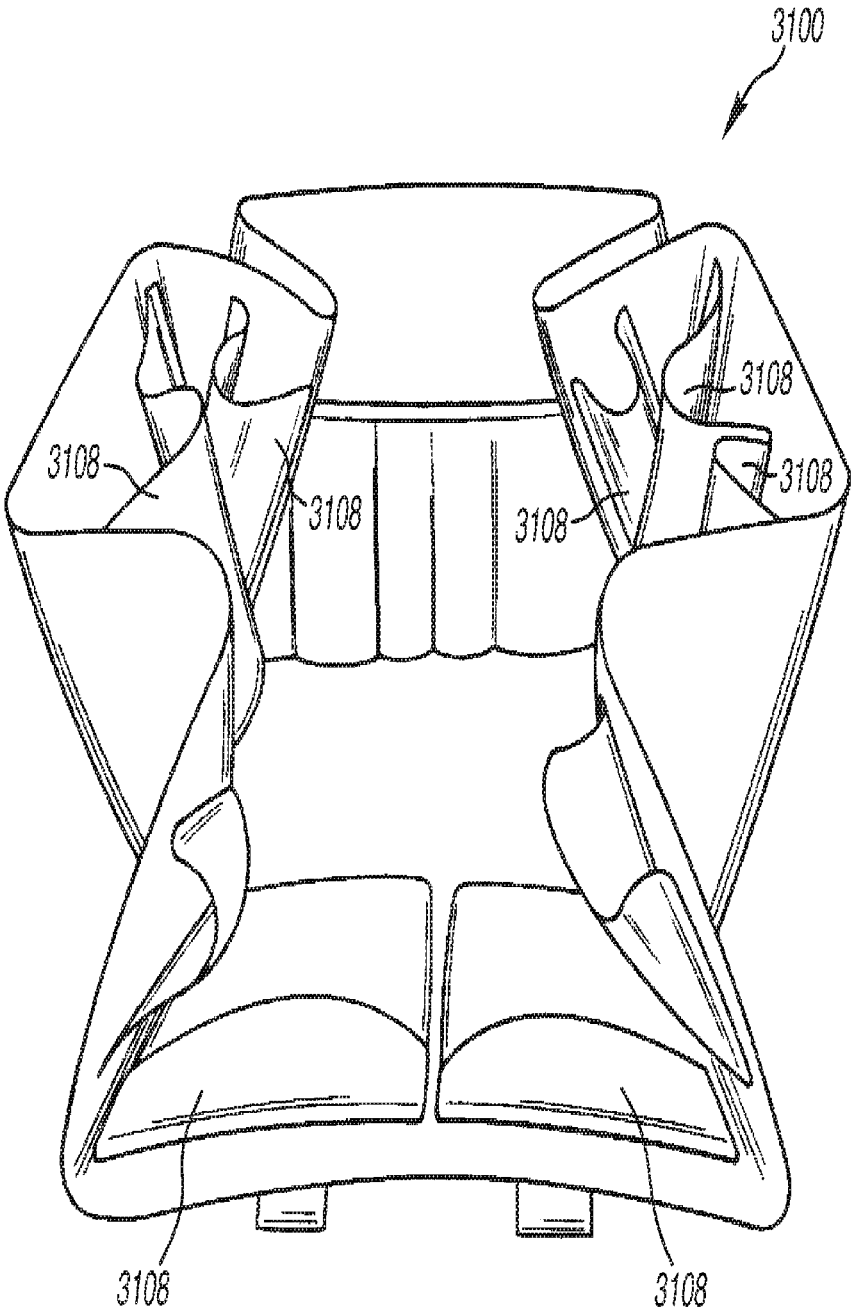
FIG. 31B is a perspective view of the convertible container shown in FIG. 31A in a partially opened configuration to reveal a plurality of pockets that are oriented to retain their contents as the wall ends and sides are opened.
Figure 31C:
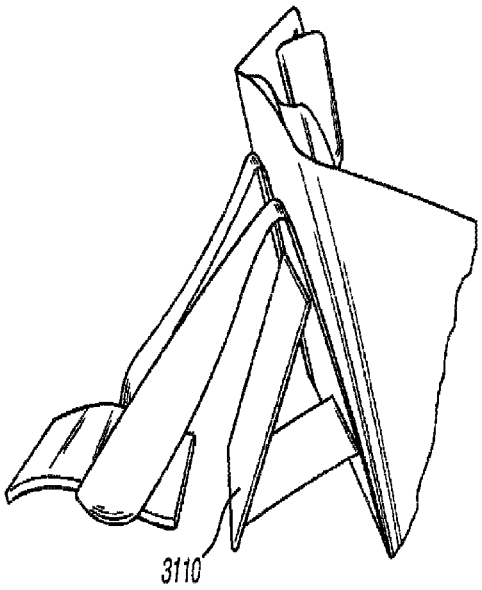
FIG. 31C is a perspective view of a portion of the collapsible container shown in FIG. 31B with a retractable easel prop leg extended to support one of the wall sides.

FIG. 31B is a perspective view of the convertible container 3100 shown in FIG. 31A in a partially opened configuration to reveal a plurality of pockets 3108 that are oriented to retain their contents as the wall ends and sides of the convertible container 3100 are opened. The convertible container 3100 is thus particularly suitable as a sales demo pack, for example, which can be carried by a sales person and unfolded on site into a sales display case to reveal the sales items, marketing and product literature, and product samples, for example. A retractable easel prop leg 3110 shown in FIG. 31C is extendable to support one of the wall sides of the convertible container 3100. When the sales pitch is over, the convertible container 3100 is rapidly converted back into an erect, assembled configuration.

Figure 32:
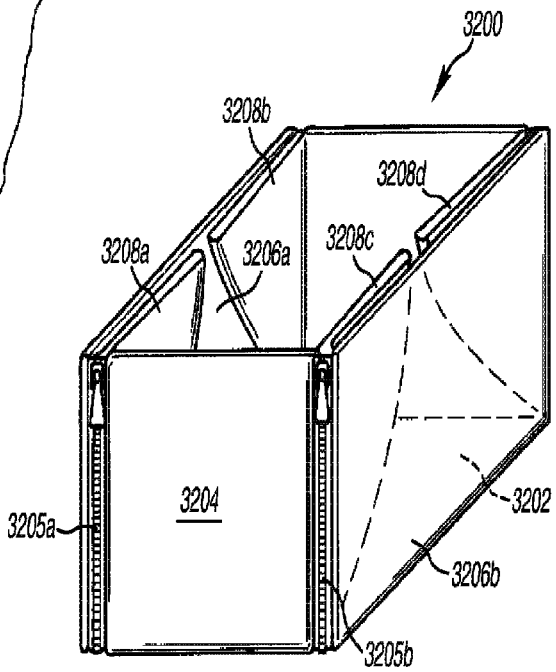
FIG. 32 is a perspective view of a convertible container having webbing or baffles forced to be substantially flush against a wall side of the convertible container in its erect, assembled configuration.

FIG. 32 is a perspective view of a convertible container 3200 having webbing or baffles 3208*a,b,c,d* forced to be substantially flush against respective wall sides 3206*a,b* of the convertible container 3200 in its erect, assembled configuration. As mentioned above in connection with FIG. 24, the present invention contemplates a biasing system whereby the webbing or baffles 3208*a,b* are biased to stay flush against the wall side 3206*a* when the convertible container 3200 is in an erect, assembled configuration. As mentioned in connection with FIG. 24, the width of a wall end 3204 is smaller than the width of a base 3202, causing the zippers 3205*a,b* to lie in substantially the same plane as the wall end 3204. Because of the forces acting upon the webbing 3208*a,b,c,d* when the zippers 3205*a,b* are zipped closed, the webbing 3208*a,b,c,d* is urged into positions generally flush against the wall sides 3206*a,b*. Additionally, the webbing 3208*a,b,c,d* is biased inwardly in accordance with the present invention to cause the webbing 3208*a,b,c,d* to fold inward toward the interior of the convertible container 3200 as it is transformed from an open, flattened configuration to an erect, assembled configuration.

The embodiments illustrated and described herein can be made from various materials for various purposes. Convertible containers designed for use as play mats can be made from cushioned materials. The core of the wall ends and wall sides are made of foam and reinforced with cardboard. The outside surfaces of the wall ends and wall sides are covered with vinyl, or similar materials, for durability and ease of cleaning. The base can be made similar to the walls with living hinge attachments. The flexible webbing can be made from vinyl, spandex, elastic or other suitable hinged, flexible, or stretchable material. Alternatively, the lid, base, wall ends and/or wall sides can be made to suit the play activity such as: molded for plastic building blocks, wood for wood blocks, carpets for dolls, etc. The lid can be construed similar to the convertible container: it can be molded plastic, cardboard, fabric, etc.

As discussed above in various embodiments, a convertible container according to the present invention can include a seamless material arranged within the interior of the convertible container. According to such an arrangement, the material is attached to the exposed ends of the walls of the convertible container to create a continuous surface (and can be non-porous to prevent liquid seepage, for example). The seamless material can be used in lieu of or in addition to the webbing described in various embodiments. It should also be noted that using a non-seamless, continuous material attached to the exposed ends of the container walls (with or without webbing) is also within the contemplation of the present invention.

Keeping articles in predictable places increases the safety of everyone. Tripping over loose toys and other articles can be avoided with the use of the convertible container. Furthermore, the closure mechanisms herein described avoid the use of loose strings, as these pose a chocking and tripping hazard.

Convertible containers designed for use as coolers or lunch containers (such as, for example, FIGS. 26, 27, 28) can be made similarly to the play mats, but insulating materials can be used. Additionally, the foam could be thicker and with sufficient body that reinforcing cardboard is not required.

Convertible containers designed for use with crafts, tools, laundry baskets, etc., can be made from harder plastics such as ABS, polycarbonate, polystyrene, polypropylene, nylon, or other suitable material. The webbing in such embodiments would be rigid, not flexible. The materials can be of various colors and can be opaque, translucent, or transparent. In this embodiment, the wall ends and wall sides can utilize living hinges, accordion hinges, or hinges molded into the plastic base and walls. In this embodiment, the flexible webbing remains constructed from a flexible or fan-folding material.

The drawings illustrate a rectangular-shaped container with upright walls; however, the container can be of any shape including but not limited to rectangular, square, triangular, hexagonal, octagonal, circular, elliptical, trapezoidal, or any regular or irregular shape. In the round embodiments, the walls can be bellows that function in an accordion-like manner.

Colors and designs printed on the interior and or exterior surface of the container add to the visual appeal of the container. In fact, the container can be used for promoting the brands with which the container can be used. For example, a building block company can advertise their brand and illustrate creations on the activity mat surface. Similarly, popular dolls and relevant scenery can be printed on the container to enhance the container's play value. Furthermore, the container can be shaped and/or printed to resemble a castle, a mansion, or other relevant theme. Additionally, areas can be provided for personalization and labeling. Still further, the convertible container can feature pop-up displays when in the open, flattened configuration to enhance the play activity.

Any of the foregoing embodiments may further include clear pockets along the interior or exterior of wall sides or wall ends of the convertible container, into which scenery or removable inserts are placed. For example, different toy-related scenery can be inserted into the clear pockets consistent with a particular play theme. Additionally or alternatively, one or more straps can be disposed on the exterior of the convertible container and adapted to hold a towel, for example. Pull tabs to encourage closure of the zippers can also be disposed proximate the zipper tails. The user grasps the pull tab with one hand while urging the zipper closed with the other. A protector pouch can also be provided to house the zipper tail when it is unzipped, thus preventing marking of the floor surface when the convertible container is in an open, flattened configuration.

Other applications for any of the foregoing embodiments in addition to those shown and described herein include a pet carrier to carry pets. Another embodiment includes integration of an electronic game, such as an interactive dance game or a video gaming system.

In a further embodiment, the walls of the container can be made to raise and lower automatically. This is accomplished with a battery-powered motor that drives gears and/or pulls cables that lift the wall sides and wall ends of the container. The motor is switched and is driven through a clutch assembly so that potential injury is avoided. The motor and drive assembly can be housed under a clear cover to provide a further point of interest and appeal to the user.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. An apparatus convertible between at least a storage container in a first configuration and an activity mat in a second configuration, comprising:

a base connected to walls;

at least one motor attached to the base;

means, connected to the motor, for raising the walls so as to transform the apparatus from the second configuration into the first configuration, wherein a ratio of a footprint of the apparatus in the second configuration to a footprint of the apparatus in the first configuration exceeds two.

2. The apparatus of claim 1, wherein the motor is a battery-powered electric motor.

3. The apparatus of claim 1, wherein the motor is a spring motor having a windable ratchet and a release for releasing the ratchet from its wound position.

4. The apparatus of claim 1, wherein the means for raising includes shafts attached to the walls and a slip clutch for preventing overloading of the motor.

5. The apparatus of claim 1, wherein the means for raising includes cables connected to the motor and secured to the walls and respective pulleys positioned to engage the cables so as to urge the walls from the second configuration to the first configuration in response to activation of the motor.

6. The apparatus of claim 1, wherein the base and the walls are coplanar when the apparatus is in the second configuration.

7. The apparatus of claim 1, further comprising a plurality of corner baffles connecting the walls together.

* * * * *